US011708205B2

(12) United States Patent
Ghirardi et al.

(10) Patent No.: US 11,708,205 B2
(45) Date of Patent: Jul. 25, 2023

(54) PACKAGE, PROCESS AND APPARATUS FOR MAKING SAID PACKAGE

(71) Applicant: Cryovac, LLC, Charlotte, NC (US)

(72) Inventors: Alessandra Ghirardi, Milan (IT); Stefano Capitani, Como (IT); Ivo Pascolo, Senago (IT)

(73) Assignee: Cryovac, LLC, Charlotte, NC (US)

( * ) Notice: Subject to any disclaimer, the term of this patent is extended or adjusted under 35 U.S.C. 154(b) by 429 days.

(21) Appl. No.: 16/954,579

(22) PCT Filed: Dec. 20, 2018

(86) PCT No.: PCT/IB2018/060449

§ 371 (c)(1),
(2) Date: Jun. 17, 2020

(87) PCT Pub. No.: WO2019/123382

PCT Pub. Date: Jun. 27, 2019

(65) Prior Publication Data

US 2020/0331683 A1 Oct. 22, 2020

(30) Foreign Application Priority Data

Dec. 22, 2017 (IT) ..... 102017000148881

(51) Int. Cl.
*B65D 77/20* (2006.01)
*B65B 5/02* (2006.01)
(Continued)

(52) U.S. Cl.
CPC ..... *B65D 77/204* (2013.01); *B65B 5/02* (2013.01); *B65B 5/04* (2013.01); *B65B 7/2878* (2013.01);
(Continued)

(58) Field of Classification Search
CPC ..... B65D 2577/2041; B65D 2571/00734; B65D 2571/00123; B65D 2571/00129;
(Continued)

(56) References Cited

U.S. PATENT DOCUMENTS 2,762,720 A 9/1956 Michel
4,058,247 A * 11/1977 Florian ..... B65D 1/34 229/407
4,442,969 A * 4/1984 Holden ..... B65D 1/34 D9/425
(Continued)

FOREIGN PATENT DOCUMENTS

DE 19706825 A1 9/1998
EP 1918220 A1 5/2008
(Continued)

*Primary Examiner* — Kareen K Thomas
(74) *Attorney, Agent, or Firm* — Jason R. Womer

(57) ABSTRACT

The present invention relates to a package for containing a product comprising a support (1) which has: a base (2) configured for receiving one or more products, a perimetral edge (6) which surrounds the base (2), a removable portion (21) extending as a prolongation of the perimetral edge (6) away from the base (2). The package further comprises: a closing film (10) engaged with a portion of the perimetral edge (6) and with the removable portion (21) for defining a housing compartment (22) for the product, a gripping portion (22) emerging from the perimetral edge (6); the removable portion (21) and at least a part of the closing film (10) are configured for being separated from the support (1) during an opening step of the package. The package is configured for defining a closing condition in which: the closing film in cooperation with the support (1) prevents access to the housing compartment (5), and the removable portion (21) is aligned with at least a portion (6*a*) of the perimetral edge (6) from which it extends as a prolongation. The removable portion (21) has a cavity (21*a*) the concavity whereof, at least in the closed condition of the package, faces the perimetral edge (6); the gripping portion (22) is
(Continued)

disposed, at least in the closed condition of the package, within said cavity (21*a*). The present invention also relates to a process and an apparatus for making said package.

17 Claims, 32 Drawing Sheets

(51) Int. Cl.
*B65B 5/04* (2006.01)
*B65B 7/28* (2006.01)
*B65B 61/02* (2006.01)

(52) U.S. Cl.
CPC ..... *B65B 61/02* (2013.01); *B65D 2577/2066* (2013.01); *B65D 2577/2083* (2013.01)

(58) Field of Classification Search
CPC ..... B65D 2571/00135; B65D 2571/00141; B65D 2571/00148; B65D 77/204; B65D 2577/2066; B65D 2577/2083; B65B 5/02; B65B 5/04; B65B 7/2878; B65B 61/02
See application file for complete search history.

(56) References Cited

U.S. PATENT DOCUMENTS

| | | | | |
|---|---|---|---|---|
| 4,616,762 | A * | 10/1986 | Alexander | A47J 36/022 220/573.1 |
| 4,794,978 | A | 1/1989 | Lauener | |
| 5,413,843 | A | 5/1995 | Mann et al. | |
| 5,916,613 | A | 6/1999 | Stockley | |
| 7,803,416 | B2 | 9/2010 | Roveda et al. | |
| 8,129,007 | B2 | 3/2012 | Forloni | |
| 8,622,206 | B2 | 1/2014 | Miller et al. | |
| 8,820,530 | B1 * | 9/2014 | Blagg | B65D 1/34 206/505 |
| 8,895,092 | B1 * | 11/2014 | Field | B65D 1/36 220/675 |
| D746,131 | S * | 12/2015 | Astorga | D9/425 |
| 10,433,944 | B2 * | 10/2019 | Ferrand | B65D 11/14 |
| 10,961,010 | B2 * | 3/2021 | Clements | A47G 23/06 |
| 2009/0208316 | A1 * | 8/2009 | Mayer | B65B 69/00 414/800 |
| 2010/0258471 | A1 * | 10/2010 | Enriquez | B65D 1/34 220/608 |
| 2012/0006842 | A1 * | 1/2012 | Overgaag | B65D 21/0217 220/810 |
| 2018/0029767 | A1 * | 2/2018 | Chung | B29C 41/14 |

FOREIGN PATENT DOCUMENTS

| | | | |
|---|---|---|---|
| EP | 2159164 | A1 | 3/2010 |
| FR | 3002209 | A1 | 8/2014 |
| WO | 2014189971 | A1 | 11/2014 |

* cited by examiner

FIG.11
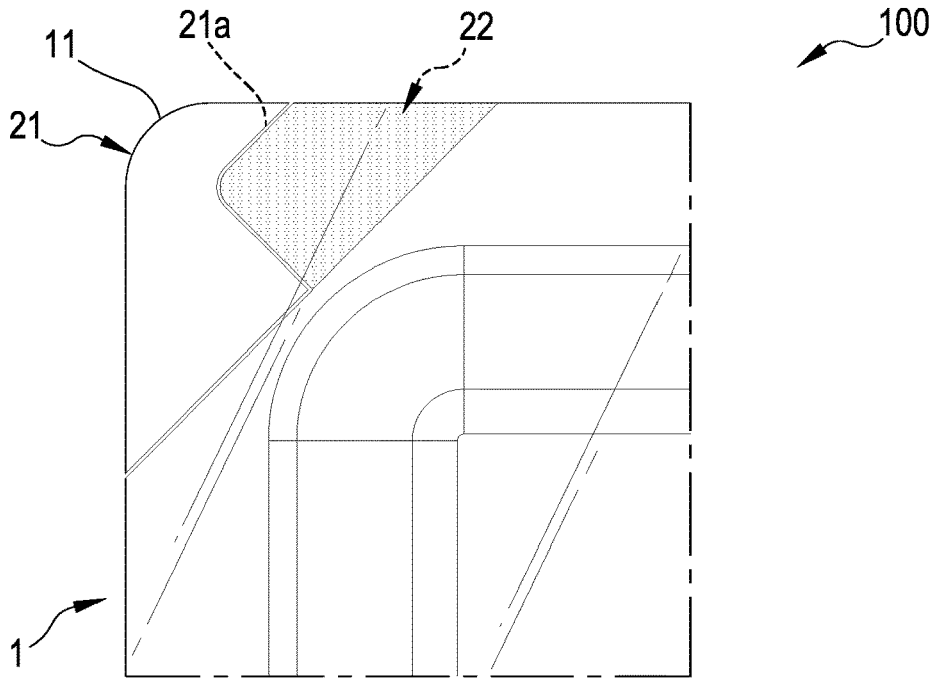
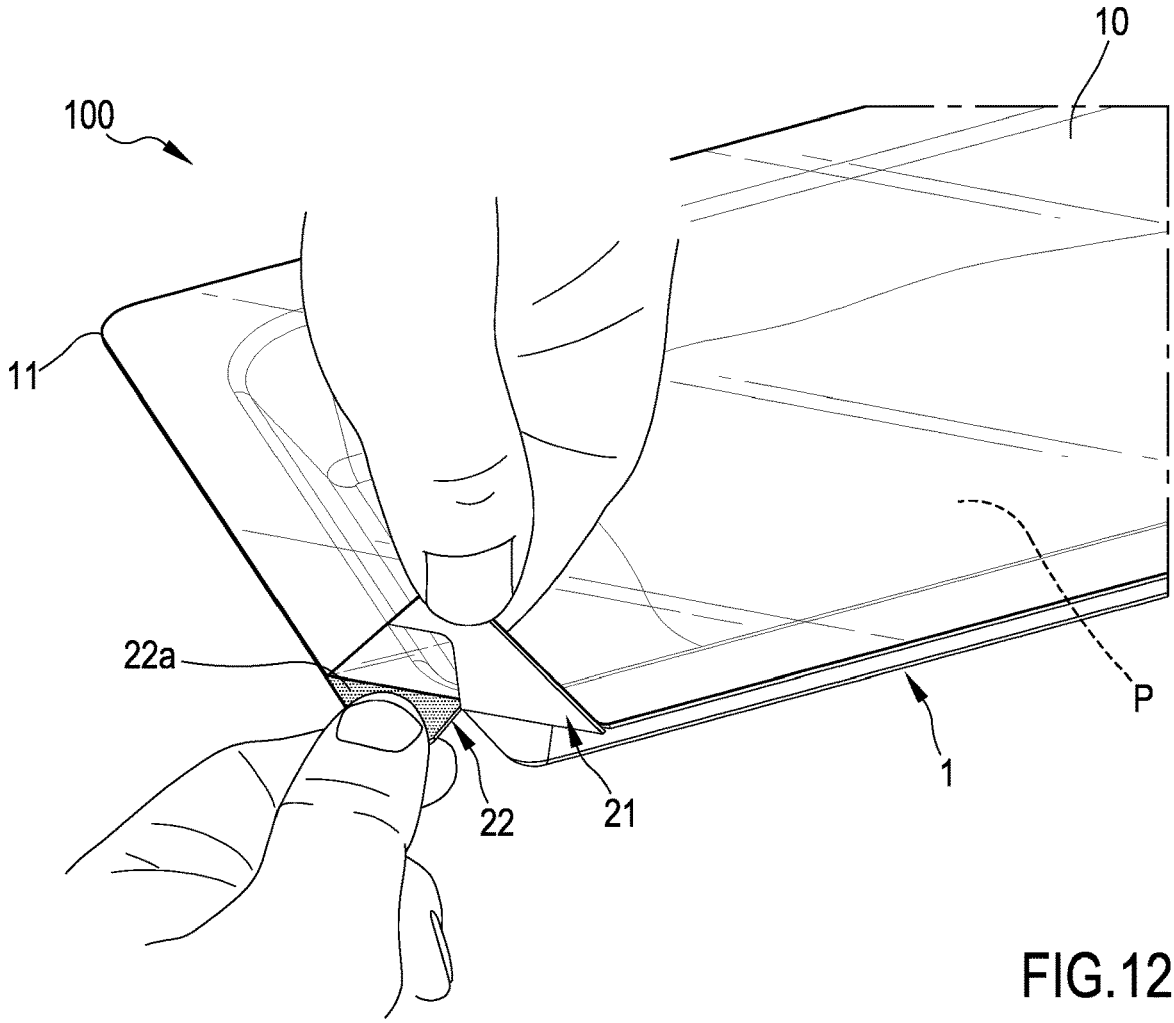
FIG.12

FIG.15
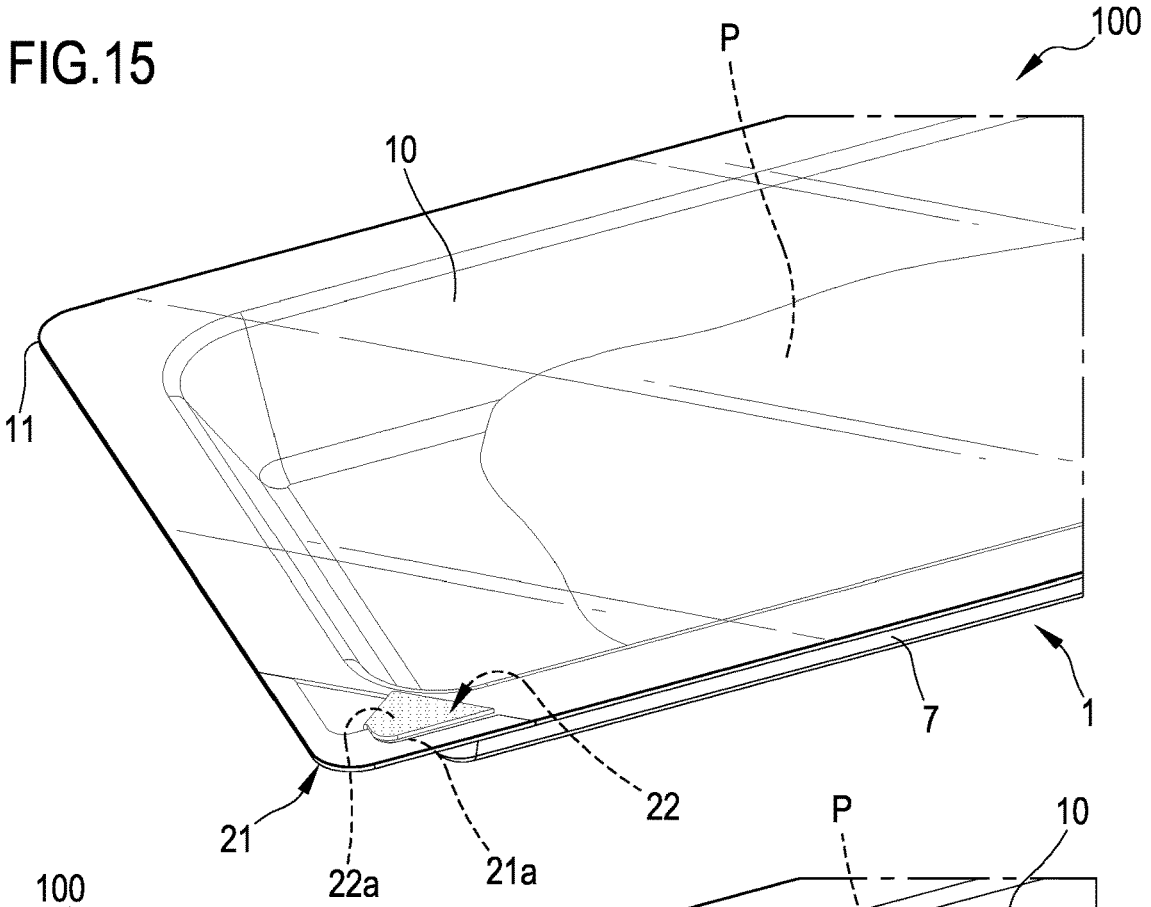
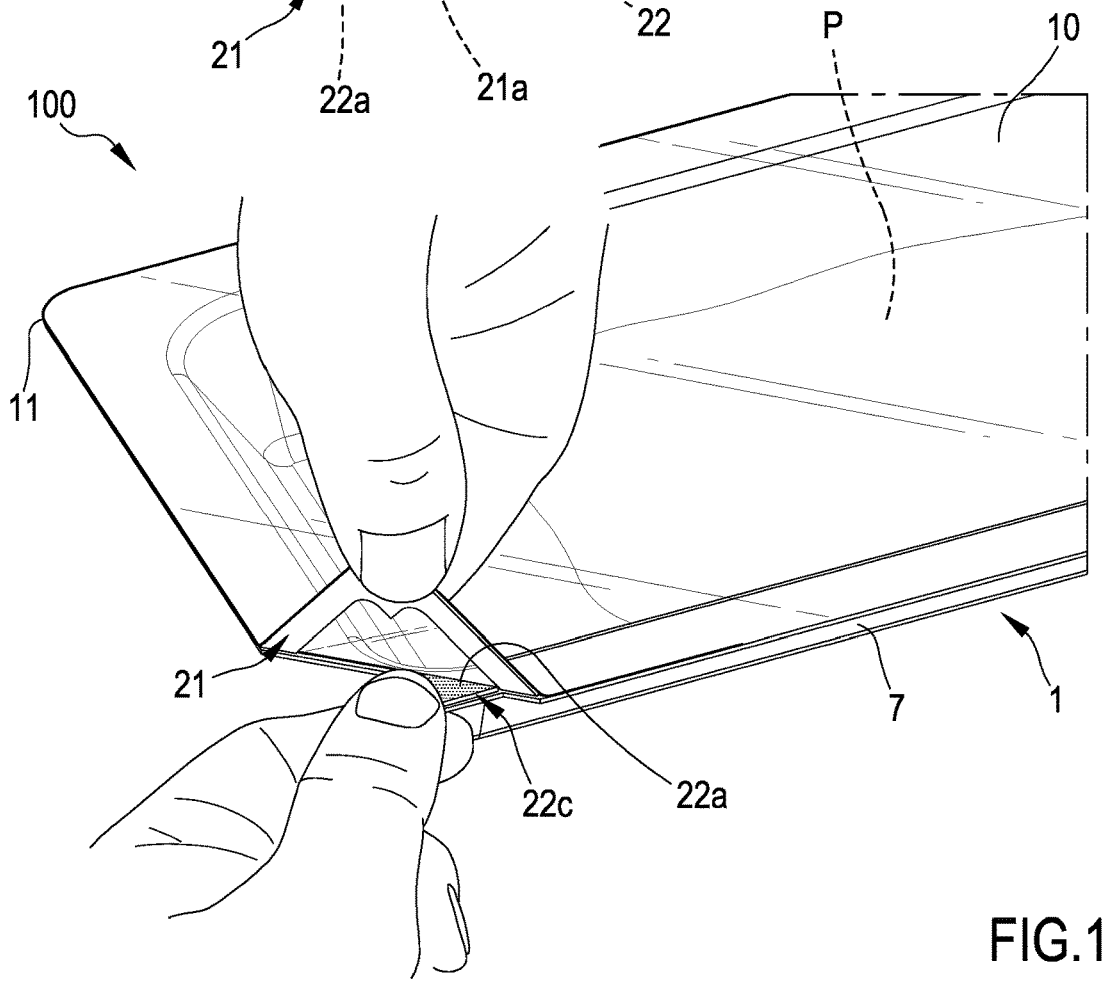
FIG.16

FIG.19
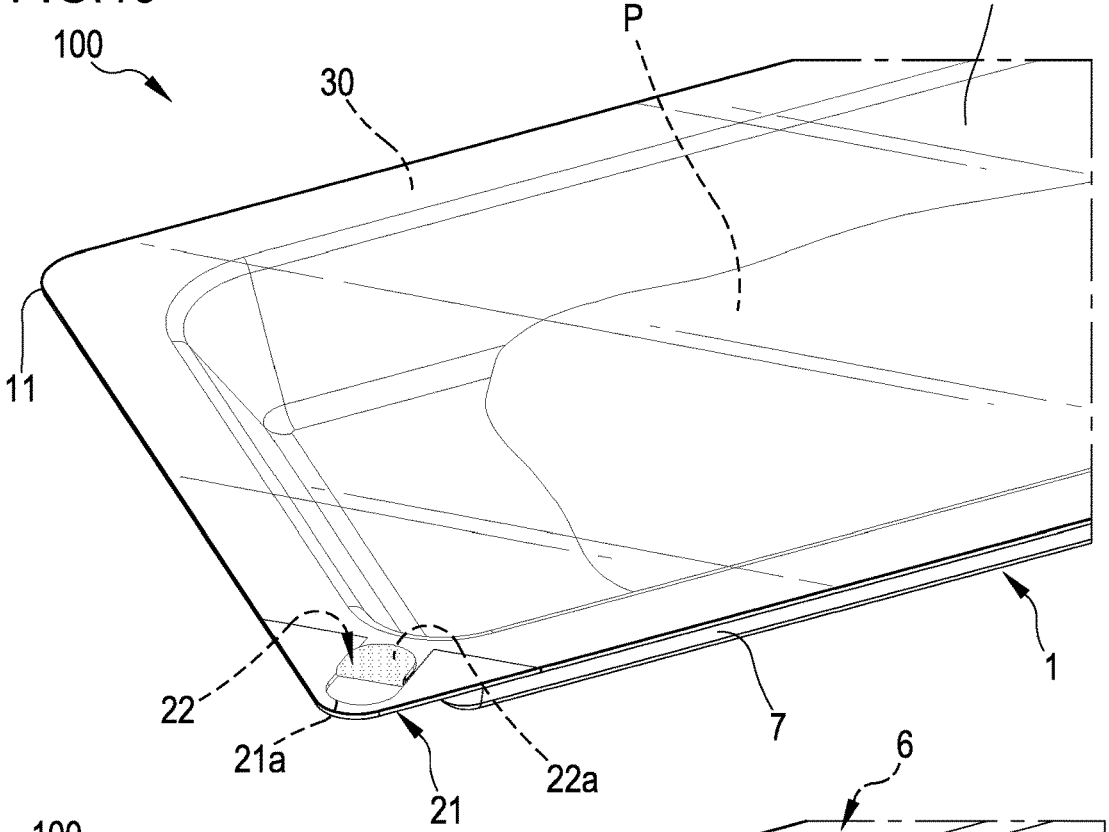
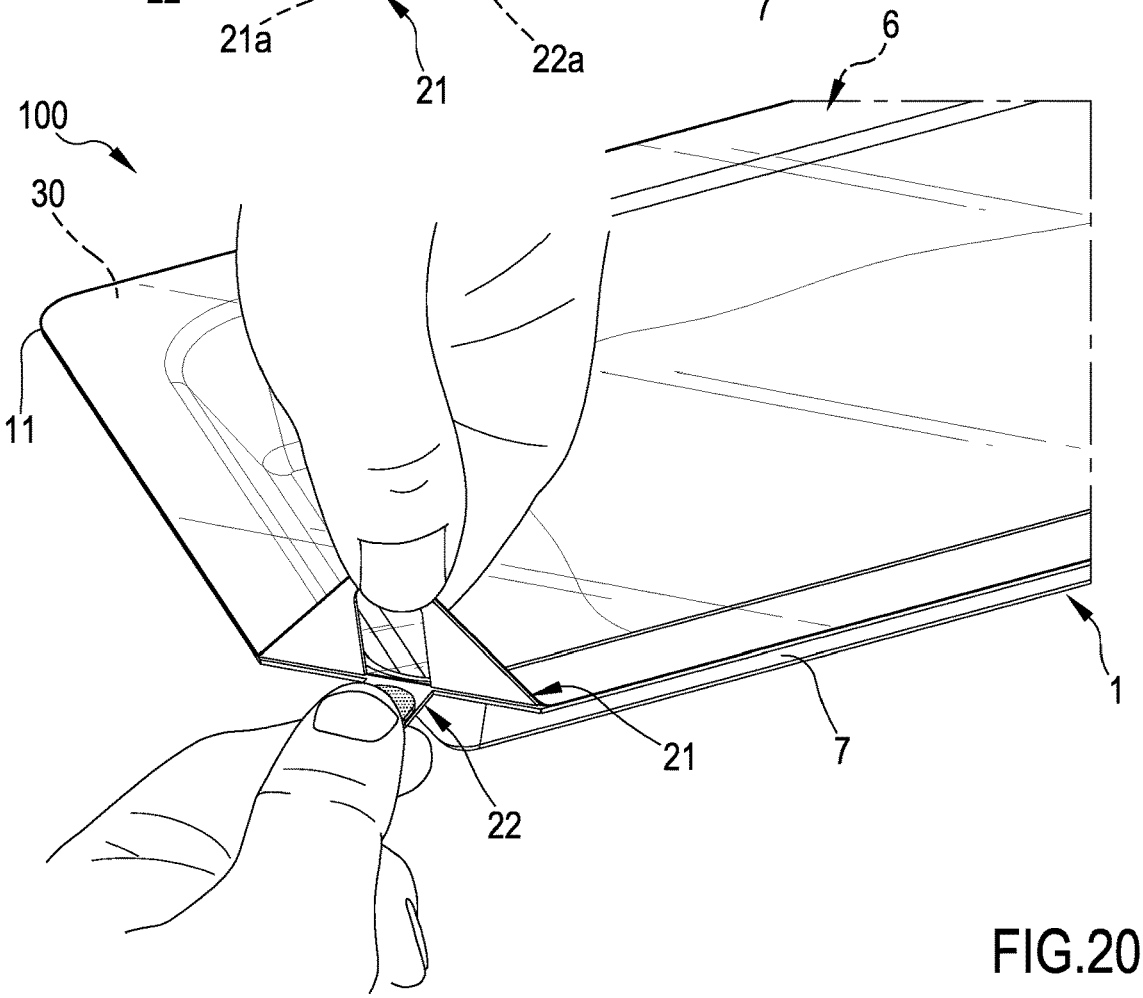
FIG.20

FIG.29
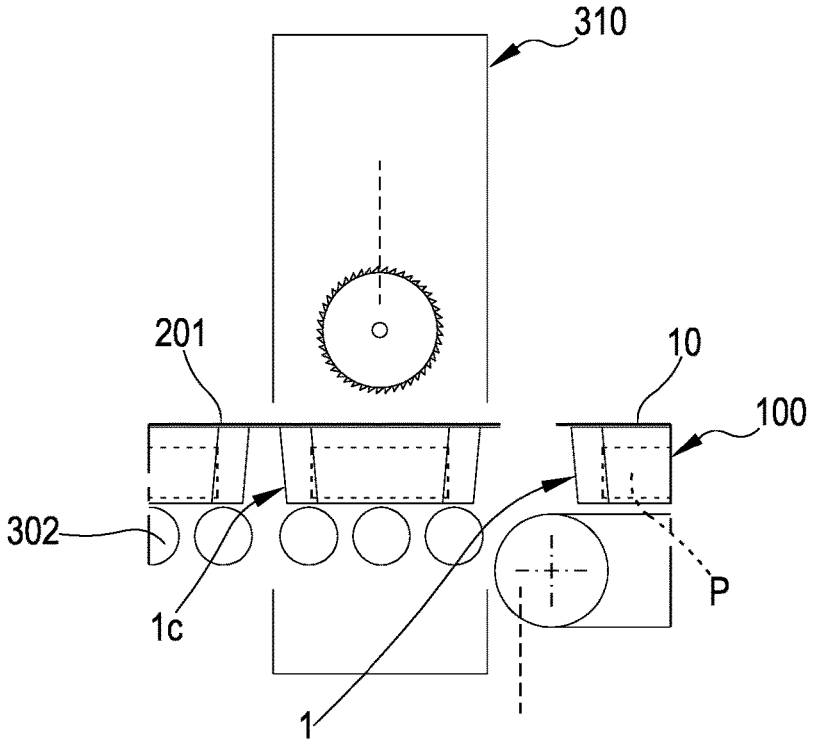
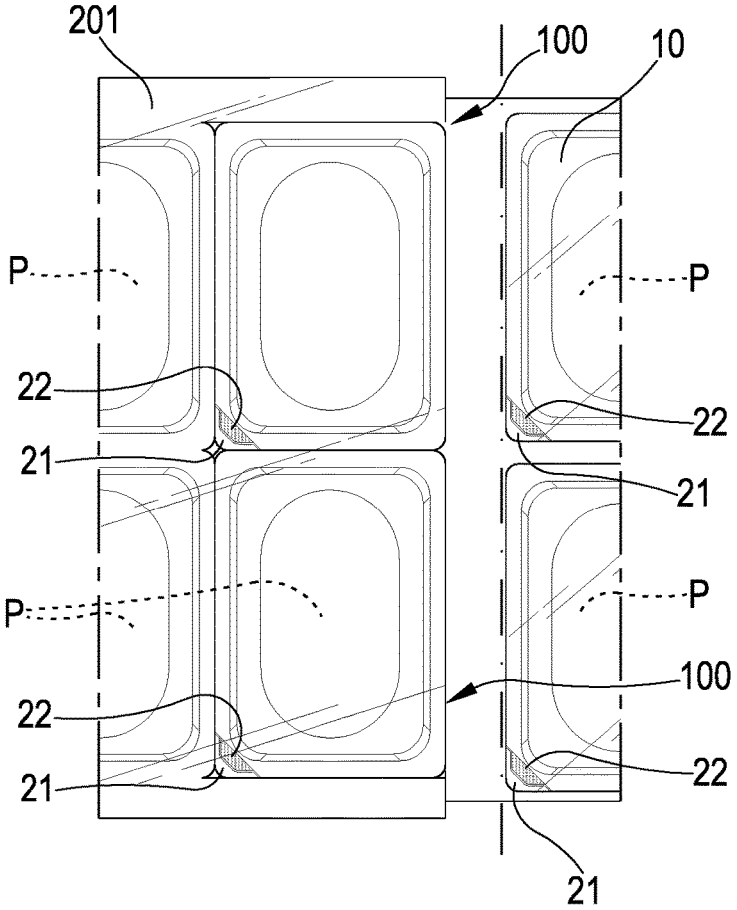
FIG.29A

PACKAGE, PROCESS AND APPARATUS FOR MAKING SAID PACKAGE

FIELD OF THE INVENTION

The present invention relates to a package, in particular for containing products, for example of a food type. The invention also relates to a process and a relative apparatus for manufacturing said package using a support or tray designed to house at least one product, and at least one plastic film, designed to mate with the support or tray in order to seal the product in a package. The finding can have application in vacuum packaging or in controlled atmosphere packaging of products of various type.

PRIOR ART

In the food packaging field, in particular, packages are known, closed by means of plastic films provided with a facilitated opening system which facilitates the opening of the package by the user, thus ensuring a simple and rapid extraction of the product from the package. A first example of facilitated opening described in patent application no. WO 2008/029332 A1, provides a first and a second plastic film coupled together at an outer perimetral edge so as to define a housing compartment for one or more products interposed between the first and the second film. The package has a facilitated opening system consisting of two flaps flanked to each other, not overlapping each other, respectively of the first and second plastic films which emerge from the perimetral closing edge of the package. The flaps are configured for defining respective gripping portions adapted to allow the opening of the package.

Although the opening system of the aforementioned international application represents a facilitated access point for the package, the Applicant has noted that the package is not however without drawbacks. In particular, it is noted that due to the flexible structure of the package and in particular the structure of the facilitated opening system, the same package is difficult to grip and above all complex to handle during the opening steps thereof.

A second example of a facilitated opening package, described in the French patent application no. FR 3 002 209 A1, provides a tray having a substantially rectangular shape and a plastic film welded at a perimetral edge of the tray. The tray comprises a gripping portion emerging from one side of the perimetral edge; in turn, the film comprises a closing portion welded to said perimetral edge and a respective gripping portion emerging from the latter.

A first part of the gripping portion of the film is superimposed to the gripping portion of the support and is configured for being raised relative to the latter while a second part of the gripping portion of the film is flanked by the gripping portion of the support and emerges from the perimetral edge of the latter. The second part of the film is attached to a stiffening tab of the tray: the second part of the film together with the stiffening tab represent the part of film which can be grasped by the user for opening the package, while the gripping portion of the tray, on the other hand, is the part which can be grasped by the user for holding the support during the step of removing the film from the package.

While the solution described in the French application allows defining a package with a facilitated opening, the Applicant has noted that the structure of the opening system of the French application requires the use of an excessive amount of material to define, on the one hand, the gripping portion of the tray and, on the other hand, the second part of the film constrained to the stiffening tab. The structure of the opening system negatively affects both in terms of production costs and overall dimensions of the package, which is therefore excessively cumbersome.

OBJECT OF THE INVENTION

The object of the present invention is to solve the drawbacks and/or limitations of the above prior art.

A first object of the invention is to provide a package having an effective facilitated opening system to allow the user a simple and quick opening of the package; in particular, it is an object of the present invention to provide a package that provides the user with a rapid tactile and visual perception of the facilitated opening system. A further object of the present invention is to provide a package having a simple and cost-effective structure which at the same time can ensure a convenient and stable handling of the package at least during the opening of the latter. A further object is to provide a package that can be manufactured by means of a simple and fast in-line production, which does not require expensive modifications to the manufacturing plants of standard packages, i.e. without a facilitated opening system.

These and yet other objects, which will become more apparent from the following description, are substantially achieved by a package, an apparatus and a related process for manufacturing said package according to what is expressed in one or more of the accompanying claims and/or the following aspects, taken alone or in any combination with each other or in combination with any one of the appended claims and/or in combination with any of the other aspects or features described below.

SUMMARY

In a 1st aspect, a package (100) is provided for containing at least one product (P) comprising:

- at least one support (1) exhibiting:
  - at least one base (2) configured for receiving one or more products (P),
  - at least one perimetral edge (6) surrounding the base (2),
  - at least one removable portion (21) extending as a prolongation of the perimetral edge (6) away from the base (2),
- a closing film (10) engaged with the perimetral edge (6) and with the removable portion (21), said closing film (10) being configured for defining—cooperatively with the support (1)—a housing compartment (5) for the product (P),
- a gripping portion (22) emerging from the perimetral edge (6), the removable portion (21) and at least part of the closing film (10) being configured for being separated from the support (1) during an opening step of the package (100), the package (100) being configured for defining a closed condition in which:

- the closing film (10) and the support (1) interdict the access to the housing compartment (5), and
- the removable portion (21) is aligned with at least one portion (**6*a*) of the perimetral edge (6) from which the removable portion (21**) itself extends as a prolongation;

and wherein:

- the removable portion (21) exhibits a cavity (**21*a*) the concavity whereof, at least in the closed condition of the package, faces the perimetral edge (6), the gripping portion (22) is disposed, at least in the closed condition of the package, inside the cavity (21***a*) of the removable portion (21).

In a 2nd aspect according to the 1st aspect, the gripping portion (22), at least in the closed condition of the package, is interposed between the removable portion (21) and the perimetral edge (6).

In a 3rd aspect according to any one of the preceding aspects, the gripping portion (22), at least in the closed condition of the package, is interposed between the removable portion (21) and the portion (6*a*) of the perimetral edge (6) from which said removable portion extends as a prolongation.

In a 4th aspect according to any one of the preceding aspects, the gripping portion (22) is directly constrained only to the perimetral edge (6) of the support, optionally the gripping portion (22) is not directly constrained to the closing film (10).

In a 5th aspect according to any one of the preceding aspects, the gripping portion (22), in the closed condition of the package, has an upper surface which is:

at least partially abuts against the closing film (10), is disengaged from said closing film (10).

In a 6th aspect according to any one of the preceding aspects, the closing film (10) is of a plastic material, the closing film being heat-sealed only to the perimetral edge (6) of the support (1) and to the removable portion (21), the closing film (10) being not heat-sealed to said gripping portion (22).

In a 7th aspect according to any one of the preceding aspects, the gripping portion (22) comprises:

a support portion (22*a*), a coating layer (22*b*) adapted to cover at least partially the support portion (22*a*), said coating layer (22*b*), at least in the closed condition of the package, being interposed between the support portion (22*a*) of the gripping portion (22) itself and the closing film (10), wherein the coating layer (22*b*) is configured for preventing the bond, optionally the sealing, of the gripping portion itself to the closing film (10).

In an 8th aspect according to the preceding aspect, the coating layer (22*b*) is made of a not heat-sealable material.

In a 9th aspect according to any one of the preceding aspects, the removable portion (21), in the closed condition, is coplanar with at least said portion (6*a*) of the perimetral edge (6) from which the removable portion (21) itself extends as a prolongation.

In a 10th aspect according to any one of the preceding aspects, the gripping portion (22) is integrally joined to the perimetral edge (6) of the support (1).

In an 11th aspect according to any one of the preceding aspects, the gripping portion (22) extends as a prolongation of the perimetral edge (6) away from the base (2).

In a 12th aspect according to any one of the preceding aspects, the gripping portion (22) extends as a prolongation of the same portion (6*a*) of the perimetral edge (6) from which, in the closed condition of the package, the removable portion (21) extends as a prolongation.

In a 13th aspect according to any one of the preceding aspects, the gripping portion (22) is coplanar to at least said portion (6*a*) of the perimetral edge (6).

In a 14th aspect according to any one of the preceding aspects, the gripping portion (22) is coplanar to the removable portion (21) at least in the closed condition of the package (100).

In a 15th aspect according to any one of the preceding aspects, the gripping portion (22) is directly engaged with the perimetral edge (6).

In a 16th aspect according to any one of the preceding aspects, the gripping portion (22) is directly engaged with the at least said portion (6*a*) of the perimetral edge (6).

In a 17th aspect according to any one of the preceding aspects, the perimetral edge (6) comprises an external flange (30) which lies on a plane, wherein the closing film (10) being engaged with the flange (30).

In an 18th aspect according to the preceding aspect, the gripping portion (22) extending at least partly along a respective plane parallel to the lying plane of the flange (30).

In a 19th aspect according to the 17th or 18th aspect, the gripping portion (22) is at least partly coplanar with the flange (30) of the perimetral edge (6).

In a 20th aspect according to any one of the aspects from the 17th to the 19th, the removable portion (21), in the closed condition of the package, extends along a main direction coplanar to the lying plane of the flange (30).

In a 21st aspect according to any one of the preceding aspects, the gripping portion (22) comprises a tab emerging from the perimetral edge (6).

In a 22nd aspect according to the preceding aspect, the removable portion (21) comprises a flat tab which, at least in the closed condition of the package, is coplanar with the flat tab of the gripping portion (22).

In a 23rd aspect according to any one of the aspects from the 7th to the 22nd, the support portion (22*a*) of the gripping portion (22) is integrally joined to the perimetral edge (6).

In a 24th aspect according to any one of the aspects from the 17th to the 23rd, the support portion (22*a*) of the gripping portion (22) is integrally joined to the flange (30) of the perimetral edge (6).

In a 25th aspect according to any one of the aspects from the 7th to the 24th, the coating layer (22*b*) is directly constrained only to the support portion (22*a*) of the gripping portion (22) itself.

In a 26th aspect according to any one of the aspects from the 7th to the 25th, the coating layer (22*b*) is integrally joined to the support portion (22*a*) of the same gripping portion (22).

In a 27th aspect according to any one of the preceding aspects, the package (100) is configured for defining a pre-opening condition in which:

the closing film (10) and support (1) interdict the access to the housing compartment (5), optionally the closing film (10) is stably engaged with the perimetral edge (6) for defining said fluid-tight housing compartment (5) for the product (P), the removable portion (21) is at least partially raised, optionally angularly offset, from the gripping portion (22), wherein in the pre-opening condition of the package, the closing film (10) is distanced from the gripping portion (22) so that such gripping portion is grippable by an user.

In a 28th aspect according to any one of the preceding aspects, the removable portion (21), in the closed condition of the package, is:

joined to the perimetral edge (6) only by means of the closing film (10); or integrally joined to the perimetral edge (6) of the support (1) by at least one weakening portion (25) of the support (1), said weakening portion (25) being configured for ensuring the separation of the removable portion (21) itself from the perimetral edge (6) of the support (1) during a step of opening the package (100) following the closed condition.

In a 29th aspect according to any one of the preceding aspects, the removable portion (21) has a mechanical stiffness greater than a mechanical stiffness of the closing film (10).

In a 30th aspect according to any one of the preceding aspects, the removable portion (21) has a mechanical stiffness substantially equal to a mechanical stiffness of the perimetral edge (6) of the support (1).

In a 31st aspect according to any one of the preceding aspects, the removable portion (21) has a thickness greater than a thickness of the closing film (10), optionally the removable portion (21) has a thickness of at least 1.5 times, in particular 3 times, greater than a thickness of the closing film (10).

In a 32nd aspect according to any one of the preceding aspects, the base (2) of the support (1) comprises a bottom wall (8) and a lateral wall (7), said lateral wall (7) emerging, in height, from the bottom wall (8) transversally to this latter, and defining, cooperatively with said bottom wall (8), a containment seat intended to receive the product (P), wherein the flange (30) of the perimetral edge (6) emerges from the lateral wall (7) according to a direction exiting from the containment seat, said flange (30) being distanced from the bottom wall (8), wherein the gripping portion (22) is borne by, optionally integrally joined to, the flange (30) and emerges from this latter away from the lateral wall (7).

In a 33rd aspect according to any one of the preceding aspects, the support (1) comprises at least one angular portion (11), the removable portion (21) being disposed at the at least one the angular portion (11), optionally the removable portion (21) defines at least part of said angular portion (11).

In a 34th aspect according to the preceding aspect, the gripping portion (22) is arranged at said at least one angular portion (11).

In a 35th aspect according to the 33rd or 34th aspect, the gripping portion (22) and the removable portion (21) are arranged at a same angular portion (11) of the support (1).

In a 36th aspect according to any one of the preceding aspects, the support (1) comprises a plurality of angular portions (11), wherein the removable portion (21) defines at least part of only one of said angular portions (11), wherein the gripping portion (22) is arranged at said angular portion defined at least in part by said removable portion (21).

In a 37th aspect according to any one of the preceding aspects, the removable portion (21) comprises a tab having a substantially "L" or "C" or "U" or "V" shape defining said cavity (21*a*) the concavity whereof faces the base (2) of the support (1).

In a 38th aspect according to any one of the preceding aspects, the gripping portion (22) is entirely contained within the cavity of said removable portion (21).

In a 39th aspect according to any one of the preceding aspects, the gripping portion (22) is at least partially, optionally entirely, counter-shaped to the cavity (21*a*) of the removable portion (21).

In a 40th aspect according to any one of the preceding aspects, the package comprises at least one product (P), optionally of a food-type, arranged in the housing compartment (5), wherein the closing film (10) is tight-fluidly engaged to the perimetral edge (6) of the support (1), optionally engaged to the flange (30), so that the housing compartment (5) is fluid-tight.

In a 41st aspect according to any one of the preceding aspects, wherein:

inside the housing compartment (5) there is a pressure lower than atmospheric pressure to define a package (100) under vacuum; or inside the housing compartment (5) there is a predetermined gas or gas mixture to define a modified atmosphere package (100).

In a 42nd aspect according to any one of the preceding aspects, the support (1) is entirely made of plastic material, optionally obtained by means of a thermoforming process.

In a 43rd aspect according to any one of the preceding aspects, the gripping portion (22) is entirely made of plastic material.

In a 44th aspect according to any one of the aspects from the 7th to the 42nd, the coating portion (22*b*) of the gripping portion (22) is made of at least one selected from the group of the following materials:

wax, for example synthetic wax, petroleum-derived wax, mineral wax;

plastic, for example high melting point thermoplastic resins, such as for example polyesters (particularly PET), polyamides or PP homopolymer or resins chemically incompatible with the sealing layer of the closing film (for example wherein the sealing material is polyethylene and the coating layer is made of PETg) or thermosetting resins;

smooth or embossed paper;

ink or paint;

metals, for example aluminum.

In a 45th aspect according to any one of the preceding aspects, wherein the gripping portion (22) comprises a folded portion of the support (1) itself.

In a 46th aspect according to any one of the preceding aspects, the support extends in thickness between:

a first surface of a heat-sealable material, optionally configured for receiving said closing film in engagement, and a second surface of a material not heat-sealable with the closing film (10), wherein at least the perimetral edge (6) and the removable portion (21) are defined superficially by said first surface of heat-sealable material, wherein the gripping portion (22) comprises a portion of the support folded above the perimetral edge (6) so that the gripping portion itself (22) is externally defined by the second not heat-sealable surface.

In a 47th aspect according to the preceding aspect, wherein the gripping portion (2) is entirely defined externally by said second surface of a not heat-sealable material.

In a 48th aspect according to the 46th or 47th aspect, the second surface of a not heat-sealable material seamlessly extends starting from a lower side of the support to an upper side opposed to the lower side and adapted to receive the closing film.

In a 49th aspect according to any one of the preceding aspects, at least a part of the second not heat-sealable surface of the folded gripping portion (22) faces towards a same side from the first surface of heat-sealable material defining at least part of the perimetral edge (6).

In a 50th aspect, a process is provided for manufacturing a package (100) for containing at least one product (P) according to any one of the preceding aspects.

In a 51st aspect according to the preceding aspect, the process comprising at least the following steps:

moving a sheet material (200) along a predetermined advancement path (A), performing at least one notch on the sheet material (200) for defining on the same a first and second semifinished portions (221, 222) flanked to each other, respectively configured for defining the removable portion (21) and gripping portion (22) of the support (1), positioning at least one product (P) on said sheet material (200), constraining a closing film (201):

with a portion of the sheet material (200) so that the product (P) is positioned inside a housing compartment (5) defined by the closing film (201) constrained to said sheet material (200), with the first semifinished portion (221) adapted to define said removable portion (21).

In a 52nd aspect according to the preceding aspect, the process further comprises at least one step of making at least one through cut in the sheet material (200) and in the closing film (201), such through cut, cooperatively with the notch made on the sheet material (200), delimits the removable portion (21) to define said package (100).

In a 53rd aspect according to the preceding aspect, the through cut intersects—in at least one point—the at least one notch in the sheet material (200) in order to delimit at least partially said removable portion (21).

In a 54th aspect according to any one of the aspects from the 51st to the 53rd, the step of constraining the closing film (201) comprises a step of heat-sealing said film on the sheet material (200).

In a 55th aspect according to any one of the aspects from the 51st to the 53rd wherein, prior to the constraining step of the film, the process comprises a step of defining a layer on an upper surface of the second semifinished portion (222) of a material not heat-sealable with the closing film (201), said upper surface, following the constraining step of the closing film (201) on the support (1), being facing said closing film.

In a 56th aspect according to the preceding aspect, wherein said step of defining a layer of a material not heat-sealable with the closing film (201) comprises a sub-step of applying, for example by means of a printing action, a coating layer (22*b*) of a not heat-sealable material on the sheet material (200).

In a 57th aspect according to the preceding aspect, said step of applying the coating layer (22*b*) may be carried out:

prior to the notching step of the sheet material (200), after the notching step of the sheet material (200), the coating layer (22*b*) being in this case applied to the second semifinished portion (222).

In a 58th aspect according to the 55th aspect, wherein the sheet material (200) is defined in thickness between a first surface of a heat-sealable material and a second surface of a material not heat-sealable with the closing film (201), said step of defining a layer of a material not heat-sealable with the closing film (201) comprises a sub-step of folding a first part of the semifinished portion (222) above a second part such that a part of the second surface of a not heat-sealable material is, in the bonding step of the closing film (201), facing the latter.

In a 59th aspect according to the 55th or 58th aspect, wherein the step of defining a layer of a material not heat-sealable with the closing film (201) comprises a sub-step of folding a portion of the support such that a surface of a not heat-sealable material is facing towards a same side of the support comprising a surface of heat-sealable material adapted to receive the closing film in engagement.

In a 60th aspect according to any one of the aspects from the 52nd to the 59th, the step of through cut of the sheet (200) and of the closing film (201) is subsequent to the step of constraining said closing film (201) to the sheet material (200).

In a 61st aspect according to any one of the aspects from the 51st to the 60th, the process comprises:

a step—after that of positioning the product (P) on the sheet material (200) and before that of constraining the closing film (201)—of removing at least part of the air from the housing compartment (5) in order to define inside the latter a pressure less than the atmospheric pressure; or a step—after that of positioning the product (P) on the sheet material and before that of constraining the closing film (201)—of removing at least part of the air from the housing compartment (5) and of inserting inside the latter a predetermined type of gas for defining a modified-atmosphere package.

In a 62nd aspect according to any one of the aspects from the 51st to the 61st, the step of making a notch and defining on an upper surface of the second semifinished portion (222) a layer of material not heat-sealable with the closing film (201) are combined in one step.

In a 63rd aspect according to any one of the aspects from the 51st to the 62nd, the process comprises a step of thermoforming the sheet material (200) for defining a precursor body comprising a plurality of semifinished supports (1*c*), each semifinished support (1*c*) comprising:

at least one base (2) configured for receiving one or more products (P), and at least one perimetral edge (6) surrounding the base (2), wherein the step of making a notch in the sheet material (200) provides to make at least one through cut on the perimetral edge (6) of each semifinished support (1*c*) for defining a first and second semifinished portions flanked to each other.

In a 64th aspect according to the preceding aspect, the layer of a material not heat-sealable with the closing film (201) is defined on the perimetral edge (6) of each semifinished support (1*c*).

In a 65th aspect according to the preceding aspect, the step of constraining the closing film (201) to at least one portion of the sheet material (200) comprises a step of fluid-tightly heat-sealing said film to the perimetral edge (6) of each semifinished support (1*c*) of the precursor body, each semifinished support (1*c*), cooperatively with the closing film, defining a housing compartment (5) for at least one product (P).

In a 66th aspect according to any one of the aspects from the 51st to the 65th, the step of positioning the product (P) on the sheet material (200) comprises resting at least one product (P) on the base (2) of the semifinished support (1*c*) of the precursor body.

In a 67th aspect according to any one of the aspects from the 51st to the 65th, the process comprises a step of making a through cut in the precursor body, on which the plurality of semifinished supports (1*c*) are defined, and in the closing film (201) associated to the precursor body for defining, at the end of the step of making the through cut, a plurality of single packages (1) according to any one of the aspects from the 1st to the 49th.

In a 68th aspect, an apparatus (300) is provided for making a package (100) according to any one of the aspects from the 1st to the 49th, the apparatus (300) being configured for performing the process according to any one of the aspects from the 50th to the 67th.

In a 69th aspect according to the preceding aspect, the apparatus (300) comprises:

a first supplying group (301) configured for supplying the sheet material (200), a conveyor (302) configured for moving the sheet material (200) along a predetermined advancement path (A), a second supplying assembly (303) configured for delivering the closing film (201), a packaging station (307) configured for receiving the sheet material (200) on which one or more products (P) are housed and at least one portion of said closing film (201), said packaging station (307) being configured for fluid-tightly engaging the closing film (201) with the sheet material (200), at least one notching station (306) located upstream of the packaging station (307) with respect to the advancement path (A) of the sheet material (200) and which is configured for notching the latter for defining the first and second semifinished portion (221, 222) lying substantially on a same plane, said first and second semifinished portion (221, 222) being configured for defining the removable portion (21) and the gripping portion (22) of the package, respectively.

In a 70th aspect according to the 68th or 69th aspect, the apparatus comprises a printing station (305) placed upstream of the packaging station (307) with respect to the advancement path (A) of the sheet material (200) configured for applying on the sheet material, optionally on the second semifinished portion (222), a coating layer (22*b*) of a material not heat-sealable with the closing film (201), optionally for defining said gripping portion (22) comprising a layer not heat-sealable with the closing film (10).

In a 71st aspect according to the 68th or 69th aspect, the apparatus comprises at least one folding station (330) placed upstream the packaging station (307) with respect to the advancement path (A) of the sheet material (200) and which is configured for folding, with respect to the sheet material, the second semifinished portion (222) for defining the gripping portion (22).

In a 72nd aspect according to the preceding aspect, wherein the folding station is interposed between the notching station (306) and the packaging station (307).

In a 73rd aspect according to the 71st aspect, wherein the folding station (330) and the notching station (306) are integrated to define a single station.

In a 74th aspect according to the 71st or the 73rd aspect, wherein the notching station (306) and the folding station (330) are configured for acting substantially simultaneously on the sheet material (200) for defining said gripping portion (22).

In a 75th aspect according to any one of the aspects from the 71st to the 74th, the folding station (330) comprises at least one pusher (331) configured for moving relative to the sheet material (200) at least between:

a retracted position in which the pusher (331) faces the second semifinished portion (222), and an advanced position in which the pusher (331) is configured for contacting said second semifinished portion (222) to lift it transversely with respect to the first semifinished portion (221), In a 76th aspect according to the preceding aspect, the pusher (331), in the retracted position, is configured for being spaced from the sheet material (200), optionally spaced from the second semifinished portion (222), even more optionally spaced from the second not heat sealable surface of the second semifinished portion (222).

In a 77th aspect according to the 75th or 76th aspect, the folding station (330) further comprises a pressure member (332) configured for disposing itself, optionally at least in the retracted position of the pusher (331), opposed to the pusher (331) with respect to the sheet material (200), wherein said pressure member (332) is configured for contacting the second semifinished portion (222), raised by the pusher (331), to fold it above a portion of a perimetral edge of the sheet material so as to define said gripping portion (22).

In a 78th aspect according to the preceding aspect, wherein the pressure member (332) is configured for contacting the second semifinished portion (222), raised by the pusher, at the second not heat-sealable surface.

In a 79th aspect according to the 77th or 78th aspect, the pressure member (332) is configured for moving, in conditions of use of the apparatus, relative to the sheet material (200) at least between:

a starting position in which the pressure member (332) is configured for disposing itself at a distance from the second semifinished portion (222) raised by the pusher (331), an intermediate position in which the pressure member intercepts said second semifinished portion (222) raised by the pusher (331), a crushing position in which the pressure member (332) completely folds said second semifinished portion (222) above said portion of a perimetral edge of the sheet material (200) so as to define said gripping portion (22).

In an 80th aspect according to any one of the aspects from the 75th to the 79th, the folding station (330) comprises a first actuator (331*a*) active in control on the pusher (331) and configured for moving the latter from the retracted position to the advanced position, and vice versa.

In an 81st aspect according to the 79th or 80th aspect, the folding station (330) comprises a second actuator (332*a*) active in control on the pressure member (332) and configured for moving the latter from the starting position to the crushing position, and vice versa.

In an 82nd aspect according to the preceding aspect, the apparatus comprises a control unit (311) connected to said first and second actuators (331*a*, 332*a*) and configured for:

commanding the first actuator (331*a*) to define the retracted position and the advanced position of the pusher (331), commanding the second actuator (332*a*) to define the starting position and the crushing position of the pressure member (332), synchronizing the actuation of said first and second actuators (331*a*, 332*a*) to allow the pusher (331) to lift the second semifinished portion and, only subsequently, allow the pressure member to crush said second raised semifinished portion to define said gripping portion.

In an 83rd aspect according to the preceding aspect, the control unit (311) is configured for commanding the advanced position of the pusher (331) and at the same time to command the starting position of the pressure member (332), wherein the control unit (311), only after having commanded the advanced position of the pusher (331), is configured for commanding the retracted position of the latter, the control unit (311) is configured for commanding the crushing position of the pressure member (332) when the pusher (331) is in the retracted position.

In an 84th aspect according to any one of the aspects from the 75th to the 83rd, the folding station (330) comprises a counter-thrust tool (333) configured for disposing itself against the pusher (331) with respect to the sheet material (200), said counter-thrust tool (333) being configured for leaning against an edge portion of the sheet material (200) placed adjacent to the second semifinished portion (222) for keeping said sheet material (200) in a predetermined position at least during the passage of the pusher (331) from the retracted position to the advanced position.

In an 85th aspect according to the preceding aspect, the counter-thrust tool (333) is configured for moving relative to the sheet material (200) at least between:

a distanced position in which the counter-thrust tool (333) is distanced from the sheet material (200), and an abutment position in which the counter-thrust tool (333) is resting on the first surface of the edge portion of the sheet material (200), wherein the pusher (331) is configured for moving from the retracted position to the advanced position during the abutment position of the counter-thrust tool (333).

In an 86th aspect according to the preceding aspect, wherein the pressure member (332) is configured for moving from the starting position to the crushing position during the distanced position of the counter-thrust tool (333).

In an 87th aspect according to the preceding aspect, wherein the counter-thrust tool (333) is configured for disposing itself on the same side of the sheet material (200) on which the pressure member (332) is disposed, optionally opposed to the pusher (331).

In an 88th aspect according to any one of the aspects from the 84th to the 87th, the folding station comprises a third actuator (333*a*) active in command on the counter-thrust tool (333) and configured for commanding the distanced and the abutment position.

In an 89th aspect according to the preceding aspect, the control unit (311) of the apparatus is connected to said third actuator (333*a*) and configured for commanding said distanced and abutment position of the counter-thrust tool (333) to said third actuator (333*a*).

In a 90th aspect according to the preceding aspect, the control unit (311) is configured for synchronizing the actuation of said third actuator with the actuation of said first and second actuators (331*a*, 332*a*) to allow the pusher (331) to raise the second semifinished portion and, only subsequently, allow the pressure member to crush said raised second semifinished portion for defining said gripping portion.

In a 91st aspect according to the preceding aspect, wherein the control unit (311), only after having commanded the abutment position of the counter-thrust tool (333), is configured for commanding the advancement position of the pusher (331).

In a 92nd aspect according to the 90th or 91th aspect, wherein the control unit (311), only after having commanded the distanced position of the pusher (331), is configured for commanding the crushing position of the pressure member (332).

In a 93rd aspect according to any one of the aspects from the 71st to the 92nd, the folding station (330) and the notching station (306) are integrated to define a single station.

In a 94th aspect according to the preceding aspect, the notching station (306) comprises a blade (306*a*) configured for moving relative to the sheet material (200) at least between:

a retracted position in which the blade (306*a*) is distanced from the sheet material (200), and a cutting position wherein said blade (306*a*) passes through the sheet material (200) to define said first and second semifinished portions (221, 222).

In a 95th aspect according to the preceding aspect, the blade (306*a*) is engaged with the pusher (331) and configured for moving move, optionally by translation, relative to the latter.

In a 96th aspect according to the preceding aspect, wherein the blade (306*a*) defines a cavity inside which the pusher (331) is engaged by sliding.

In a 97th aspect according to the 93th or 94th aspect, the blade (306*a*) is configured for being placed in opposition to the pusher (331) and to the counter-thrust tool (333) with respect to the sheet material (200), said blade (306*a*) is configured for moving towards and away from the pusher (331).

In a 98th aspect according to the preceding aspect, wherein the blade (306*a*) is adjacent to the pressure member (332).

In a 99th aspect according to any one of the aspects from the 71st to the 98th, the apparatus comprises a plurality of folding stations (330) aligned along a transversal direction, optionally orthogonal, to the advancement path (A) of the sheet material (200).

In a 100th aspect according to any one of the aspects from the 68th to the 99th, the apparatus comprises at least one cutting station (310) placed downstream of the notching station (306), optionally downstream of the folding station, configured for defining a through cut of the sheet material (200) and closing film (201) for forming said packages (100).

In a 101st aspect according to any one of the aspects from the 68th to the 100th, the packaging station (307) is synchronized with at least one of the conveyor (302), the first supplying group (301) or the second supplying group (303).

In a 102nd aspect according to any one of the aspects from the 68th to the 101st, the apparatus comprises a positioning station (304) configured for housing at least one product (P) on the sheet material (200) upstream of the packaging station (307).

In a 103rd aspect according to the preceding aspect, said positioning station (304) configured for housing, upstream of the packaging station (307), at least one product (P) on at least one base (2) of the supports (1) defined on the sheet material (200).

In a 104th aspect according to any one of the aspects from the 68th to the 103rd, the apparatus comprises a forming station (308) configured for making the supports (1), by means of a thermoforming process, on the sheet material, said forming station being arranged upstream of the packaging station (307).

In a 105th aspect according to the preceding aspect, the forming station (308) is configured for performing a thermoforming of the sheet material (200) to define on the latter one or more semifinished supports (1*c*).

In a 106th aspect according to the preceding aspect, wherein the folding station (330) is configured for folding the second semifinished portion (222) of each semifinished support (1*c*).

In a 107th aspect according to the 105th or 106th aspect, wherein the forming station is configured for defining one or more rows of semifinished supports (1*c*) extending along the advancement path (A) of the sheet material, wherein the apparatus comprises a folding station (330), optionally a cutting station (306), for each row of semifinished supports (1*c*).

In a 108th aspect, a support (1) for packages (100) is provided for the containment of products (P), said support (1) being of the type according to any one of the aspects from the 1st to the 49th, optionally obtained through the process according to any one of the aspects from the 50th to the 67th.

In a 109th aspect, a support (1) is provided comprising:

at least one base (2) configured for receiving one or more products (P), at least one perimetral edge (6) surrounding the base (2), at least a removable portion (21) extending as a prolongation of the perimetral edge (6) away from the base (2), the removable portion (21) is aligned with at least a portion (6*a*) of the perimetral edge (6) from which the same removable portion (21) extends as a prolongation, at least part of the removable portion (21) and of the perimetral edge (6) being configured for receiving in engagement a closing film (10) of the support (1), wherein the removable portion (21) is configured for being separated from the support (optionally from the rest of the support or base and movable portion) during a package (100) opening step.

In a 110th aspect according to the preceding aspect, the removable portion (21) has a cavity (21*a*) the concavity whereof (at least when the gripping portion is not separated from the rest of the support) faces the perimetral edge (6).

In a 111th aspect according to the 109th or 110th aspect, the support comprises a gripping portion (22) disposed within the cavity (21*a*) of the removable portion (21).

In a 112th aspect according to the preceding aspect, the gripping portion (22) emerging from the perimetral edge (6).

In a 113th aspect according to the 111th or 112th aspect, the gripping portion (22) is interposed between the removable portion (21) and the perimetral edge (6).

In a 114th aspect according to any one of the preceding aspects from the 111th to the 113th, the gripping portion (22) is interposed between the removable portion (21) and the portion (6*a*) of the perimetral edge (6) from which said removable portion extends as a prolongation.

In a 115th aspect according to any one of the aspects from the 111th to the 114th, the gripping portion (22) is only directly connected to the perimetral edge (6) of the support.

In a 116th aspect according to any one of the aspects from the 111th to the 115th, the gripping portion (22) comprises:

a support portion (22*a*), a coating layer (22*b*) adapted to cover at least partially the support portion (22*a*), said coating layer (22*b*) being configured for preventing the sealing of the gripping portion itself to the closing film (10).

In a 117th aspect according to the preceding aspect, the coating layer (22*b*) is made of a not heat-sealable material.

In a 118th aspect according to any one of the aspects from the 109th to the 117th, the removable portion (21) is coplanar to the perimetral edge (6) from which the removable portion (21) itself extends as a prolongation.

In a 119th aspect according to any one of the aspects from the 111th to the 118th, the gripping portion (22) is integrally joined to the perimetral edge (6) of the support (1).

In a 120th aspect according to any one of the aspects from the 111th to the 119th, the gripping portion (22) extends as a prolongation of the perimetral edge (6) away from the base (2).

In a 121st aspect according to any one of the aspects from the 111th to the 120th, the gripping portion (22) extends as a prolongation of the same portion (6*a*) of the perimetral edge (6) from which the removable portion (21) extends as a prolongation.

In a 122nd aspect according to any one of the aspects from the 111th to the 121st, the gripping portion (22) is coplanar to at least said portion (6*a*) of the perimetral edge (6).

In a 123rd aspect according to any one of the aspects from, the 111th to the 122nd, the gripping portion (22) is coplanar to the removable portion (21).

In a 124th aspect according to any one of the aspects from the 111th to the 123rd, the gripping portion (22) is directly engaged with the perimetral edge (6).

In a 125th aspect according to any one of the aspects from the 111th to the 124th, the gripping portion (22) is directly engaged with at least said portion (6*a*) of the perimetral edge (6).

In a 126th aspect according to any one of the preceding aspects, the perimetral edge (6) comprises an external flange (30) which lies on a plane.

In an 127th aspect according to the preceding aspect, the gripping portion (22) extending at least partly along a respective plane parallel to the lying plane of the flange (30).

In a 128th aspect according to the 126th or 127th aspect, the gripping portion (22) is at least partly coplanar with the flange (30) of the perimetral edge (6).

In a 129th aspect according to any one of the aspects from the 126th to the 128th, the removable portion (21) extends along a main direction coplanar to the lying plane of the flange (30).

In a 130th aspect according to any one of the preceding aspects, the gripping portion (22) comprises a tab emerging from the perimetral edge (6).

In a 131st aspect according to the preceding aspect, the removable portion (21) comprises a flat tab which is coplanar with the flat tab of the gripping portion (22).

In a 132nd aspect according to any one of the aspects from the 116th to the 131st, the support portion (22*a*) of the gripping portion (22) is integrally joined to the perimetral edge (6).

In a 133rd aspect according to any one of the aspects from the 126th to the 132nd, the support portion (22*a*) of the gripping portion (22) is integrally joined to the flange (30) of the perimetral edge (6).

In a 134th aspect according to any one of the aspects from the 111th to the 133rd, the coating layer (22*b*) is directly constrained only to the support portion (22*a*) of the gripping portion (22) itself.

In a 135th aspect according to any one of the aspects from the 116th to the 134th, the coating layer (22*b*) is integrally joined to the support portion (22*a*) of the same gripping portion (22).

In a 136th aspect according to any one of the preceding aspects, the removable portion (21) is integrally joined to the perimetral edge (6) of the support (1) by at least one weakening portion (25) of the support (1), said weakening portion (25) being configured for ensuring the separation of the removable portion (21) itself from the perimetral edge (6) of the support (1) during a step of opening the package (100) following the closed condition.

In a 137th aspect according to any one of the preceding aspects, the removable portion (21) has a mechanical stiffness greater than a mechanical stiffness of the closing film (10).

In a 138th aspect according to any one of the preceding aspects, the removable portion (21) has a mechanical stiffness substantially equal to a mechanical stiffness of the perimetral edge (6) of the support (1).

In a 139th aspect according to any one of the preceding aspects, the base (2) of the support (1) comprises a bottom wall (8) and a lateral wall (7), said lateral wall (7) emerging, in height, from the bottom wall (8) transversally to this latter, and defining, cooperatively with said bottom wall (8), a containment seat intended to receive the product (P).

In a 140th aspect according to the preceding aspect, the flange (30) of the perimetral edge (6) emerges from the lateral wall (7) according to a direction exiting from the containment seat, said flange (30) being distanced from the bottom wall (8).

In a 141st aspect according to the preceding aspect, the gripping portion (22) is borne by, optionally integrally joined to, the flange (30) and emerges from this latter away from the lateral wall (7).

In a 142nd aspect according to any one of the preceding aspects, the support (1) comprises at least one angular portion (11), the removable portion (21) being disposed at the at least one the angular portion (11), optionally the removable portion (21) defines at least part of said angular portion (11).

In a 143rd aspect according to the preceding aspect, the gripping portion (22) is arranged at said at least one angular portion (11).

In a 144th aspect according to the 142nd or 143rd aspect, the gripping portion (22) and the removable portion (21) are arranged at a same angular portion (11) of the support (1).

In a 145th aspect according to any one of the preceding aspects, the support (1) comprises a plurality of angular portions (11), wherein the removable portion (21) defines at least part of only one of said angular portions (11), wherein the gripping portion (22) is arranged at said angular portion defined at least in part by said removable portion (21).

In a 146th aspect according to any one of the preceding aspects, the removable portion (21) comprises a tab having a substantially "L" or "C" or "U" or "V" shape defining said cavity (21*a*) the concavity whereof faces the base (2) of the support (1).

In a 147th aspect according to any one of the preceding aspects, the gripping portion (22) is entirely contained within the cavity of said removable portion (21).

In a 148th aspect according to any one of the preceding aspects, the gripping portion (22) is at least partially, optionally entirely, counter-shaped to the cavity (21*a*) of the removable portion (21).

In a 149th aspect according to any one of the preceding aspects, the support (1) is entirely made of plastic material, optionally obtained by means of a thermoforming process.

In a 150th aspect according to any one of the preceding aspects, the gripping portion (22) is entirely made of plastic material.

In a 151st aspect according to any one of the aspects from the 116th to the 150th, the coating portion (22*b*) of the gripping portion (22) is made of at least one selected from the group of the following materials:

- wax, for example synthetic wax, petroleum-derived wax, mineral wax;
- plastic, for example high melting point thermoplastic resins, such as for example polyesters (particularly PET), polyamides or PP homopolymer or resins chemically incompatible with the sealing layer of the closing film (for example wherein the sealing material is polyethylene and the coating layer is made of PETg) or thermosetting resins;
- smooth or embossed paper;
- ink or paint;
- metals, for example aluminum.

In a 152nd aspect according to any one of the preceding aspects, wherein the gripping portion (22) comprises a folded portion of the support (1) itself.

In a 153rd aspect according to any one of the preceding aspects, the gripping portion extends in thickness between a first surface of a heat-sealable material, and a second surface of a material not heat-sealable with the closing film (10), wherein at least the perimetral edge (6) and removable portion (21) are superficially defined by said first upper surface of heat-sealable material, wherein the gripping portion (22) comprises a portion of the support folded above the perimetral edge (6) so that the gripping portion itself (22) is externally defined by the second not heat-sealable surface.

In a 154th aspect according to the preceding aspect, wherein the gripping portion (2) is entirely defined externally by said second surface of a not heat-sealable material.

In a 155th aspect according to the 153rd or 154th aspect, the second surface of a not heat-sealable material extends without interruption starting from a lower side of the support to an upper side opposed to the lower side and adapted to receive the closing film.

In a 156th aspect according to any one of the preceding aspects, at least a part of the second not heat-sealable surface of the folded gripping portion (22) faces towards a same side from the first surface of heat-sealable material defining at least part of the perimetral edge (6).

In a 157th aspect, a support is provided, usable in a package according to any one of the aspects from the 1st to the 49th.

In a 158th aspect, a package is provided comprising the features of the support described in any one of the aspects from the 1st to the 49th of package.

In a 159th aspect, a use of a support for making packages, for example for containing food products, is provided.

In a 160th aspect, a process for manufacturing a support according to any one of the preceding aspects is provided.

In a 161st aspect according to the preceding aspect, the process comprising at least the following steps:

- moving a sheet material (200) along a predetermined advancement path (A),
- performing at least one notch on the sheet material (200) for defining on the same a first and second semifinished portions (221, 222) flanked to each other, respectively configured for defining the removable portion (21) and gripping portion (22) of the support (1).

In a 162nd aspect according to the preceding aspect, the process comprises a step of defining on a second surface of the second semifinished portion (222) a layer of a material not heat-sealable with a closing film (201) of the support.

In a 163rd aspect according to the preceding aspect, wherein said step of defining a layer of a material not heat-sealable with the closing film (201) comprises a sub-step of applying, for example by means of a printing action, a coating layer (22*b*) of a not heat-sealable material on the sheet material (200).

In a 164th aspect according to the preceding aspect, said step of applying the coating layer (22*b*) may be carried out:

- prior to the notching step of the sheet material (200),
- after the notching step of the sheet material (200), the coating layer (22*b*) being in this case applied to the second semifinished portion (222).

In a 165th aspect according to the 162nd aspect, wherein the sheet material (200) is defined in thickness between an upper surface of a heat-sealable material and a lower surface of a material not heat-sealable with the closing film (201), said step of defining a layer of a material not heat-sealable with the closing film (201) comprises a sub-step of folding a first part of the semifinished portion (222) above a second part such that a part of the lower surface of a not heat-sealable material is, in the bonding step of the closing film (201), facing the latter.

In a 166th aspect according to the 162nd or 165th aspect, wherein the step of defining a layer of a material not heat-sealable with the closing film (201) comprises a sub-step of folding a portion of the support such that a surface of a not heat-sealable material is facing towards a same side of the support comprising a surface of heat-sealable material adapted to receive the closing film in engagement.

In a 167th aspect according to any one of the aspects from the 159th to the 166th, the step of making a notch and defining on an upper surface of the second semifinished portion (222) a layer of material not heat-sealable with the closing film (201) are combined in one step.

In a 168th aspect according to any one of the aspects from the 159th to the 167th, the process comprises a step of thermoforming the sheet material (200) for defining a precursor body comprising a plurality of semifinished supports (1*c*), each semifinished support (1*c*) comprising:

at least one base (2) configured for receiving one or more products (P), and at least one perimetral edge (6) surrounding the base (2), wherein the step of making a notch in the sheet material (200) provides to make at least one through cut on the perimetral edge (6) of each semifinished support (1*c*) for defining a first and second semifinished portions flanked to each other.

In a 169th aspect according to the preceding aspect, the layer of a material not heat-sealable with the closing film (201) is defined on the perimetral edge (6) of each semifinished support (1*c*).

In a 170th aspect according to the preceding aspect, the process comprises a step of making a through cut in the precursor body, on which the plurality of semifinished supports (1*c*) are defined, and in the closing film (201) associated to the precursor body for defining, at the end of the step of making the through cut, a plurality of single packages (1) according to any one of the preceding aspects.

BRIEF DESCRIPTION OF THE DRAWINGS

Some embodiments and some aspects of the invention are described hereinafter with reference to the accompanying drawings, provided only for illustrative and, therefore, non-limiting purposes, in which:

FIGS. 11 and 12 are schematic views of a further embodiment of a package according to the present invention;

FIGS. 15 and 16 are schematic views of a further embodiment of a package according to the present invention;

FIGS. 19 and 20 are schematic views of the package according to the present invention made by means of a support according to FIGS. 17 and 18;

FIGS. 23 to 29A are schematic representations of a process for making a package according to the present invention;

CONVENTIONS

Figure 1:
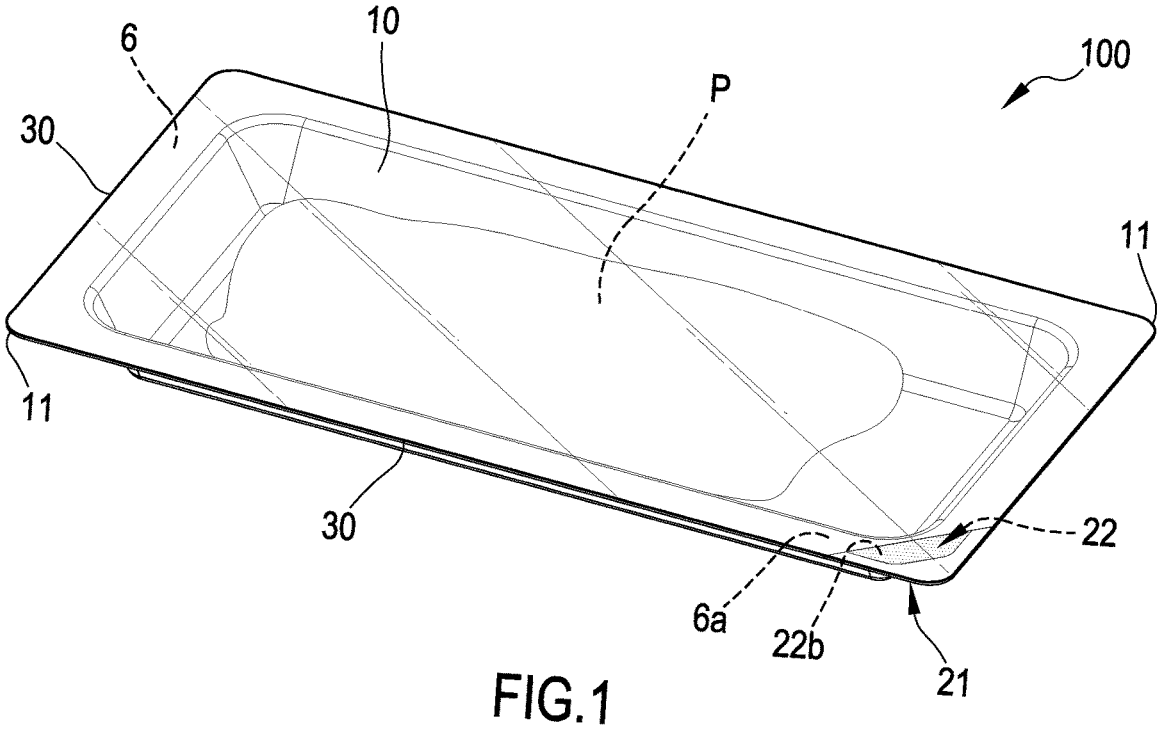
FIG. 1 is a perspective partially top view of an embodiment of a package according to the present invention.

It should be noted that in the present detailed description, corresponding parts illustrated in the various figures are indicated by the same reference numerals. The figures may illustrate the object of the invention by representations that are not in scale; therefore, parts and components illustrated in the figures relating to the object of the invention may relate solely to schematic representations.

The terms upstream and downstream refer to a direction of advancement of a package—or of a support for making said package—along a predetermined path starting from a starting or forming station of a support for said package, through a packaging station and then up to a package unloading station.

Definitions

Product

The term product P means an article or a composite of articles of any kind. For example, the product may be of a foodstuff type and be in solid, liquid or gel form, i.e. in the form of two or more of the aforementioned aggregation states. In the food sector, the product may comprise: meat, fish, cheese, treated meats, prepared and frozen meals of various kinds.

Control Unit

The packaging apparatus described and claimed herein includes at least one control unit designed to control the operations performed by the apparatus. The control unit can clearly be only one or be formed by a plurality of different control units according to the design choices and the operational needs. The term control unit means an electronic component which can comprise at least one of: a digital processor (for example comprising at least one selected from the group of: CPU, GPU, GPGPU), a memory (or memories), an analog circuit, or a combination of one or more digital processing units with one or more analog circuits. The control unit can be "configured" or "programmed" to perform some steps: this can be done in practice by any means that allows configuring or programming the control unit. For example, in the case of a control unit comprising one or more CPUs and one or more memories, one or more programs can be stored in appropriate memory banks connected to the CPU or to the CPUs; the program or programs contain instructions which, when executed by the CPU or the CPUs, program or configure the control unit to perform the operations described in relation to the control unit. Alternatively, if the control unit is or includes analog circuitry, then the control unit circuit may be designed to include circuitry configured, in use, for processing electrical signals so as to perform the steps related to control unit. The control unit may comprise one or more digital units, for example of the microprocessor type, or one or more analog units, or a suitable combination of digital and analog units; the control unit can be configured for coordinating all the actions necessary for executing an instruction and instruction sets.

Actuator

The term actuator means any device capable of causing movement on a body, for example on a command of the control unit (reception by the actuator of a command sent by the control unit). The actuator can be of an electric, pneumatic, mechanical (for example with a spring) type, or of another type.

Support

The term support means both a flat support and a tray comprising at least one base and at least one lateral wall emerging from the outer perimeter of the base and optionally a terminal flange emerging radially outwardly from an upper perimetral edge of the lateral wall. The outer flange can extend along a single prevailing development plane or can be shaped; in the case of a shaped outer flange, the latter may for example exhibit multiple portions extending along different prevailing development planes, particularly parallel but offset from each other. The portions of the shaped external flange can be radially offset.

The support defines a top surface on which the product P can be placed and/or a volume inside which the product can be housed.

The tray may comprise an upper edge portion emerging radially from a free edge of the lateral wall opposite the base: the upper edge portion emerges from the lateral wall in an outgoing direction relative to the tray volume.

The flat support can be of any shape, for example rectangular, rhomboidal, circular or elliptical; similarly, the tray with lateral wall can have a base of any shape, for example rectangular, rhomboidal, circular or elliptical. The support can be formed by means of a specific manufacturing process distinct from the packaging process or can be implemented in line with the packaging process.

The support can be made at least partly of paper material, optionally having at least 50% by weight, preferably at least 70% by weight, of organic material comprising one or more of cellulose, hemicellulose, lignin, lignin derivatives. The subject paper material extends between a first and a second prevailing development surface. The paper sheet material used for making the support may, in one embodiment variant, be covered by at least a part of the first and/or second prevailing development surface by means of a plastic coating, such as a food-grade film. If the coating is arranged so as to cover at least part of the first prevailing development surface, the same coating will define an inner surface of the support. Vice versa, if the coating is arranged on the second prevailing development surface, the same coating will define an outer surface of the support. The coating may also be heat-treated in such a way as to be able to act as an element for engaging and securing portions of the support as better described below. The coating may also be used to define a sort of barrier to water and/or humidity useful for preventing the weakening and loss of structurality of the support with consequent uncontrolled deformation of the paper material constituting the latter component. The coating can be applied to the paper material (as specified above on the inside and/or outside of the support) in the form of a so-called lacquer deposited from a solution or sprayed, the thickness whereof is generally comprised between 0.2 μm and 10 μm. Alternatively, the coating may comprise a plastic film, for example a polyethylene, which can be applied by means of a rolling process, on one or both sides (inner and/or outer side) of the paper material defining the support. In case the coating is applied by rolling, the values of the plastic film (coating) may, for example, range from 10 μm to 400 μm, in particular, from 20 μm to 200 μm, even more in particular, from 30 μm to 80 μm, of coating material (i.e., polyethylene). The plastic coating material may be selected, by way of example, from the following materials: PP, PE (HDPE, LDPE, MDPE, LLDPE), EVA, polyesters (including PET and PETg), PVdC.

The support may be alternatively made at least in part of a mono-layer or multilayer thermoplastic material. The support may be provided with gas barrier properties. As used herein, this term refers to a film or sheet of material that has an oxygen transmission rate of less than 200 $cm^3/(m^2*day*bar)$, less than 150 $cm^3/(m^2*day*bar)$, less than 100 $cm^3/(m^2*day*bar)$ when measured in accordance with ASTM D-3985 at 23° C. and 0% relative humidity. Gas barrier materials suitable for single-layer thermoplastic containers are e.g. polyesters, polyamides, ethylene vinyl alcohol (EVOH), PVdC and the like.

The support may be made of a multilayer material comprising at least one layer of: one or more gas barrier layers, one or more heat-sealable layers (adapted to allow the sealing of the coating film to the support surface), one or more outer layers (for example polyamide or polypropylene or polyester).

The gas barrier polymers that can be used for the gas barrier layer are PVDC, EVOH, polyamides, polyesters and mixtures thereof. Generally, a PVDC barrier layer will contain plasticizers and/or stabilizers as known in the art. The thickness of the gas barrier layer will preferably be set in order to provide the material of which the support is composed with an oxygen transmission rate at 23° C. and 0% relative humidity of, less than 50 $cm^3/(m^2*day*atm)$, preferably less than 10 $cm^3/(m^2*day*atm)$, when measured in accordance with ASTM D-3985.

The heat-sealable layer will be selected from polyolefins, such as ethylene homo- or copolymers, propylene homo- or copolymers, ethylene/vinylacetate copolymers, ionomers and homo- or co-polyesters, e.g. PETG, a glycol-modified polyethylene terephthalate. A frangible layer that is easy to open can be positioned adjacent to the heat-sealable layer of the support to facilitate the opening of the final packaging. Blends of low-cohesion polymers which can be used as a frangible layer are for example those described in WO 99/54398.

Additional layers, such as adhesive layers, for example to make the gas barrier layer better adhere to the adjacent layers, may preferably be present in the multilayer material of the support and are selected based on the specific resins used for the gas barrier layer.

In the case of a multilayer structure, part of it can be formed as a foam. For example, the multilayer material used for forming the support can comprise (from the outermost layer to the layer of contact with the more internal foods) one or more structural layers, typically made of a material such as expanded polystyrene, expanded polyester or expanded polypropylene, or of cardboard, or sheet for example polypropylene, polystyrene, poly(vinyl chloride), polyester; a gas barrier layer and a heat-sealable layer.

The overall thickness of the support may be up to 5 mm. For example, the thickness may be between 0.04 mm and 3.00 mm, optionally between 0.05 mm and 1.50 mm, even more optionally between 0.6 mm and 1.00 mm. In one embodiment, the support comprises an overall thickness of between 0.06 and 0.4 mm.

The support may be made entirely of paper material (optionally coating in plastic film) or it may be entirely made of plastic material. Alternatively, the support may be at least partly made of paper material and at least partly of plastic material; in particular, the support is made internally of plastic material and externally covered at least partly in paper material.

The support can also be used to define so-called ready-meal packages; in this configuration, the supports are made so that they can be inserted in the oven for heating and/or cooking the food product placed in the package. In this embodiment (supports for ready-meal packages), the support can, for example, be made of paper material, in particular cardboard, covered with polyester or can be entirely made of a polyester resin. For example, supports suitable for ready-meal packages are made of PP, CPET, APET or APET/CPET, foamed or non-foamed materials. The support may further comprise a heat-sealable layer of a low melting material on the film. This hot-weldable layer can be co-extruded with a PET based layer (as described in patent applications No. EP-A-1, 529,797 and WO2007/093495) or it can be deposited on the base film by solvent deposition or by extrusion coating (for example described in U.S. Pat. No. 2,762,720 and EP-A-1, 252,008).

In a further embodiment, the support may be made at least partly of metal material, in particular aluminum. The support can also be made at least partly of aluminum and/or at least partly of paper material. In general, the support may be made of at least one of the following materials: plastic, paper, metal.

By the term not heat-sealable material of the support and in particular of a gripping portion 22 as will better be described hereinafter it is meant a material adapted to prevent the constraint (engagement or sealing) of a film, for example plastic, even when brought to a correct temperature adapted to allow the sealing thereof on materials suitable for receiving and sealing with said film. For example, the material of the closing film is plastic; in this configuration, the not heat-sealable material may comprise at least one selected from the group of the following materials:

- wax, for example synthetic wax, petroleum-derived wax, mineral wax;
- plastic, for example high melting point thermoplastic resins, such as for example polyesters (particularly PET), polyamides or PP homopolymer or resins chemically incompatible with the sealing layer of the closing film (for example wherein the sealing material is polyethylene and the coating layer is made of PETg) or thermosetting resins;
- smooth or embossed paper;
- ink,
- paint;
- metals, for example aluminum.

Film

A film made of plastic material, in particular polymeric material, is applied to the supports (flat supports or trays), so as to create a fluid-tight package housing the product. In order to make a vacuum pack, the film applied to the support is typically a flexible multilayer material comprising at least a first outer heat-weldable layer capable of welding to the inner surface of the support, optionally a gas barrier layer and a second, heat-resistant outer layer.

If it is desired to make a modified atmosphere package (MAP) or a package under natural atmosphere (non-modified atmosphere), the film applied with the support (film made of plastic, in particular polymeric material) may typically be single-layer or multilayer. In the case of a multilayer sheet, the film may comprise at least one of: one or more gas barrier layers, one or more heat-sealable layers (layers adapted to allow a plastic film to be welded to the support), one or more heat-resistant layers, one or more outer layers (for example polyamide or polypropylene or polyester).

For use in a skin-pack or VSP packaging process, plastic materials, especially polymers, should be easily formed as the film needs to be stretched and softened by contact with the heating plate before it is laid on the product and the support. The film must rest on the product conforming to its shape and possibly to the internal shape of the support.

The heat-sealable (for example outer) layer may comprise any polymer capable of welding to the inner surface of the support. Suitable polymers for the heat-sealable layer can be ethylene and ethylene copolymers, such as LDPE, ethylene/alpha-olefin copolymers, ethylene/acrylic acid copolymers, ethylene/vinyl acetate copolymers or ethylene/vinyl acetate copolymers, ionomers, co-polyesters, for example PETG. Preferred materials for the heat-sealable layer are LDPE, ethylene/alpha-olefin copolymers, e.g. LLDPE, ionomers, ethylene/vinyl acetate copolymers and mixtures thereof.

Depending on the product to be packaged, the film may comprise a gas barrier layer. The gas barrier layer typically comprises oxygen-impermeable resins such as PVDC, EVOH, polyamides and mixtures of EVOH and polyamides. Typically, the thickness of the gas barrier layer is set to provide the film with an oxygen transmission rate of 23° C. and 0% relative humidity of, less than 100 $cm^3/m^2*m^2*atm$, preferably less than 50 $cm^3/(m^2*day*atm)$, when measured in accordance with ASTM D-3985. Common polymers for the heat-resistant outer layer are, for example, ethylene homo- or copolymers, in particular HDPE, ethylene copolymers and cyclic olefins, such as ethylene/norbornene copolymers, propylene homo- or copolymers, ionomers, polyesters, polyamides.

The film in its multilayer form may further comprise other layers such as adhesive layers, filling layers and the like to provide the thickness necessary for the film and improve its mechanical properties, such as puncture resistance, abuse resistance, formability and the like. The film is obtainable by any suitable co-extrusion process, through a flat or circular extrusion head, optionally by co-extrusion or by hot blow molding.

Again for use in a skin-pack or VSP packaging process, the film is substantially non-oriented. Typically, the film, or only one or more of its layers, is cross-linked to improve, for example, the strength of the film and/or heat resistance when the film is brought into contact with the heating plate during the vacuum skin packaging process. Crosslinking can be achieved by using chemical additives or by subjecting the film layers to an energy-radiation treatment, such as high-energy electron beam treatment, to induce crosslinking between molecules of the irradiated material. Films suitable for this application may have a thickness in the range between 50 μm and 500 μm, optionally between 60 μm and 3000 μm, even more optionally between 65 μm and 100 μm.

For use in packaging processes of products under controlled atmosphere (MAP) or in a natural atmosphere (unmodified atmosphere), the film applied to the substrate (plastic film, in particular polymeric) is typically mono-layer or multilayer, having at least one heat-sealable layer, optionally capable of thermo-retracting under heat action. The applied film may further comprise at least one gas barrier layer and optionally an heat-resistant outer layer. In particular, the film can be obtained by co-extrusion and lamination processes. The film may have a symmetrical or asymmetrical structure and may be single-layer or multilayer. Multilayer films are composed of at least two layers, more frequently at least five layers, often at least seven layers.

The total thickness of the film can range from 30 μm to 500 μm, optionally from 40 μm to 300 μm, even more optionally from 50 μm to 200 μm; in one embodiment the film, has a thickness of between 65 μm and 100 μm. The films may possibly be cross-linked. Crosslinking can be achieved by irradiation with high energy electrons at an appropriate dosage level as known in the art. The films described above can be heat-shrinkable or heat-curable. Heat-shrinkable films normally show a free shrinking value at 120° C. (value measured in accordance with ASTM D2732, in oil) in the range from 2% to 80%, normally from 5% to 60%, in particular from 10% to 40% in both longitudinal and transverse directions. Heat-curable films normally have a shrinkage value of less than 10% at 120° C., normally less than 5% both in the transverse and longitudinal direction (measured in accordance with the ASTM D2732 method, in oil). Films normally comprise at least one heat-sealable layer and an outer layer (the outermost) generally consisting of heat-resistant polymers or polyolefins. The welding layer typically comprises a heat-sealable polyolefin which in turn comprises a single polyolefin or a mixture of two or more polyolefins such as polyethylene or polypropylene or a mixture thereof. The welding layer may also be provided with anti-fogging properties through known techniques, for example by incorporation in its composition of anti-fogging additives or through a coating or a spraying of one or more anti-fogging additives that counteract the fogging on the surface of the welding layer. The welding layer may also comprise one or more plasticizers. The outermost layer may comprise polyesters, polyamides or polyolefins. In some structures, a mixture of polyamide and polyester can be used for the outermost layer. In some cases, the films include a gas barrier layer. Barrier films normally have an oxygen transmission rate, also called OTR (Oxygen Transmission Rate) below 200 $cm^3/(m^2*day*atm)$ and more frequently below 80 $cm^3/(m^2*day*atm)$ evaluated at 23° C. and 0% RH measured in accordance with the ASTM D-3985 method. The barrier layer is normally made of a thermoplastic resin selected from a saponified or hydrolyzed product of ethylene-vinyl acetate copolymer (EVOH), an amorphous polyamide and vinyl-vinylidene chloride and mixtures thereof. Some materials include an EVOH barrier layer, layered between two polyamide layers. In some packaging applications, films do not include any gas barrier layer. These films usually comprise one or more polyolefins as defined herein. Non-gas barrier films normally have an OTR (evaluated at 23° C. and 0% RH in accordance with ASTM D-3985) of 100 $cm^3/(m^2*day*atm)$ up to 10000 $cm^3/(m^2*day*atm)$, more often up to 6000 $cm^3/(m^2*day*atm)$.

Peculiar compositions based on polyester are those used for the films of the so-called ready-meals. For these films, the polyester resins of the film may constitute at least 50%, 60%, 70%, 80% and 90% by weight of the film. These films are normally used in combination with supports, especially trays, made from polyester. In the case of packages for fresh red meat, a double film may be used, comprising an oxygen permeable inner film and an oxygen impermeable outer film. The combination of these two films greatly prevents discoloration of the meat even in the most critical situation in the barrier packaging of fresh meat or when the packaged meat extends outside the cavity defined by the tray, or in which the product emerges from the upper perimetral edge of the lateral wall. These films are described for example in European patent applications EP1848635 and EP0690012.

The film may be single-layer. The typical composition of the single-layer films comprises the polyesters as defined herein and mixtures thereof or the polyolefins as defined herein and mixtures thereof. In all the film layers described herein, the polymeric components may contain suitable amounts of additives normally included in such compositions. Some of these additives are normally included in the outer layers or in one of the outer layers, while others are normally added to the inner layers. These additives include slipping or anti-blocking agents such as talc, waxes, silica and the like, or antioxidant agents, stabilizers, plasticizers, fillers, pigments and dyes, cross-linking inhibitors, cross-linking agents, UV absorbers, odor absorbers, oxygen absorbers, bactericides, antistatic agents, antifog agents or compositions and similar additives known to the man skilled in the art of packaging.

The films may have one or more holes adapted to allow the fluid communication between the inner volume of the package and the external environment, or, in the case of a food product, allow the packaged food to exchange gas with the outside; the perforation of the films can, for example, be performed by means of a laser beam or mechanical means, such as rollers provided with needles. The number of perforations applied and the size of the holes influence the permeability to the gases of the film itself. Micro-perforated films are usually characterized by OTR values (evaluated at 23° C. and 0% RH in accordance with ASTM D-3985) of 2500 $cm^3/(m^2*day*atm)$ up to 1000000 $cm^3/(m^2*day*atm)$. Macro-perforated films are usually characterized by OTR values (evaluated at 23° C. and 0% RH in accordance with ASTM D-3985) higher than 1000000 $cm^3/(m^2*day*atm)$.

Furthermore, the films described herein can be formulated to provide strong welds with the support or tray or peelable from the tray/support. For example, the film may be of a multilayer type and have at least one easy to open frangible or peelable layer which can be positioned adjacent a heat-sealable layer to facilitate the opening of the final packaging: the frangible or peelable layer is adapted to allow easy removal of the same film from the support to which it is associated. A method of measuring the strength of a weld, herein referred to as a "welding force, is described in ASTM F-88-00. Acceptable welding force values to have a peelable weld are between 100 g/25 mm and 850 g/25 mm, 150 g/25 mm to 800 g/25 mm, 200 g/25 mm to 700 g/25 mm.

Material Specifications

The term paper material means paper or cardboard; in particular, the sheet material that can be used to make the support can have a weight of between 30 $g/m^2$ and 600 $g/m^2$, in particular between 40 g/m$^2$ and 500 g/m$^2$, even more particularly between 50 g/m$^2$ and 250 g/m$^2$.

PVDC is any vinylidene chloride copolymer in which a prevalent amount of the copolymer comprises vinylidene chloride and a lower amount of the copolymer comprises one or more unsaturated monomers copolymerizable therewith, typically vinyl chloride and alkyl acrylates or methacrylates (for example methyl acrylate or methacrylate) and mixtures thereof in different proportions.

The term EVOH includes saponified or hydrolyzed ethylene-vinyl acetate copolymers and refers to ethylene/vinyl alcohol copolymers having an ethylene co-monomer content preferably composed of a percentage of from about 28 mole % to about 48 mole %, more preferably from about 32 mole % and about 44 mole % of ethylene and even more preferably, and a saponification degree of at least 85%, preferably at least 90%.

The term polyamides is meant to indicate homo- and co- or ter-polymers. This term specifically includes aliphatic polyamides or co-polyamides, e.g. polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partly aromatic polyamides or copolyamides, such as polyamide 61, polyamide 6I/6T, polyamide MXD6, polyamide MXD6/MXDI, and mixtures thereof.

The term polyesters refers to polymers obtained from the polycondensation reaction of dicarboxylic acids with dihydroxylic alcohols. Suitable dicarboxylic acids are, for example, terephthalic acid, isophthalic acid, 2,6-naphthalene dicarboxylic acid and the like. Suitable dihydroxylic alcohols are for example ethylene glycol, diethylene glycol, 1,4-butanediol, 1,4-cyclohexanodimethanol and the like. Examples of useful polyesters include poly(ethylene terephthalate) and copolyesters obtained by reaction of one or more carboxylic acids with one or more dihydroxylic alcohols.

The term copolymer means a polymer derived from two or more types of monomers and includes terpolymers. Ethylene homo-polymers include high density polyethylene (HDPE) and low density polyethylene (LDPE). Ethylene copolymers include ethylene/alphaolefin copolymers and unsaturated ethylene/ester copolymers. The ethylne/alpha-olefin copolymers generally include copolymers of ethylene and one or more co-monomers selected from alpha-olefins having between 3 and 20 carbon atoms, such as 1-butene, 1-pentene, 1-hexene, 1-octene, 4-methyl-1-pentene and the like. Ethylene/alpha-olefin copolymers generally have a density in the range of from about 0.86 g/cm$^3$ to about 0.94 g/cm$^3$. It is generally understood that the term linear low density polyethylene (LLDPE) includes that group of ethylene/alpha-olefin copolymers which fall in the density range of between about 0.915 g/cm$^3$ and about 0.94 g/cm$^3$ and in particular between about 0.915 g/cm$^3$ and about 0.925 g/cm$^3$. Sometimes, linear polyethylene in the density range between about 0.926 g/cm$^3$ and about 0.94 g/cm$^3$ is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers can be obtained with heterogeneous or homogeneous polymerization processes. Another useful ethylene copolymer is an unsaturated ethylene/ester copolymer, which is the ethylene copolymer and one or more unsaturated ester monomers. Useful unsaturated esters include vinyl esters of aliphatic carboxylic acids, in which esters have between 4 and 12 carbon atoms, such as vinyl acetate, and alkyl esters of acrylic or methacrylic acid, in which esters have between 4 and 12 carbon atoms. Ionomers are copolymers of an ethylene and an unsaturated mono-carboxylic acid having the carboxylic acid neutralized by a metal ion, such as zinc or, preferably, sodium. Useful propylene copolymers include propylene/ethylene copolymers, which are copolymers of propylene and ethylene having a percentage by weight content mostly of propylene and propylene/ethylene/butene ter-polymers, which are copolymers of propylene, ethylene and 1-butene.

DETAILED DESCRIPTION

Package

Reference numeral 100 indicates as a whole a package configured for containing at least one product P, for example of a food type.

As can be seen for example in FIGS. 1-3, 5, 7, 8, 15 and 19, the package 100 comprises at least one support 1 configured for receiving the product P and at least one closing film 10, for example of plastic material, sealably constrained to the support 1: the film 10 is configured for defining—in cooperation with the support 1—a housing compartment 5 (FIG. 5) for the product P and for being subsequently removed by a user during a step of opening the package 100 so as to allow the withdrawal of the product P.

In the accompanying figures, a support 1 having a polygonal shape, in particular rectangular, is illustrated. However, the possibility of providing a support 1 having a square, rhomboidal, triangular, elliptical, circular, semicircular shape or a combination thereof is not excluded. The support 1 is made of sheet material and comprises at least one base 2 representing the part of the support 1 suitable for receiving the product P directly; the support 1 further comprises at least one perimetral edge 6 which completely surrounds the base 2. The perimetral edge 6 represents the support portion 1 adapted to engage the film 10 for closing the package 100 and adapted to define—in cooperation with said film 10—the fluid-tight housing compartment 5 for containing the product P. The fluid-tight package 100 may then have a housing compartment 5 in which there is a lower pressure than the atmospheric pressure to define a vacuum package 100 (so-called "SKIN" type package). Alternatively, the fluid-tight package may have a housing compartment 5 in which a predetermined gas or gas mixture is present to define a modified atmosphere package 100 (so-called "MAP" type package). The package may also be normally sealed without a modified atmosphere or a pressure lower than he atmospheric within the housing compartment 5.

The perimetral edge 6 may comprise an external flange 30 (see for example FIGS. 1, 3, 7 and 8) extending all around the base 2 so as to define a closed outer perimeter within which the latter is contained: the flange 30 essentially defines an end surface of the perimetral edge 6. The flange 30 may extend, in a condition of normal use of the package 100, along a substantially horizontal trajectory or plane. As a condition of normal use, a condition of normal presentation and use of the package 100 in which it is resting on the base 2 of the support 1 is meant. In the case of support 1 of the flat type, the flange 30 and the base 2 lie essentially on the same plane (condition not shown in the accompanying figures). In an embodiment variant, the flange 30 is spaced from the base 2 and in particular is arranged at a height different from the base 2 such that the support 1 can essentially define a tray; the flange 30 may extend along a plane parallel to a lying plane of the base 2: in the case of a tray, the plane of the flange 30 is spaced from the plane of the base 2.

In greater detail, in the tray-shaped configuration of the support 1, the latter may comprise a bottom wall 8 and a lateral wall 7 emerging in height from the bottom wall 8 transversely to the latter (see, for example, FIGS. 3 and 5) and defining, in cooperation with said bottom wall 8, a containment seat for the product P: the flange 30 emerges from the lateral wall 7 according to a direction outgoing from the containment seat The lateral wall 7 is angularly offset with respect to the bottom wall 8; in particular, the lateral wall 7 and the bottom wall 8 define an angle, subtended between said walls, of between 90° and 160°, in greater detail between 90° and 150°, in even greater detail between 90° and 130°.

As can be seen in the accompanying figures, the lateral wall 7 defines an opposite free edge with respect to the bottom wall 8 and delimiting an upper opening of the support 1 (upper opening of the tray). In other words, the free edge represents an upper edge of the support 1 which defines the opening of the same support 1 through which the product P—for example the food product—is passed to be positioned in the housing compartment 1 and to be covered by the closing film 10 at the time of packaging. The free edge of the lateral wall 7 has a shape according to the shape of an outer perimeter of the bottom wall 8. In fact, the accompanying figures show an embodiment of the support 1 in which the outer perimeter of the lateral wall 7 both have a rectangular shape.

As can be seen in the accompanying figures, the closing film 10 is engaged, optionally fluid-tightly, with the perimetral edge 6 and in particular with the flange 30. In particular, the closing film 10 is at least partly engaged with the flange 30 so that the housing compartment 5 is fluid-tight. The closing film 10 extends in thickness between a first and a second surface 10*a*, 10*b* while the support 1 extends in thickness between a first and a second surface 1*a*, 1*b*: the second surface 10*b* of the closing film 10 is engaged with at least part of the first surface 1*a* of the support 1 (see, for example, FIG. 5) defining at least part of the perimetral edge 6, optionally of the flange 30.

As can be seen in the accompanying figures, the support 1 comprises a removable portion 21 which extends as a prolongation of the perimetral edge 6 away from the base 2; the removable portion 21, as will be better explained below, is configured for being separated together with the closing film 10 from the support 1 during an opening step of the package 100.

Figure 2:
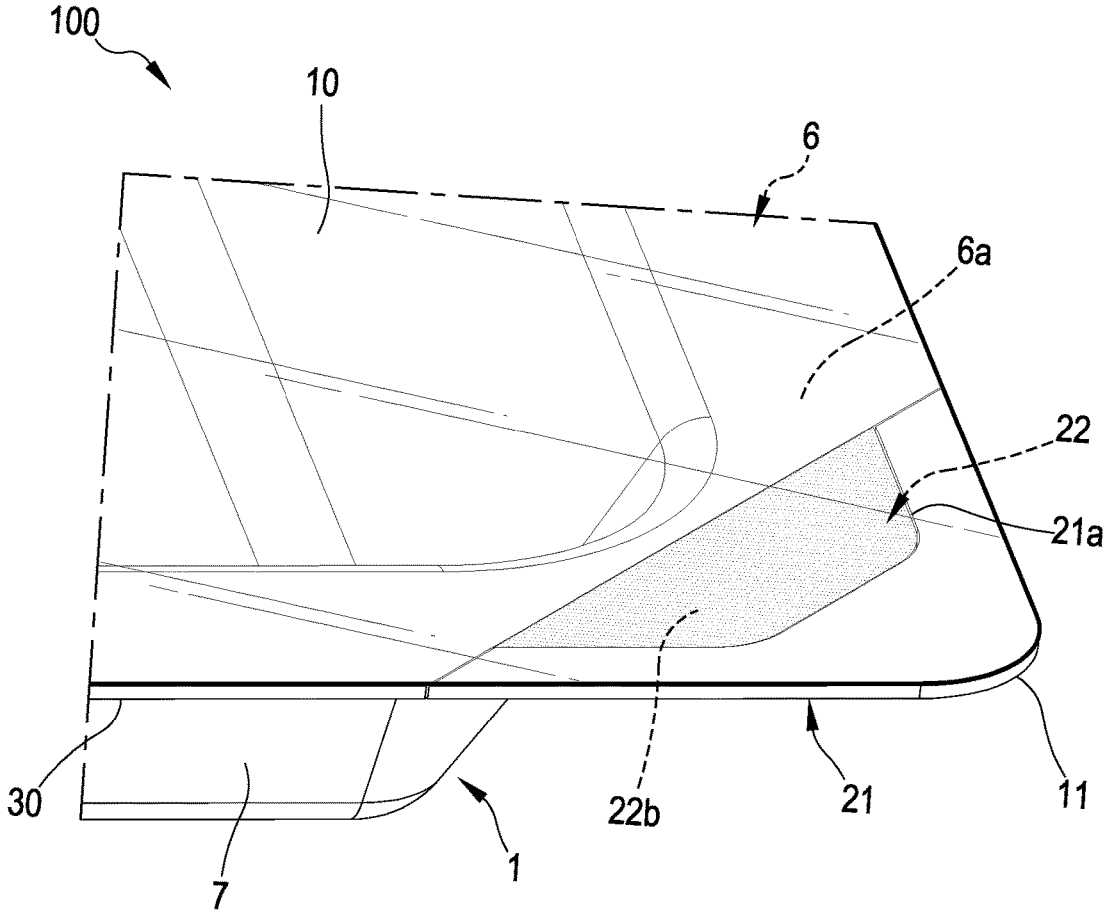
FIG. 2 is a detailed view of the package in FIG. 1.
Figure 3:
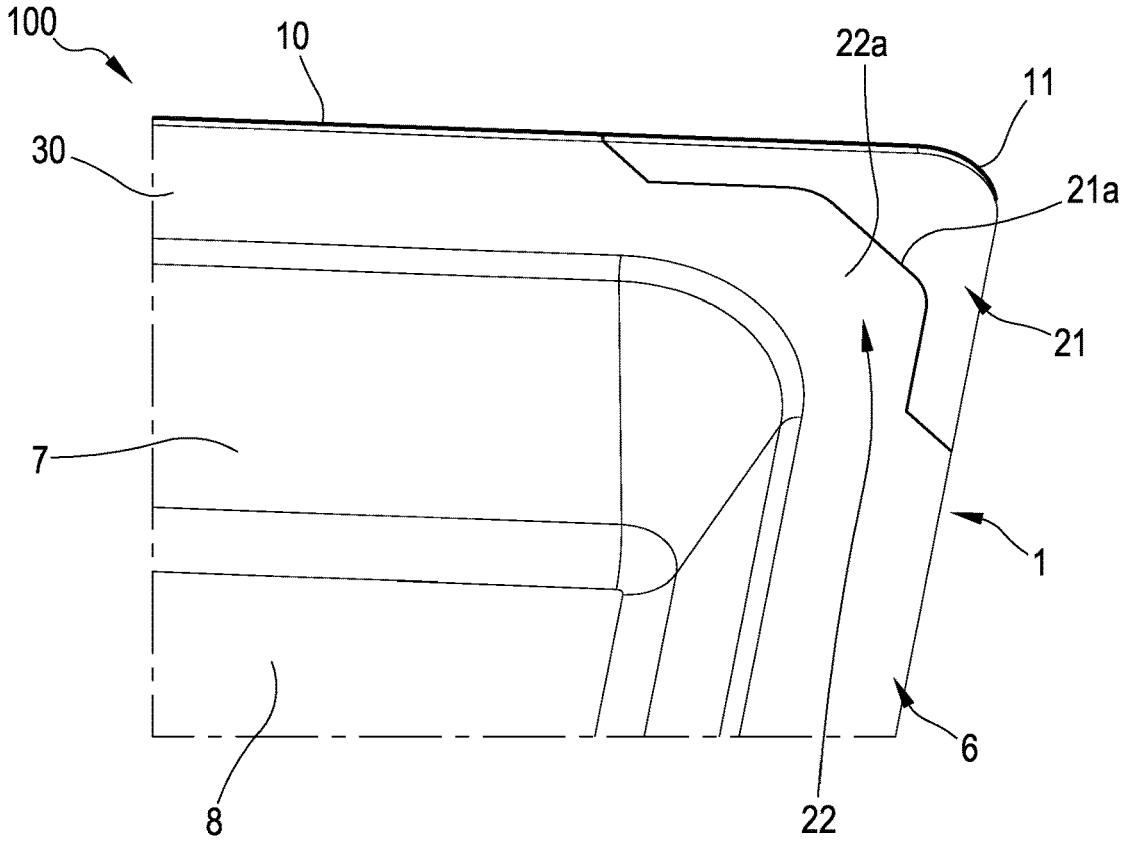
FIG. 3 is a detailed perspective partially bottom view of an embodiment of a package according to the present invention.
Figure 4:
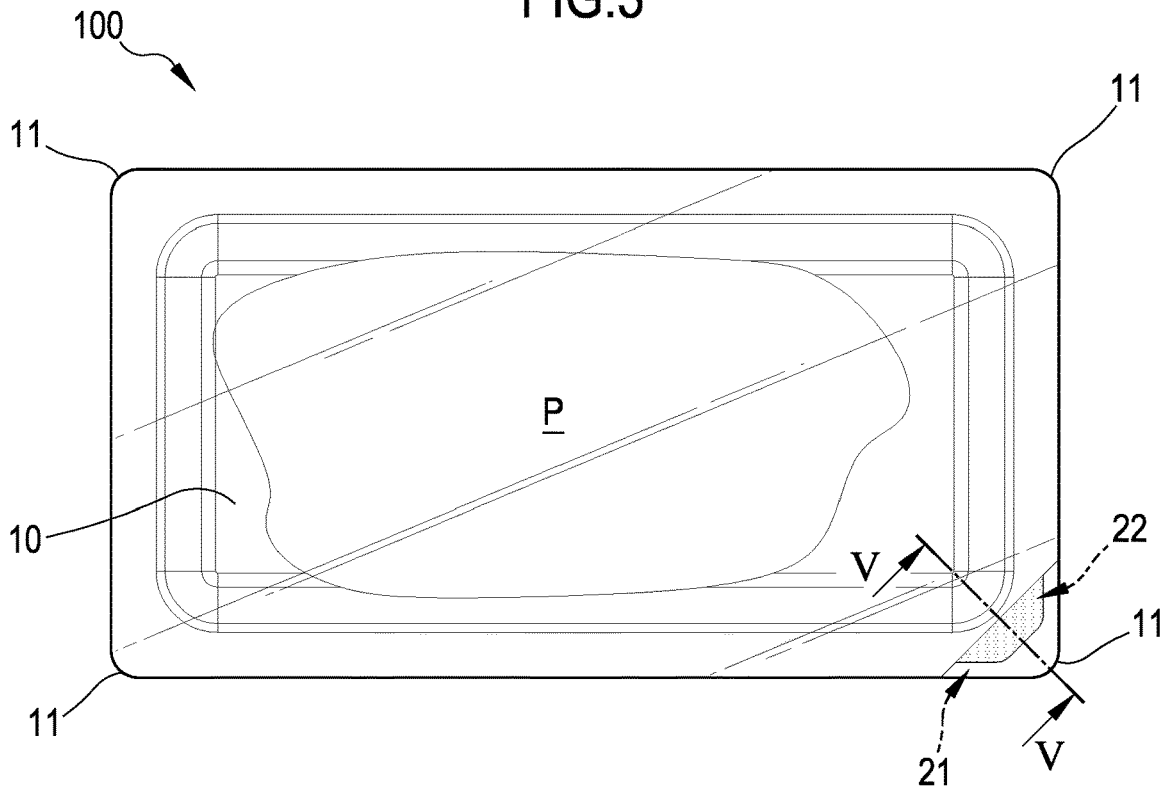
FIG. 4 is a top view of an embodiment of a package according to the present invention.

In fact, as specified above, the package 100 is configured for defining a closing condition in which the closing film 10, in cooperation with the support 1, inhibits access to the housing compartment 5 of the product P (see for example FIG. 1). In the closed condition of the package 100, the removable portion 21 is aligned with at least one portion 6*a* of the perimetral edge 6 from which the same extends as a prolongation (FIGS. 1 and 2). In particular, the removable portion 21, in the closed condition, is aligned with at least one end portion (the portion 6*a*) of the perimetral edge 6 from which it emerges. In the condition illustrated in the accompanying figures in which the edge 6 comprises at least a portion 6*a* lying on a plane, the removable portion 21—in the closed condition—is coplanar with the portion 6*a* of the perimetral edge 6 from which it extends as a prolongation. In the embodiment illustrated in the accompanying figures in which the support 1 comprises the flange 30, the removable portion 21 is coplanar, at least in the closed condition of the package 100, to said flange 30 (FIG. 2).

The removable portion 21 is also engaged with the closing film 10 and is configured for being removed, during an opening step of the package 100, from the support 1 together with at least part of the closing film 10. In detail, the removable portion 21 is stably engaged to a closing film portion 10 such that during an open condition of the package, the removable portion 21 can be raised together with the closing film 10 with respect to the rest of the support 1 in a manner such as to be able to remove said film 10 from the package 100.

Figure 9:
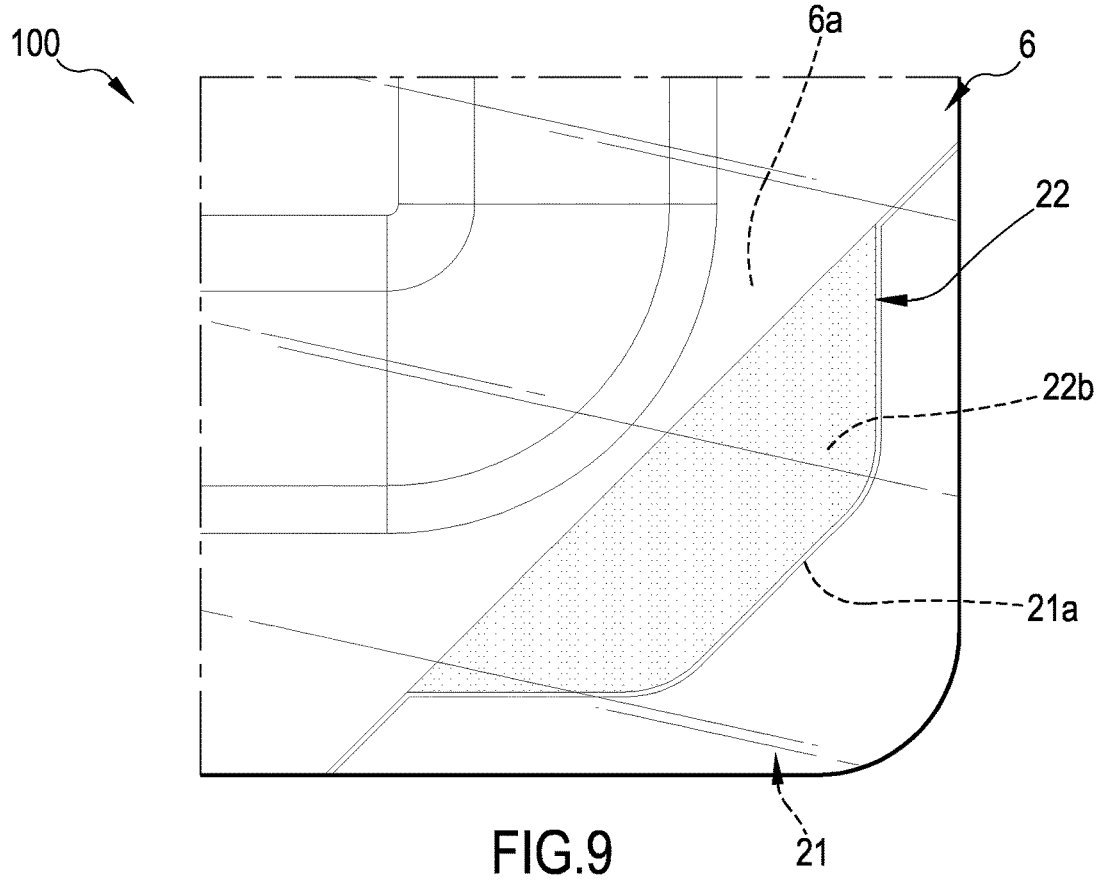
FIGS. 9 and 10 are detailed top views of respective packages according to the present invention.

In one embodiment illustrated in FIG. 9, the removable portion 21, at least in the closed condition of the package 100, exhibits a discontinuity with the portion 6*a* of the perimetral edge 6; in particular, said discontinuity is defined by a through cut which separates the removable portion 21 from the portion 6*a* of the perimetral edge 6. In this case, the removable portion 21 of the package 100 is then joined to the perimetral edge 6 exclusively by means of the closing film 10.

Figure 10:
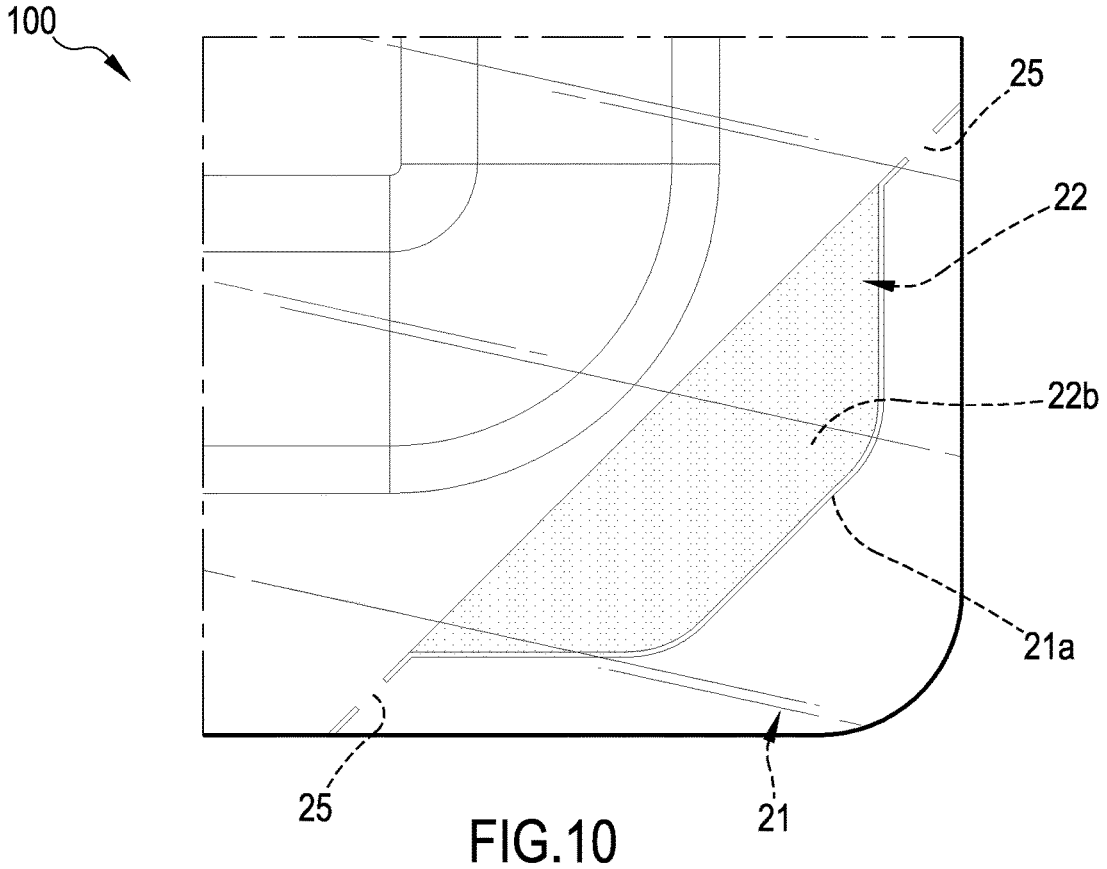

In a further embodiment illustrated for example in FIG. 10, the removable portion 21 is integrally joined to the perimetral edge 6 of the support 1 by at least one weakening portion 25 of the support 1. The weakening portion 25 is configured for ensuring the separation of the removable portion 21 from the perimetral edge 6 during an opening step of the package 100 subsequent to the closing condition. The weakening portion 25 may comprise one or more batons, each of which is configured to connect the removable portion 21 to the portion 6*a* of perimetral edge 6, optionally for connecting the removable portion 21 to the flange 30. In this case, the removable portion 21 is then integrally joined with the portion 6*a* of the perimetral edge 6, and in particular with the flange 30. FIG. 10 illustrates a support 10 having two batons defined at opposed lateral portions of the removable portion 21 which define the weakening portion 25. The possibility of implementing a weakening portion 25 comprising a single baton or a number of batons greater than two is not excluded. Irrespective of the number and structure of the batons, the removable portion 25 is configured for connecting, in the closed condition of the package, the edge 6 and the removable portion 21; the weakening portion is configured for breaking during a condition of first opening of the package 100 and thus allow the detachment of the removable portion 21 from the edge 6 (in particular from the flange 30): following the breakage of the removable portion 21, the latter and the closing film 10 can be removed together from the support 1 during an open condition of the package 100 (the condition shown schematically in FIGS. 7 and 8).

Figure 17:
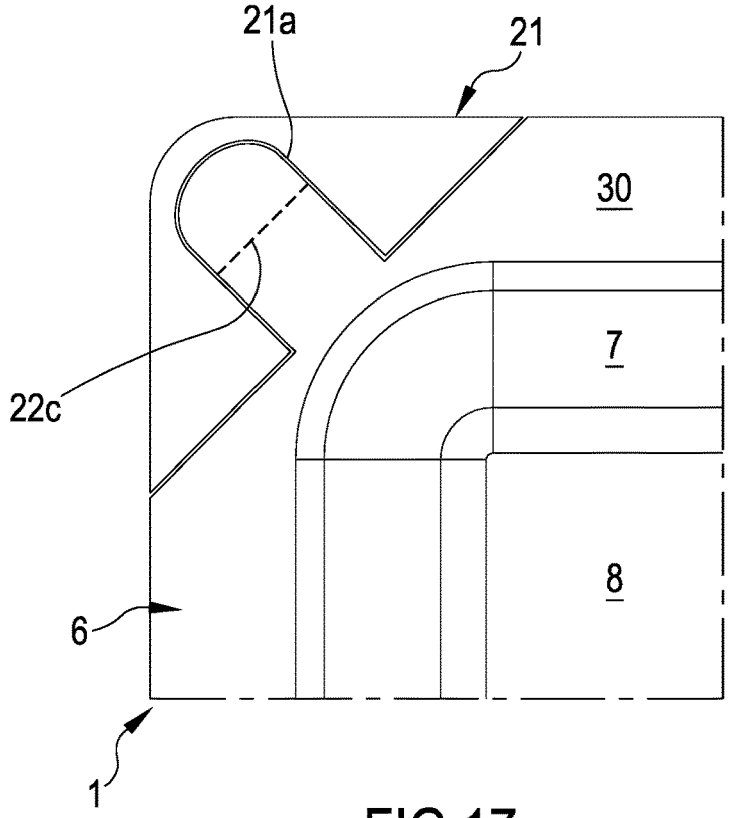
FIGS. 17 and 18 are schematic views of a further support of a package according to the present invention.
Figure 18:
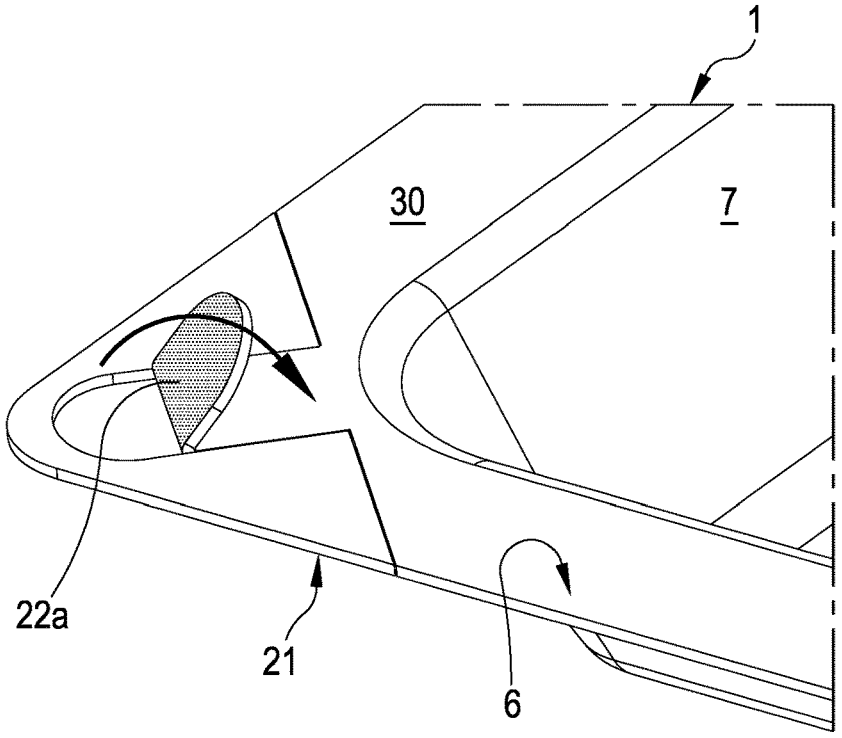

As can be seen in the accompanying figures, the removable portion 21 has a cavity 21*a* the concavity whereof, at least in the closed condition of the package, is facing towards the perimetral edge 6; in particular, the concavity of said cavity 21*a* is facing towards the base of the support and more particularly towards the portion 6*a* of the perimetral edge 6 from which the removable portion 21 itself extends as a prolongation (see, for example, FIG. 2). In greater detail, the removable portion 21 comprises a tab having a substantially "L" or "C" or "U" or "V" or "A" or "W" or "J" shape defining said cavity 21*a* the concavity whereof is facing towards the base 2 of the support 1. For example, FIGS. 1, 2, 4, 7, 8-10 show a package 100 in which the removable portion 21 comprises a tab extending along a plane and having a substantially "V" shape; in this configuration, the entire concavity of the cavity 21*a* is facing towards the base 2 of the support 1. FIGS. 11 and 12 show instead an embodiment variant of the removable portion 21 the cavity 21*a* whereof has a substantially "J" shape; in this configuration, the concavity of the cavity 21*a* is only partially oriented towards the base 2 and partially towards the perimetral edge 6 (optionally towards the flange 30). FIGS. 13-16 illustrate a further embodiment of the removable portion 21 the cavity 21*a* whereof has a substantially "W" shape; in this configuration, the concavity of the cavity 21*a* is entirely facing towards the base 2. FIGS. 17 and 18 show a further embodiment of the removable portion 21 the cavity 21*a* whereof has a substantially "C shape; in this configuration, the concavity of the cavity 21*a* is entirely facing towards the base 2. The possibility of making a tab having a different shape in which only part of the concavity of the cavity 21*a* is facing only towards the perimetral edge 6 is not excluded.

As can be seen in the accompanying figures, the removable portion 21 and at least part of the perimetral edge 6, at least in the closed condition of the package, delimit an opening; in greater detail, the opening is essentially interposed between the removable portion 21 and the flange 30. At least in the closed condition of the package 100, the film 10 is engaged to the flange 30 and to the removable portion 21 and placed to cover the entire opening.

As visible, for example, in the accompanying figures, the support 1 may comprise at least one angular portion 11; for example, in the accompanying figures an embodiment of the support 1 is shown having a substantially rectangular shape, thus exhibiting four angular portions 11. In the tray-like support 1 configuration, the angular portions are defined on the bottom wall 8, on the lateral wall 7 and on the flange 30; each angular portion 11 essentially comprises a fitting. The removable portion 21 is defined at at least one angular portion 11 as illustrated for example in FIGS. 1-4.

From the point of view of the material, the removable portion 21 may have a mechanical stiffness greater than a mechanical stiffness of the closing film 10. In particular, the removable portion 21 may have a mechanical stiffness substantially identical to a mechanical stiffness of the perimetral edge 6 of the support 1; the mechanical stiffness of the removable portion 21 and of the closing film 10 is measured by traction and/or bending. In the case where the removable portion 21 and the closing film 10 are made of the same material, the removable portion 21 may have a thickness greater than the corresponding thickness of the closing film 10, so as to obtain said greater mechanical stiffness; in this condition, the removable portion 21 may for example have a thickness at least 1.5 times, in particular 3 times, greater than a thickness of the closing film 10.

The support 1 further comprises a gripping portion 22 emerging from the perimetral edge 6 and disposed, at least in the closed condition of the package 100, at least partly within the cavity 21*a* of the removable portion 21. In greater detail, the gripping portion 22 extends as a prolongation of the perimetral edge 6 away from the base 2: the gripping portion 22 extends as a prolongation of the portion itself 6*a* of the perimetral edge 6, from which, in the closed condition of the package, the removable portion 21 extends as a prolongation. In fact, the gripping portion 22 extends predominantly along a prevailing development direction parallel to a prevailing development direction of the removable portion 21, at least in the closed condition of the package 100. In even greater detail, the gripping portion 22, at least in the closed condition of the package, is interposed between the removable portion 21 and the perimetral edge 6: in particular, the gripping portion 22, at least in the closed condition of the package, is interposed between the removable portion 21 and the portion 6*a* of the perimetral edge 6 from which the same portions 21 and 22 extend as a prolongation.

As can be seen in the accompanying figures, the gripping portion 22 is coplanar with the at least said portion 6*a* of the perimetral edge 6, in particular the flange 30 of said edge 6. In particular, as shown in FIG. 2, the gripping portion 22 is coplanar with the removable portion 21 at least in the closed condition of the package 100. In fact, the gripping portion 22) extends at least partially along a respective plane parallel to the lying plane of the flange 30: the gripping portion 22 is at least partially coplanar with the flange 30 of the perimetral edge 6. In detail, the gripping portion 22 is coplanar with respect to the perimetral edge 6 (in particular to the flange 30) to which it is directly joined; in particular, the gripping portion 22 is directly engaged to the portion 6*a* of the perimetral edge 6 from which the same extends as a prolongation and is coplanar with respect to the latter portion 6*a*. In the condition illustrated in the accompanying figures, in which the edge 6 comprises the flange 30, the lying plane of the latter (flange 30) and the extension (lying) plane of the gripping portion 22 are parallel to each other. In an embodiment variant, the gripping portion 22 may have an arcuate or undulating shape; also in this condition, the prevailing development trajectory of the gripping portion 22 itself is equally parallel, in the closed condition of the package 100, to a main development direction of the removable portion 21, optionally parallel to the portion 6*a* of the perimetral edge 6.

The gripping portion 22 is connected directly to the perimetral edge 6 of the support 1. In one embodiment, the gripping portion 22 is integrally joined to the perimetral edge 6 of the support 1, in particular integrally joined to the flange 30. The gripping portion 22 comprises a tab extending in thickness between a first surface extending without continuity to the first surface 1*a* of the support 1 and a second surface extending seamlessly to the second surface 1*b* of the support 1.

In an embodiment, the gripping portion 22 comprises a tab emerging from the perimetral edge 6 and lying on a plane: the lying planes of the gripping portion 22 and of the removable portion 21 are—at least in the closed condition of the package—parallel to each other. In general, the tab of the gripping portion 22 and of the removable portion 21, at least in the closed condition of the package 100, are parallel to each other. In the configuration of the package 100 with support 1 of the tray type, the gripping portion 22 essentially emerges from the lateral wall 7 away from the latter and from the bottom wall 8. As described above, the support 1 may comprise one or more angular portions 11; the gripping portion 22 is disposed at the same angular portion 11 at which the removable portion 21 is disposed. The gripping portion 22 is at least partly counter-shaped to the cavity 21*a* of the removable portion 21 and is entirely disposed (contained) within said cavity 21*a*. In particular, the gripping portion 22 is entirely disposed within the cavity 21*a* and entirely interposed, at least in the closed condition of the package, between the perimetral edge 6 (optionally the flange 30) and the removable portion 21. In other words, the gripping portion 22 extends starting from a section of an outer perimeter delimiting the opening defined between the edge 6 and the removable portion 21, within said opening.

In an embodiment shown in FIGS. 1, 2, 4, 9-12, the gripping portion 22 is, at least in the closed condition of the package 100, entirely counter-shaped to the cavity 21*a* of the removable portion 21: the gripping portion 22 substantially entirely occupies the opening delimited by the removable portion 21 in the closed condition of the package 100 in cooperation with the perimetral edge 6.

In an embodiment variant for example shown in FIGS. 15 and 19, the gripping portion 22 is, at least in the closed condition of the package 100, only partially counter-shaped to the cavity 21*a* of the removable portion 21: the gripping portion 22 occupies only one part of the opening delimited by the removable portion 21 in the closed condition of the package 100 in cooperation with the perimetral edge 6.

The bottom wall 8 and the lateral wall 7 may be made in one piece; as better described below, the bottom wall 8 and the lateral wall 7 are obtained by means of plastic deformation, in particular by thermoforming, of the same sheet material. The base 2, the lateral wall 7, the perimetral edge 6, the flange 30 and the gripping portion 22 form a single solid body made of plastic material. In the embodiment in which the removable portion 21 is joined to the edge 6 by the weakening portion 25, the removable portion 21 is then integrally joined to the base 2, lateral wall 7, perimetral edge 6, flange 30 and gripping portion 22.

As specified above, the gripping portion 22 is integrally joined (directly carried) and therefore constrained to the perimetral edge 6, optionally by the flange 30, of the support 1; the gripping portion 22 is in particular only constrained directly to the perimetral edge 6 (optionally to the flange 30) of the support 1: the gripping portion 22 is not directly constrained to the closing film 10. In other words, the gripping portion 22, in the closed condition of the package, has an upper surface adapted to receive in abutment the closing film 10 and released from (not firmly engaged with) the closing film 10. In fact, the gripping portion 22 is configured for defining a constraint with the closing film 10 by simple contact or support.

As described above, the closing film 10 is made of plastic material; the film 10 is engaged with the support 1 by means of a heat-sealing action: the film 10 and the support 1 are made of heat-sealable material and therefore capable of ensuring a stable engagement (welding) with each other.

Figure 5:
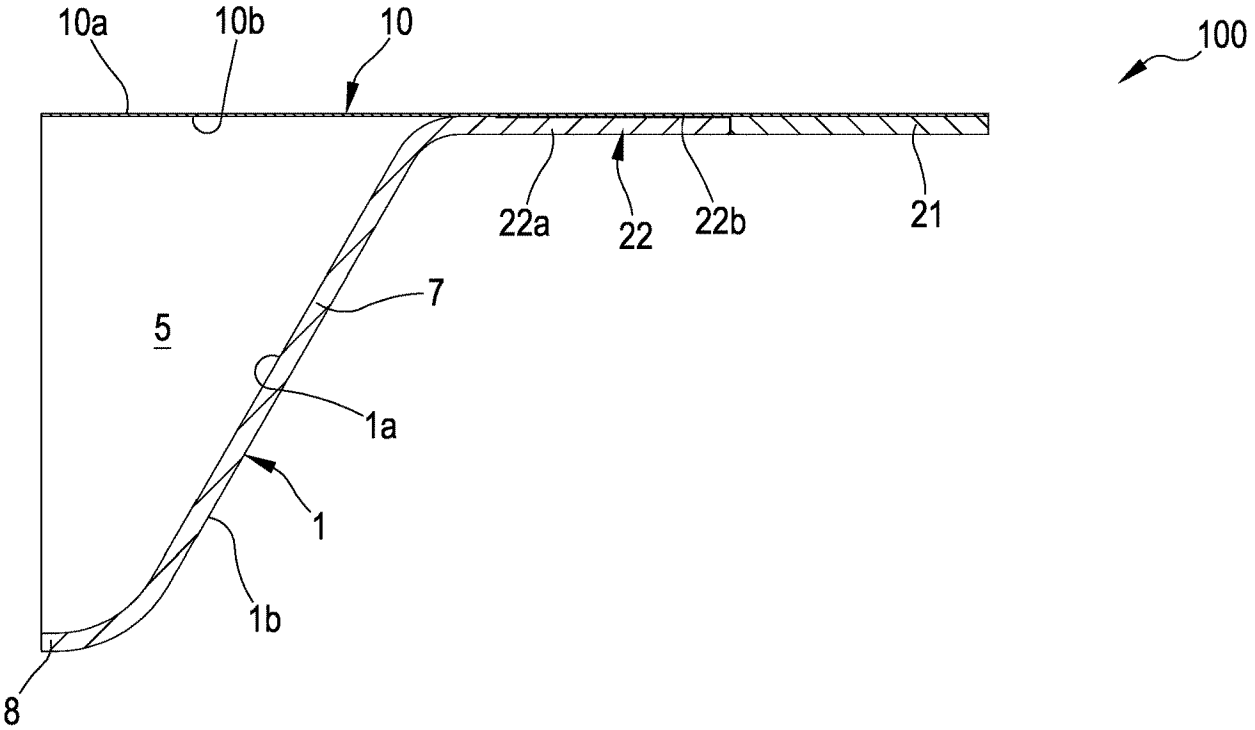
FIG. 5 is a sectional view according to line V-V, of the package in FIG. 4.
Figure 6:
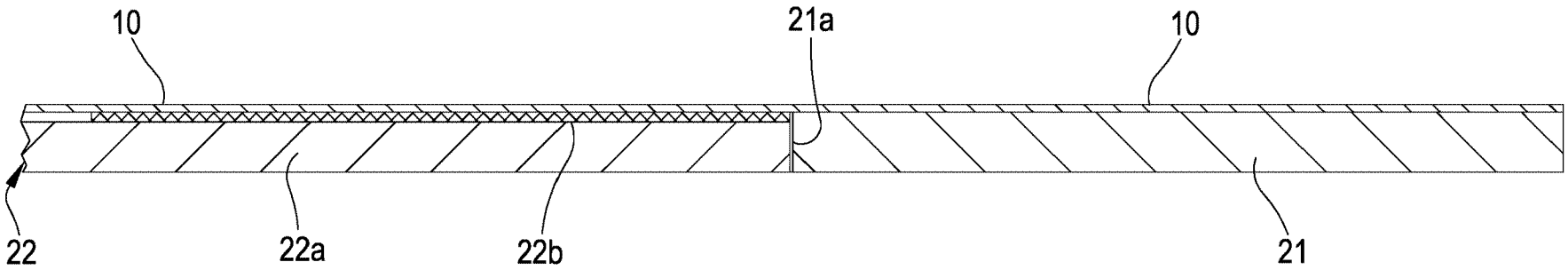
FIG. 6 is a detailed view of the sectional view of the package in FIG. 5.
Figure 7:
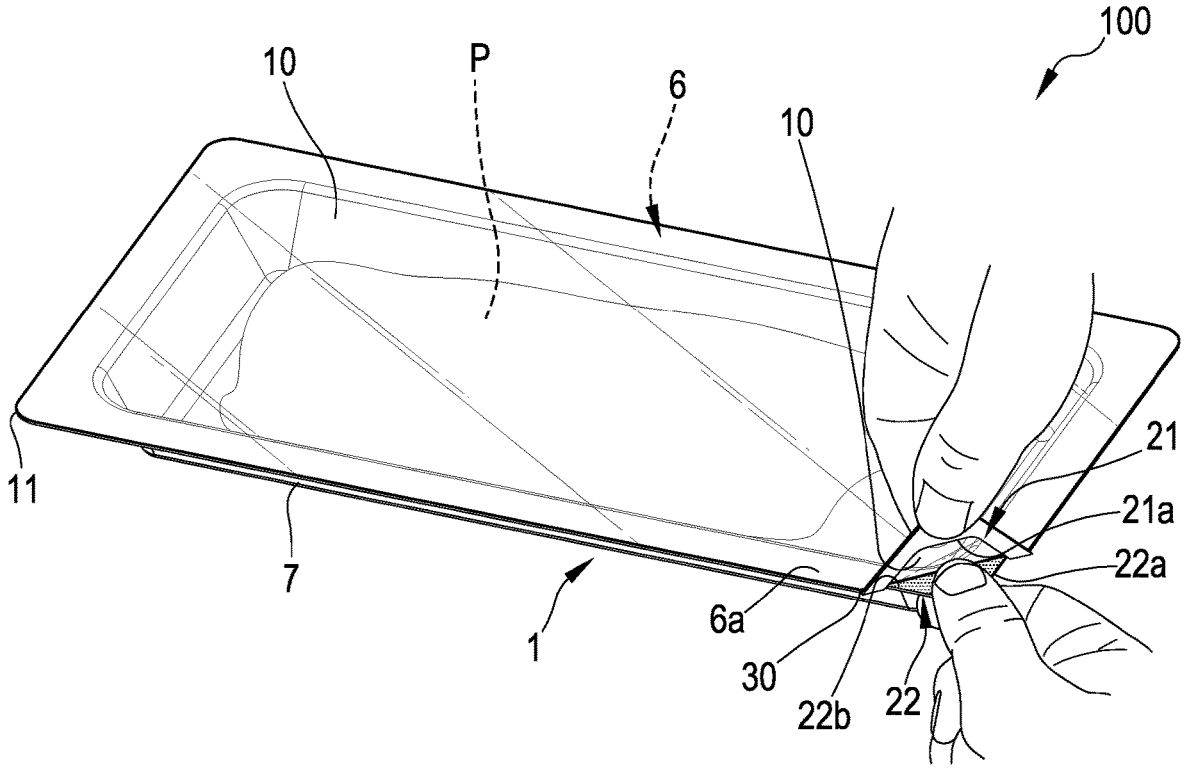
FIGS. 7 and 8 schematically show opening steps of a package according to the present invention.

In one embodiment, the gripping portion 22 comprises a support portion 22*a* and a coating layer 22*b* adapted to cover at least partially the support portion 22*a* (see, for example, FIGS. 5 and 6). The coating layer 22*b*, at least in the closed condition of the package, is interposed between the support portion 22*a* of the gripping portion 22 itself and the closing film 10; the coating layer 22*b* is made of a material, for example not heat sealable, configured for preventing the sealing of the gripping portion 22 itself to the closing film 10. The coating layer 22*b* is exclusively constrained directly to the support portion 22*a* of the gripping portion 22 thereof. In terms of materials, the coating layer 22*b* of the gripping portion 22 may be made of at least one selected from the group of the following materials:

- wax, for example synthetic wax, petroleum-derived wax, mineral wax;
- plastic, for example high melting point thermoplastic resins, such as for example polyesters (particularly PET), polyamides or PP homopolymer or resins chemically incompatible with the sealing layer of the closing film (for example wherein the sealing material is polyethylene and the coating layer is made of PETg) or thermosetting resins;
- smooth or embossed paper;
- ink or paint;
- metals, for example aluminum.

Figure 13:
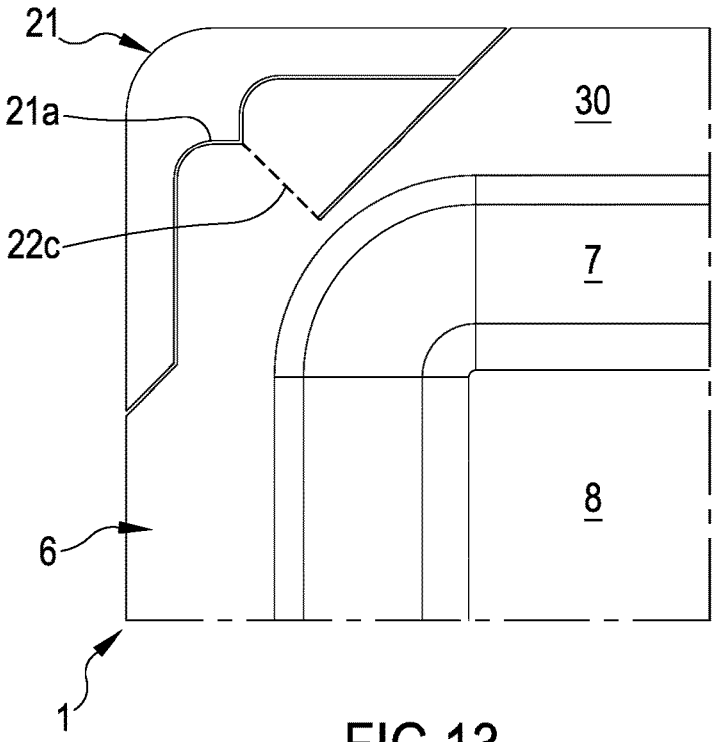
FIGS. 13 and 14 schematically illustrate a support of the package according to FIGS. 11 and 12.

In particular, in the embodiments of the package 100 for example shown in FIGS. 1, 2, 4-12, the gripping portion 22 is defined by a support portion 22*a* joined to the support and emerging from the edge 6*a*, the portion is coated on top by the layer 22*b*; in this configuration, the layer 22*b* comprises an additional layer of material incompatible with the closing film (material not weldable with the film 10) applied for example by printing on the support portion 22*b*. In this specific configuration, the coating layer 22*b* may comprise, for example, a composition based on wax or ink. In FIGS. 14-20, the support 1 is made of sheet material and the surface 1*a* (upper surface) and the surface 1*b* (lower surface) extend in thickness; at least a part of the surface 1*b* is made of a material configured for preventing the sealing, in particular the heat-sealing, of the surface 1*b* and the closing film 10. The support 1 may be made of a multilayer plastic material such that the entire lower surface 1*b* is entirely made of a material (for example PET or PETg) not compatible with the closing film 10 while the upper surface 1*a* is entirely made of heat-sealable material adapted for be sealed to the closing film 10. In this configuration, the gripping portion 22 is obtained by folding a portion of the support such that a part of the lower surface 1*b* of the support is turned over and disposed adjacent to the upper surface 1*a* (see for example FIGS. 14 and 18 which show the folding step of a portion of the support 1); at the end of the folding step, the gripping portion 22 is defined by a portion of the support in which the coating layer 22*b* consists of the surface 1*b* of the support 1. FIGS. 13 and 17 show two different notches of the support 1 which delimit a portion of the support 1 adapted to be folded along respective folding lines 22*c*.

On a functional level, the gripping portion 22 is configured for being firmly gripped by a user during an opening step of the package 100 (see FIGS. 7 and 8), so as to keep the support 1 in a stable position and thus facilitate the operation of separation of the film from the support 1 (opening of the package). In particular, FIG. 1 shows the package 100 in the closed condition thereof; the gripping portion 22 is placed in the cavity 21*a* of the removable portion 21 and is covered by the closing film 10: the gripping portion 22, as specified above, is not constrained to the closing film 10 which is liftable with respect to said gripping portion 22 together with the removable portion 21 (see FIG. 7). Due to the configuration of the gripping portion 22 and of the removable portion 21, the package is configured for defining a pre-opening condition in which the gripping portion 22 and the removable portion 21 are configured for being grasped simultaneously by the user. FIGS. 7, 12, 16 and 20 show this pre-opening condition of the package 100, in which:

- the closing film 10 and the support 1 interdict the access to the housing compartment 5. The closing film 10 is firmly engaged to the perimetral edge 6 to define said fluid-tight housing compartment 5 for the product P,
- the removable portion 21 is at least partially raised, optionally angularly offset, from the gripping portion 22.

Figure 8:
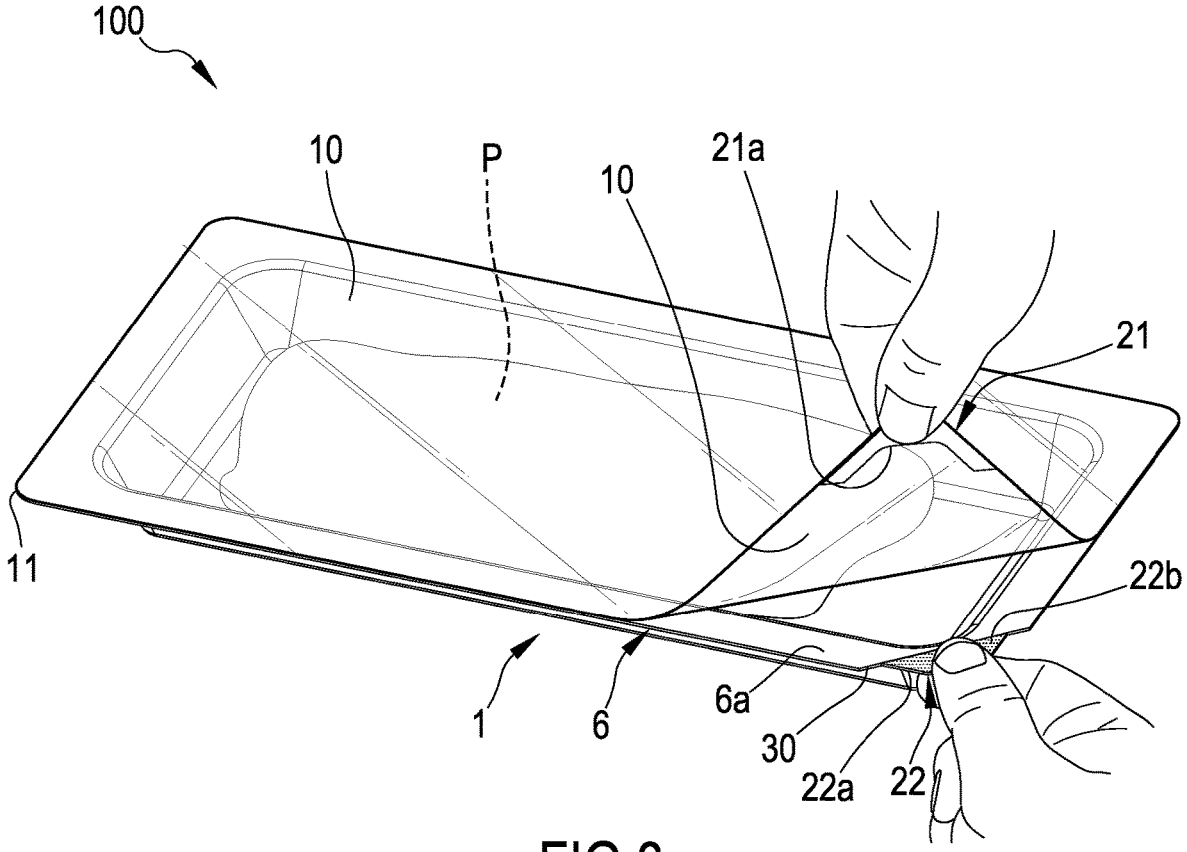

In the pre-opening condition of the package, the closing film 10 is distanced from the gripping portion 22 so that such gripping portion is grippable by an user. In fact, in the pre-opening condition, the user can keep the package 100 in position by means of the gripping portion 22 and a first step of removing the removable portion 21 together with the closing film 10 begins. FIG. 8 instead shows an advanced opening step of the package 100 wherein the removable portion 21 is separated from the portion 6*a* of the perimetral edge 6 and wherein the closing film 10 is partially separated from the perimetral edge 6, in particular it is separated from the flange 30 allowing access to the housing compartment 5 accommodating the product P.

As mentioned above, the greater mechanical stiffness of the removable portion 21 provides the user with a considerably more stable grip than in a case in which the grip occurred directly on a portion of the closing film 10. Moreover, the difference in mechanical stiffness between the removable portion 21 and the closing film 10 provides the user with a better tactile perception, facilitating the user in the step of locating the removable portion 21 during an opening step. In this way, it is certainly possible to facilitate both the pre-opening condition of the package for raising the removable portion 21 and the advanced open condition of the package during which the film 10 is removed from the support 1.

Process of Making Said Package 100

Another object of the present invention is a process for making the package 100, according to any one of the appended claims and/or according to the description given above.

The process described below uses the apparatus 300 described and claimed below in one or more of the accompanying claims. It should also be noted that, according to a further aspect of the invention, the various method steps described below can be carried out by a control unit 311 (FIG. 11) which acts on suitable actuators and/or motors and/or pumps and/or valves in order to carry out the various steps described and determine the movements of moving parts; the control unit 311 may further be used to control the suction and/or injection of gas into a packaging chamber within which the package 100 is formed at least in part.

The process contemplates providing a sheet material 200 along a predetermined advancement path A; such a step involves unwinding the sheet material 200 itself in a web configuration from a reel, such as for example schematized in FIG. 11. In the case in which packages with a tray-shaped support 1 are to be made, the process comprises a step of thermoforming the sheet material 200 such that said sheet material 200 defines a precursor body comprising a plurality of semifinished supports 1*c*; each semifinished support 1*c* comprising:

- at least one base 2 configured for receiving one or more products P, and
- at least one perimetral edge 6 surrounding the base 2.

In fact, the base 2 and the perimetral edge 6 of each semifinished support 1*a* are respectively configured for defining, at the end of the process, the base 2 and the edge 6 of the support 1 of the finished package 100. In particular, the thermoforming step is adapted to define the lateral wall 7, the bottom wall 8 and the flange 30 of the support 1.

FIG. 12 schematically shows the sheet material 200 formed as a continuous strip on which the plurality of semifinished supports 1*c* aligned along the predetermined advancement path A are defined. In the accompanying figures, a configuration of the sheet material 200 has been schematically illustrated, in particular of the precursor body, having semifinished supports 1*c* alongside two by two along a transverse direction, optionally orthogonal, to the advancement path A of said sheet material 200.

Figure 25:
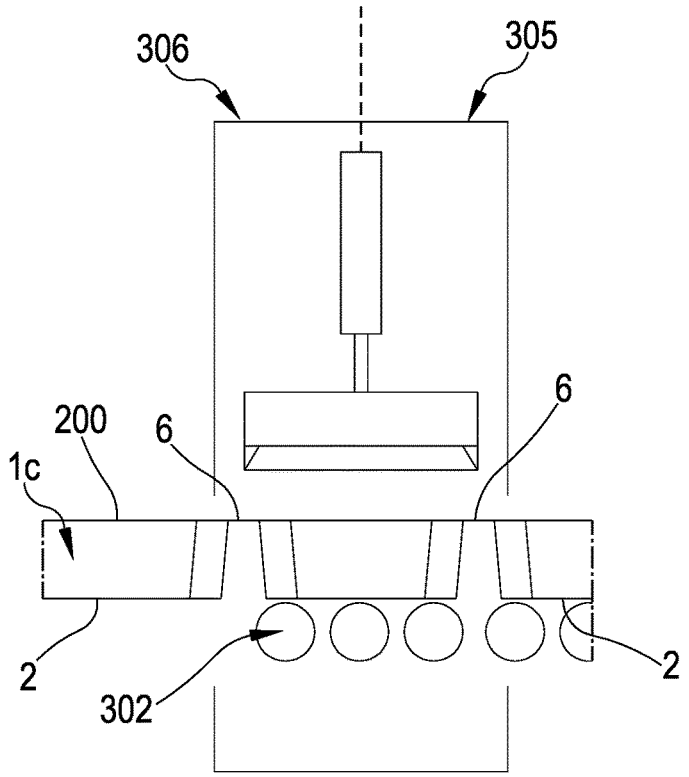
Figure 25A:
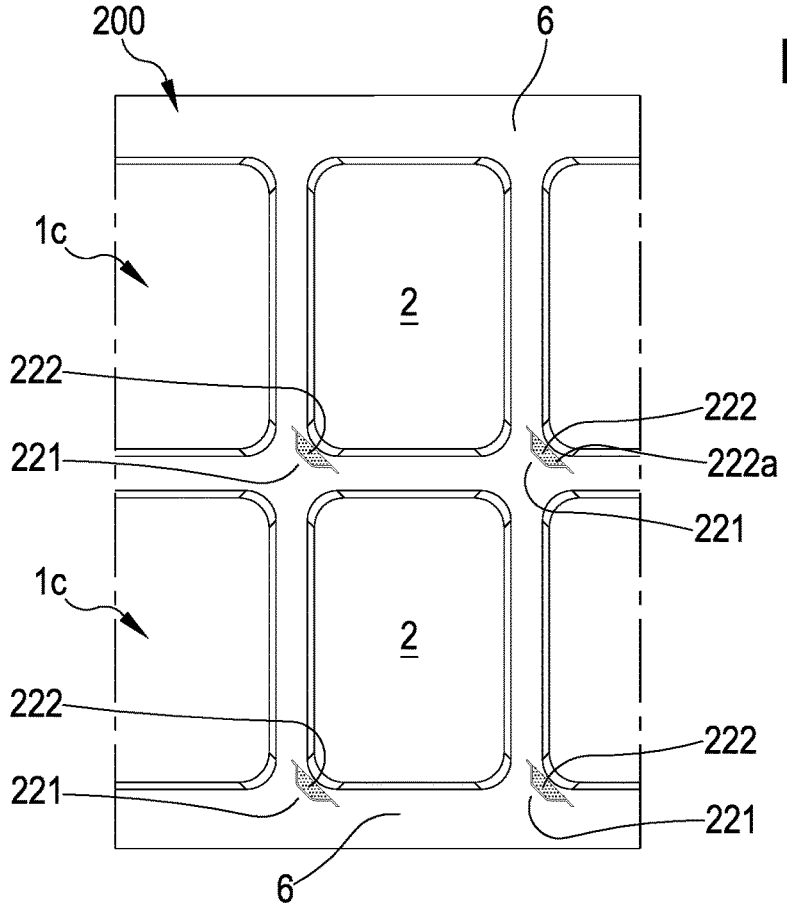

The process comprises a notching step of the sheet material 200 in order to define on the same a first and second semifinished portions 221, 222 flanked to each other. The notch passes through the sheet material 200 and in particular defined at the edge 6 of each semifinished support 1*c*. As can be seen, for example, in FIG. 25A, the notch (through cut) has a substantially "C" shape with concavity turned towards the base 2 of the respective semifinished support 1*a*.

The first semifinished portion 221 of the support 1*a* is configured for defining the removable portion 21 of a support 1 while the second semifinished portion 222 is configured for defining the gripping portion 22 of the support 1; during the notching step of the sheet material, the cavity 21*a* of the removable portion 21 is delimited.

The notching step may be carried out in such a way that the removable portion 21 is completely separated from the base (FIG. 9) or it can define the weakened portion 25 interposed between the removable portion 21 and the portion 6*a* of the perimetral edge 6.

The process also provides for a step of defining a layer of a not heat-sealable material 222*a* on a portion of an upper surface of the second semifinished portion 222*a* adapted to prevent the constraint (sealing) of a closing film on said second semifinished portion 222. For example, the step of defining said not heat sealable material 222*a* may include a step of applying on a portion of the sheet material 200 at least one of the following materials selected from the group of the following materials:

- wax, for example synthetic wax, petroleum-derived wax, mineral wax;
- plastic, for example high melting point thermoplastic resins, such as for example polyesters (particularly PET), polyamides or PP homopolymer or resins chemically incompatible with the sealing layer of the closing film (for example wherein the sealing material is polyethylene and the coating layer is made of PETg) or thermosetting resins;
- smooth or embossed paper;
- ink or paint;
- metals, for example aluminum.

The application of the coating layer 22*b* on the sheet material 200 may for example be carried out by means of a printing step (for example in the case where the material 22*b* is ink or wax) or by the adhesion (for example gluing) of said layer 22*b* (for example in the case where the layer is plastic or paper). The not heat sealable material 222*a* applied to the sheet material 200 is configured for defining, at the end of the packaging process, the coating layer 22*b* of the package 100. This application step may be carried out prior to the notching step of the sheet material 200, such as for example shown in FIGS. 24A, 25A or after. As better described below, the presence of the material 22*b* prevents the sealing of the second semifinished portion 222 to a closing film 201, for example made of plastic material.

Alternatively, the step of defining said not heat sealable layer on the sheet material 200 may comprise a folding step of the second semifinished portion; for example, in the case in which the sheet material 200 is defined in thickness between an upper surface of heat-sealable material and a lower surface of a not heat-sealable material, the process may provide for folding a first part of the semifinished portion 222 above a second part in such a way that:

- the upper surfaces of the first and second part of the semifinished portion are facing and in contact with one another,
- the lower surface of not heat-sealable material of the first part of the second semifinished portion essentially defines an outer surface of the sheet material adapted to receive a closing film in abutment.

Figure 14:
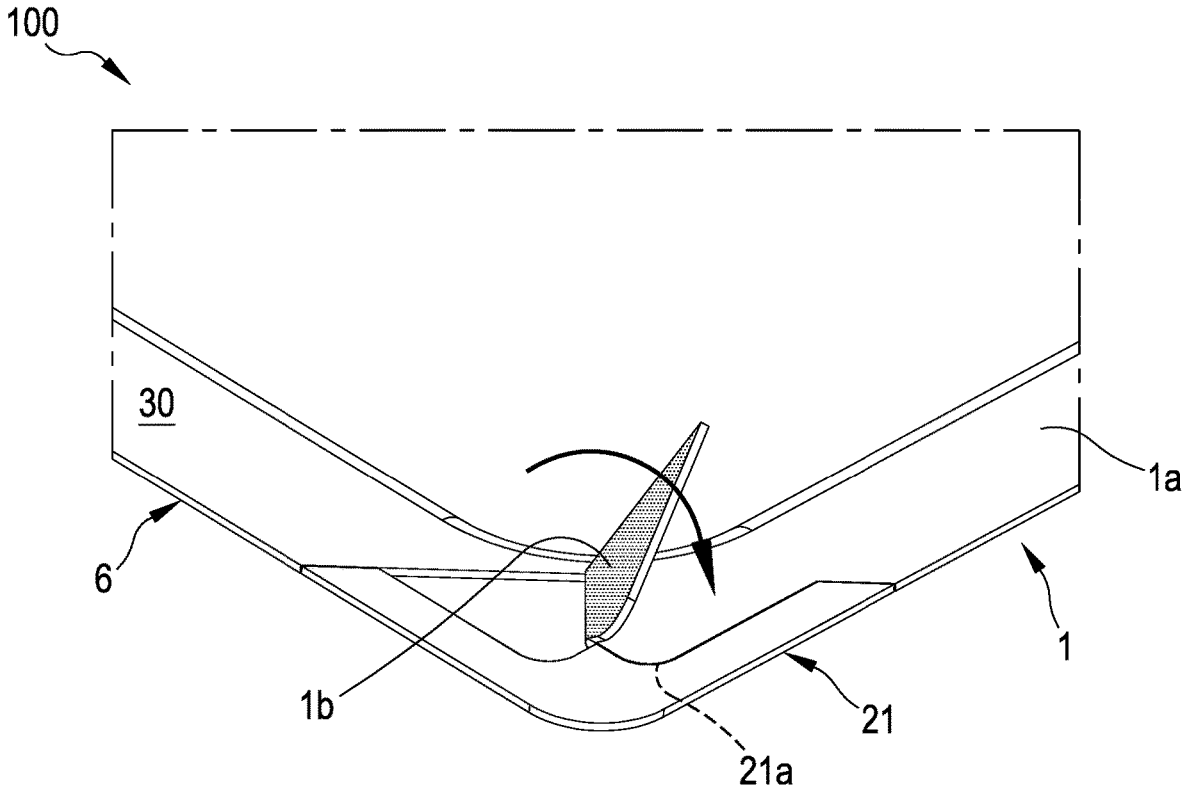

FIGS. 14 and 18 illustrate a step of folding a portion of a support 1; the same folding step may be carried out—in the same way—on the second semifinished portion 222 of each semifinished support 1*c*.

The folding step of the second semifinished portion 222 allows overlapping the first and second part of said portion 222 in order to dispose the lower surface of not heat-sealable material of the first part adjacent to an upper surface of the first semifinished portion configured for receiving a closing film. This folding step allows obtaining packages 100 as illustrated for example in FIGS. 15 and 19. Obviously, the folding step of the second semifinished portion 222 may be carried out only after the notching step of the material, as illustrated schematically in FIG. 32, in which there is a notching station 305, adapted to define the first and second semifinished portion 221 and 222, located upstream of a folding station 330 adapted to fold the second semifinished portion 222.

Figure 26:
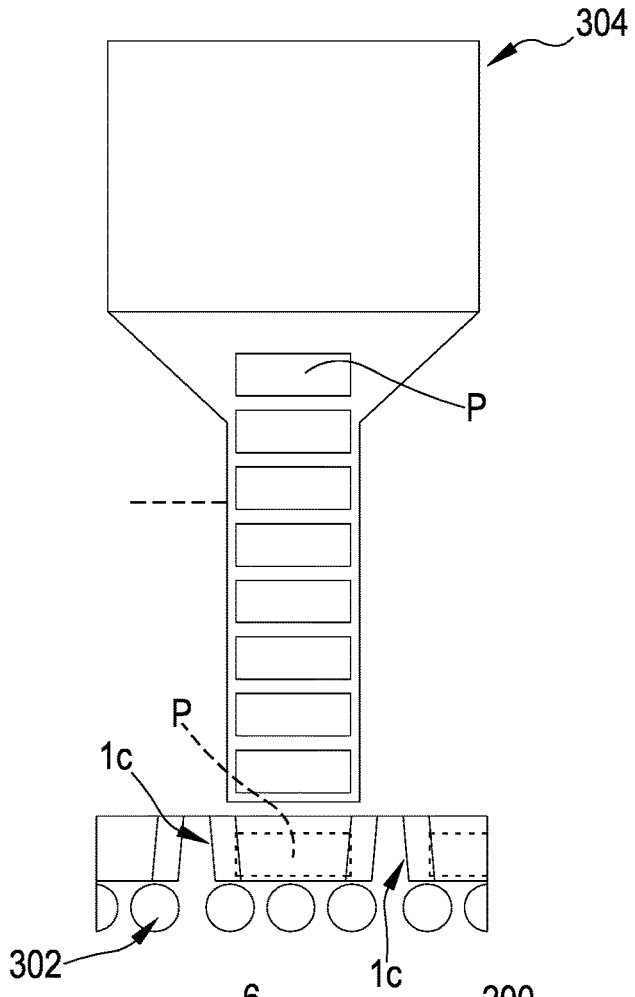
Figure 26A:
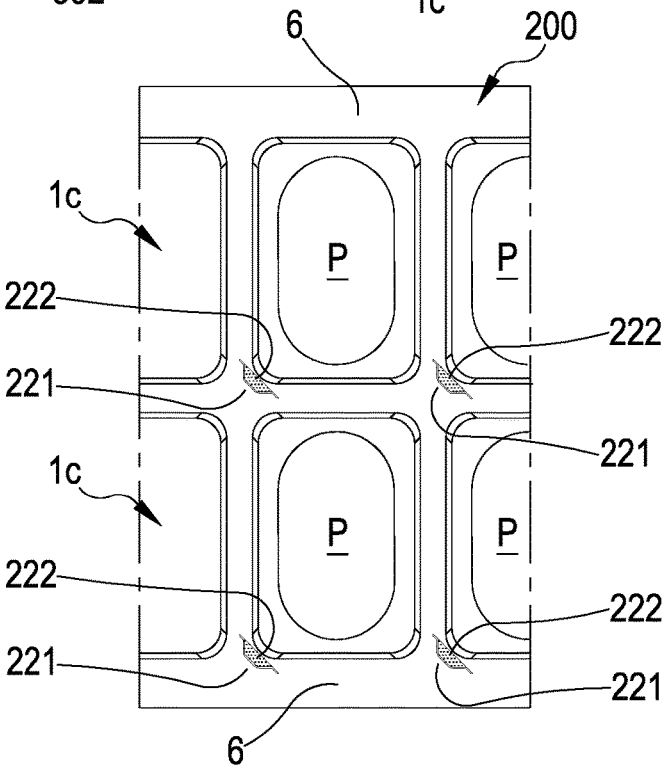

The process further provides for positioning at least one product P on the base 2 of the sheet material 200 (FIG. 26). The step of positioning of the product P on the material may be performed:

- prior to or after the notching step of the sheet material 200,
- prior to or after the folding step of the second semifinished portion,
- prior to or after the application step of the coating layer 22*b* onto the sheet material 200.

The positioning of the product P on the sheet material, and specifically on the base 2 of each semifinished support 1*c* of said sheet material 200, may be performed manually by an operator or automatically by means of a special positioning station 304.

Only following the positioning of the product P and following the definition of the layer of material not heat-sealable on the second semifinished portion 222, the process comprises a step of constraining a closing film 201 to at least one portion of the sheet material 200 so that the product P is positioned inside a housing compartment 5 defined by the closing film 201 constrained to said sheet material 200. In particular, the closing film 201 is constrained at least to the edge 6 of each semifinished support 1*c* of the precursor body. The step of constraining the film 201 takes place by means of heat-sealing (see FIG. 26), so that the housing compartment 5 inside which said product P is housed is fluid-tight. The film is fluid-tightly sealed to the edge 6 including the first semifinished portion 221 (removable portion 21) excluding the second semifinished portion 222 which, due to the presence of the not heat-sealable material 222*b* or due to the presence of the lower surface of the material sheet 200 of a not heat-sealable material, is configured for receiving in contact the closing film 201 preventing the sealing of said film 201 on the second semifinished portion 222: the closing film 201 is only sealed to the edge 6 and to the first semifinished portion 221 of the sheet material 200.

The process may further comprise a step—after that of positioning the product P on the base 2 and before that of constraining the closing film 201—of removing at least part of the air from the housing compartment 5 in order to define inside the latter a pressure less than the atmospheric pressure to make skin-type vacuum packages. Alternatively, the process can provide for the removal of at least part of the air from the housing compartment 5 and the insertion inside the latter of a predetermined type of gas to make a modified atmosphere package.

The film 201 may also be in the form of a continuous film and be unwound from a reel as shown in FIG. 16 above the sheet material 200 for the upper closure of the housing compartment of each semifinished support 1*c*. In this configuration, the closing film essentially defines a tape.

A further step of the manufacturing process, subsequent to the step of constraining a closing film 201 to the edge 6 of the sheet material 200, provides for the through cut of the sheet 200 and of the closing film 201 which through cut, in cooperation with the notch made on the sheet material 200 is adapted to delimit the removable portion 21 and in particular to define said package 100.

In greater detail, the through-cutting step comprises cutting the precursor body and, at the same time, the closing film 201 constrained on said precursor body so as to define individual packages 100. In fact, the through cut allows the separation of the semifinished supports 1*c* of the sheet material 200 to define individual supports 1 on which the film 10 defined by a portion of the continuous closing film 201 is fluid-tightly constrained. The through-cutting steps are schematically illustrated in FIGS. 29, 29A.

FIGS. 21 to 29A illustrate a process which provides for the in-line forming of packages which are obtained by forming and cutting the sheet material 200 and sealing and cutting the closing film 201.

Figure 30:
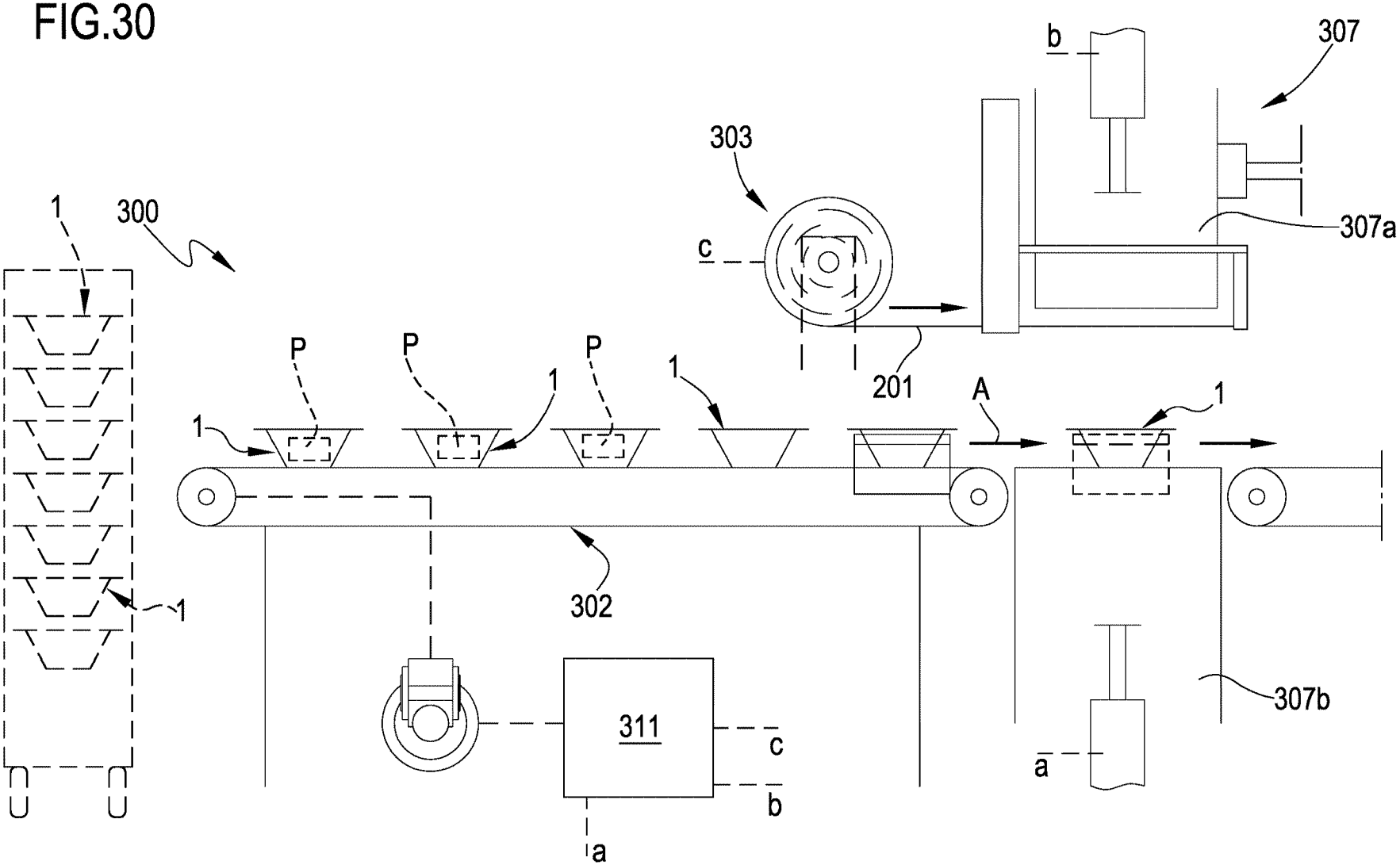
FIGS. 30 and 31 are schematic views of further embodiments of a packaging apparatus for making a package according to the present invention.
Figure 31:
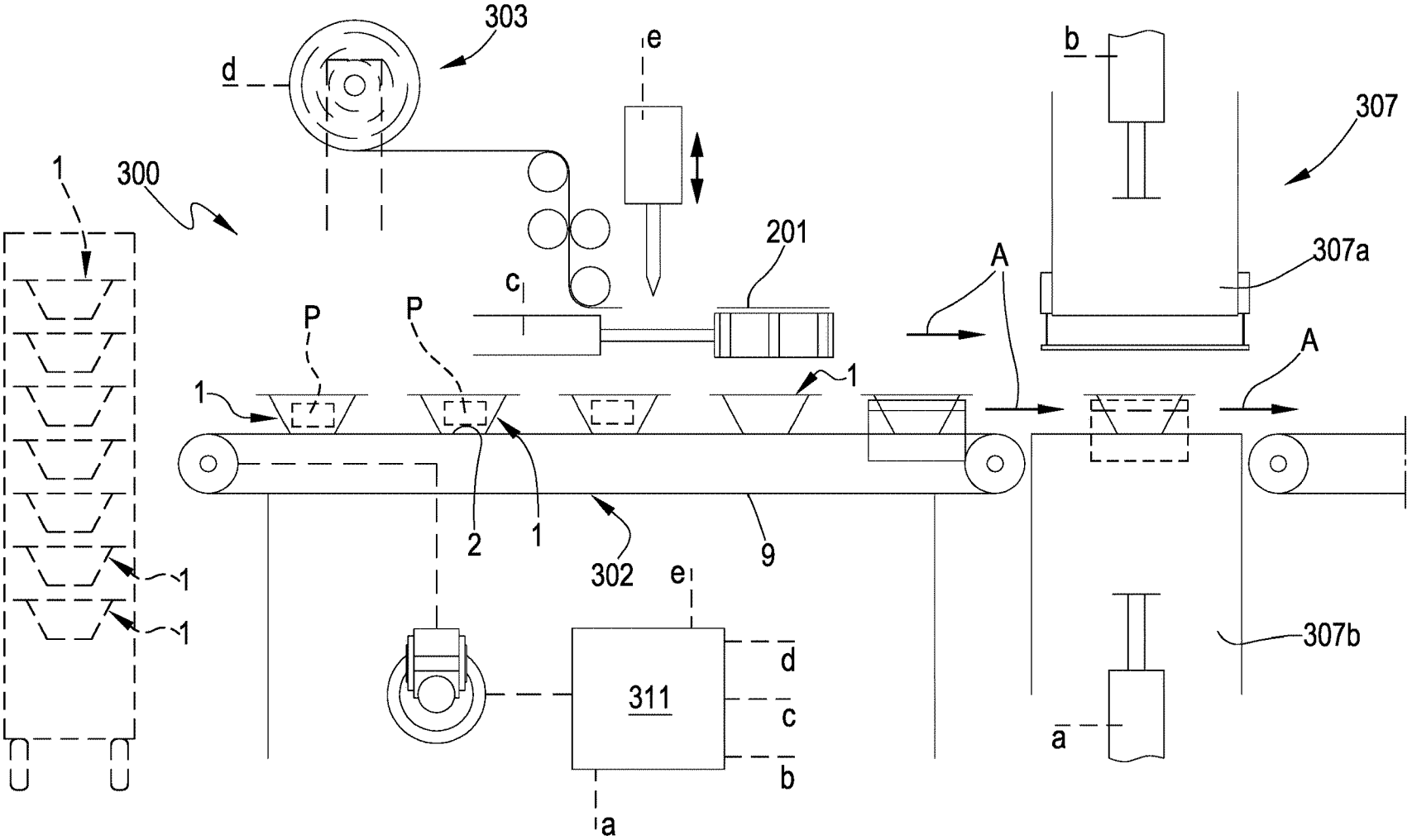

Alternatively, the process may include the use of supports 1, or trays, preformed, made for example on a forming line separate from the packaging line. FIGS. 30 and 31 show, for example, processes which exhibit a feeding station of single supports 1 (distinct and separate from each other) which are moved, for example by means of a conveyor 302, inside a packaging station. During the movement of the single supports 1, the positioning on each of these of at least one product is provided. Each support 1 carrying the product P is then sent to a packaging station where a closing film is welded to the support 1 in such a way that the product P is closed fluid-tightly between the support and the film. FIG. 30 schematizes an embodiment of the process in which the closing film is in the form of a continuous tape and is thus supplied to the packaging station. In this configuration, the process must provide a continuous film cutting step in such a way as to allow the package to separate from the tape. FIG. 31 instead schematizes a variant of the process which provides for the pre-cutting of a continuous film outside the packaging station to define a portion of film which is brought inside the packaging station to be bound to a respective support.

The processes shown in FIGS. 30 and 31 can be implemented for the production of packages 100 in which the support 1 is capable of permanently carrying the removable portion 21 also without the presence of the closing film 10 due to the presence of the weakening portion 25. In fact, due to the presence of the batons of the weakening portion, the supports 1 resting on the conveyor have the gripping portion 22 and the removable portion 21 integrally joined to the edge 6 and to the base 2. In this way, the packaging step provides for the application of the closing film on a single finished support 1.

Apparatus for Making Said Package

Another object of the present invention is an apparatus 300 for making packages 100 according to one or more of the appended claims and/or according to the description given above. In particular, the apparatus 300 is configured to perform the process claimed and/or described above used for making said package 100.

Figure 21:
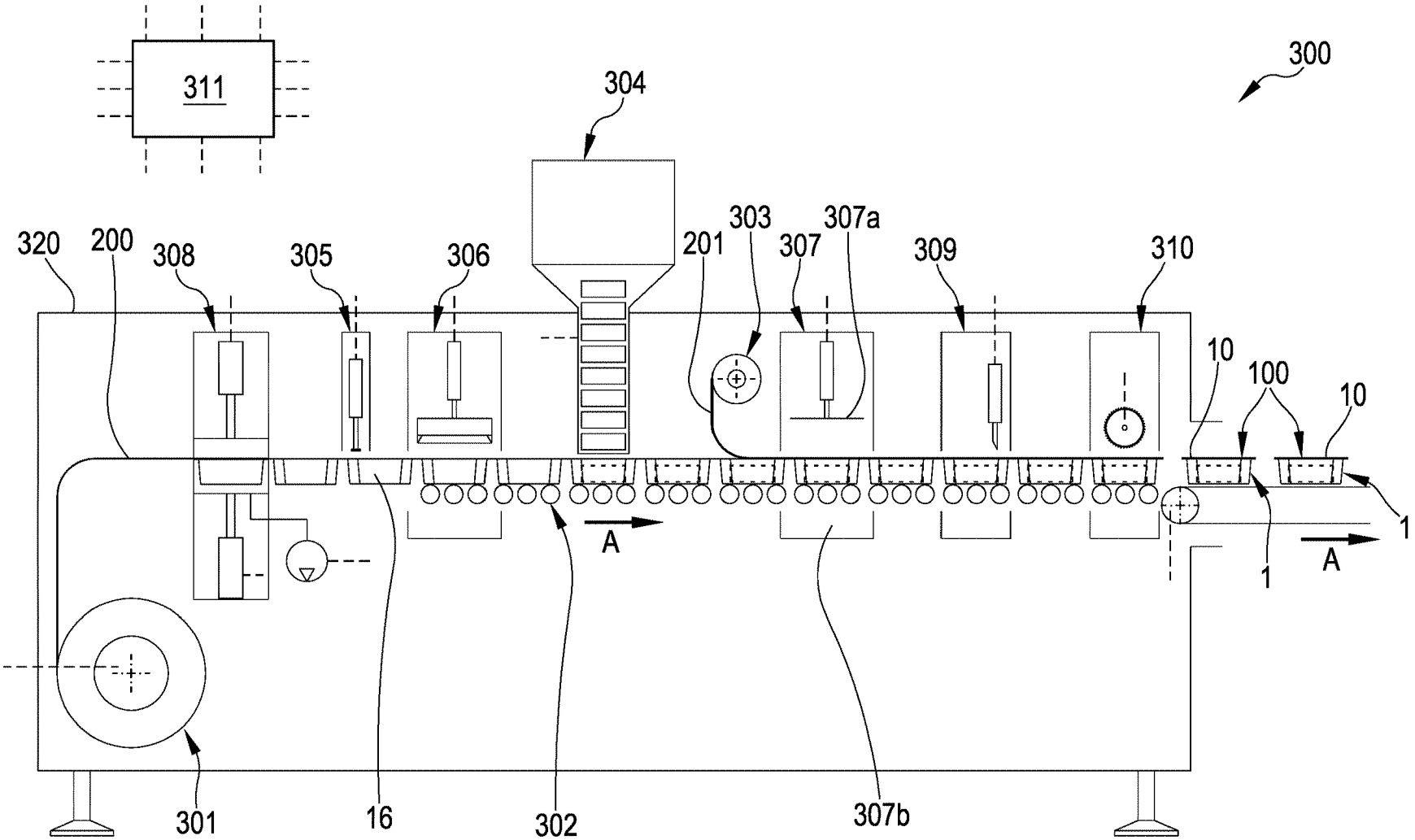
FIG. 21 is a schematic view of a packaging apparatus for making a package according to the present invention.
Figure 22:
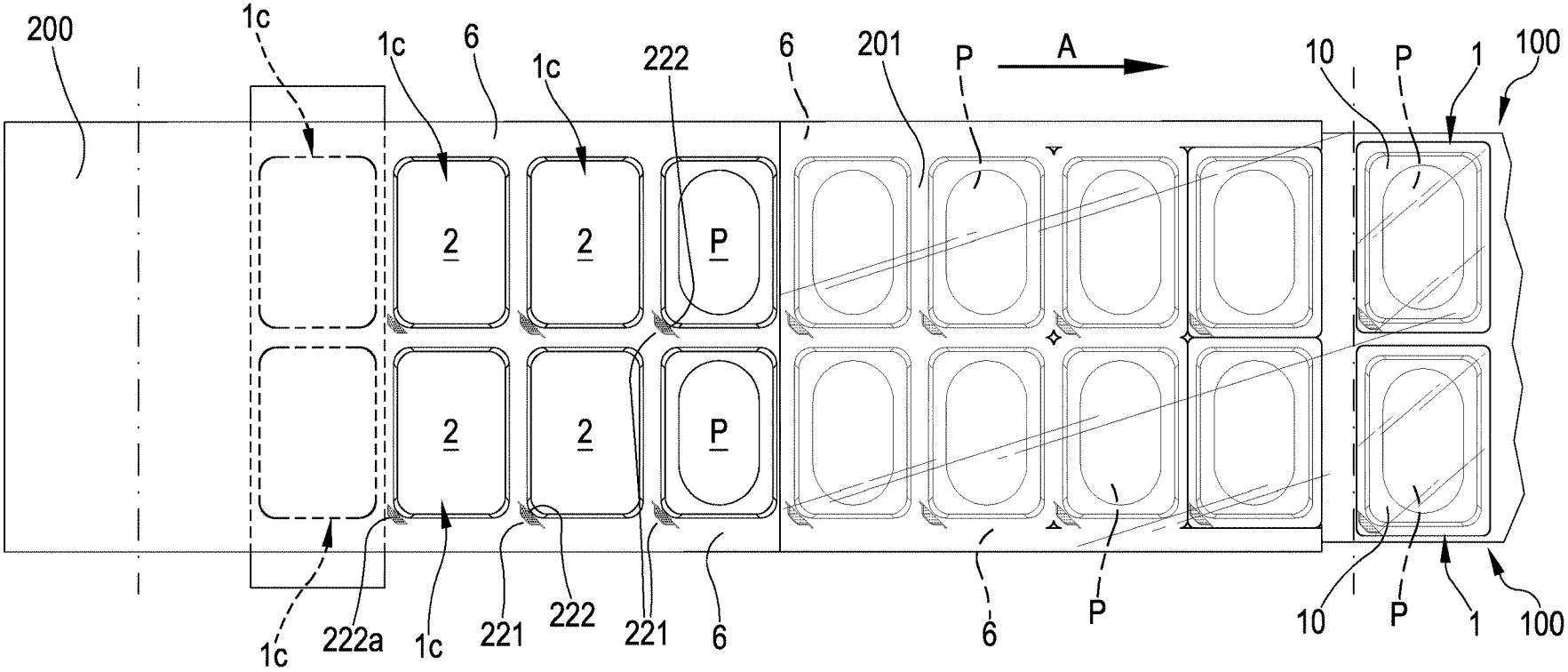
FIG. 22 is a top view illustrating schematically different configurations of a semifinished product for making a package according to the present invention.

In a first embodiment illustrated in FIG. 21, the apparatus 300 comprises a plurality of operating stations arranged sequentially to define a production line, each of said operating stations configured for performing a predetermined operation on a semi-finished product so as to obtain the package 100 at the output of the line. The various operating stations of the apparatus 300 are described below, following an order of sequence of the processing steps.

The apparatus 300 comprises at least one frame 301 configured for supporting one or more operating stations and ensuring stability during the operating steps. The apparatus 300 further comprises a first supplying assembly 301 shown in FIGS. 21 and 23, configured for providing the sheet material 200 and disposing it along the production line so that said sheet material 200 extends smoothly through the plurality of operating stations. The first supplying group 301 provides the sheet material 200 wound on a reel movable by rotation, in particular said reel can be: a) moved by an electric motor, b) braked, c) free in rotation.

The movement of the sheet material 200 along a predetermined advancement path A of the sheet material 200 is ensured by the presence of a conveyor 302, shown in FIG. 21, engaged to the frame 320. Said conveyor 302 comprises a belt driven by one or more electric motors and configured for supporting the sheet material 200. Alternatively, the conveyor 302 may comprise a system for laterally hooking the sheet material 200 by means of clamps, so as to impose its movement through the use of one or more electric motors.

Figure 23:
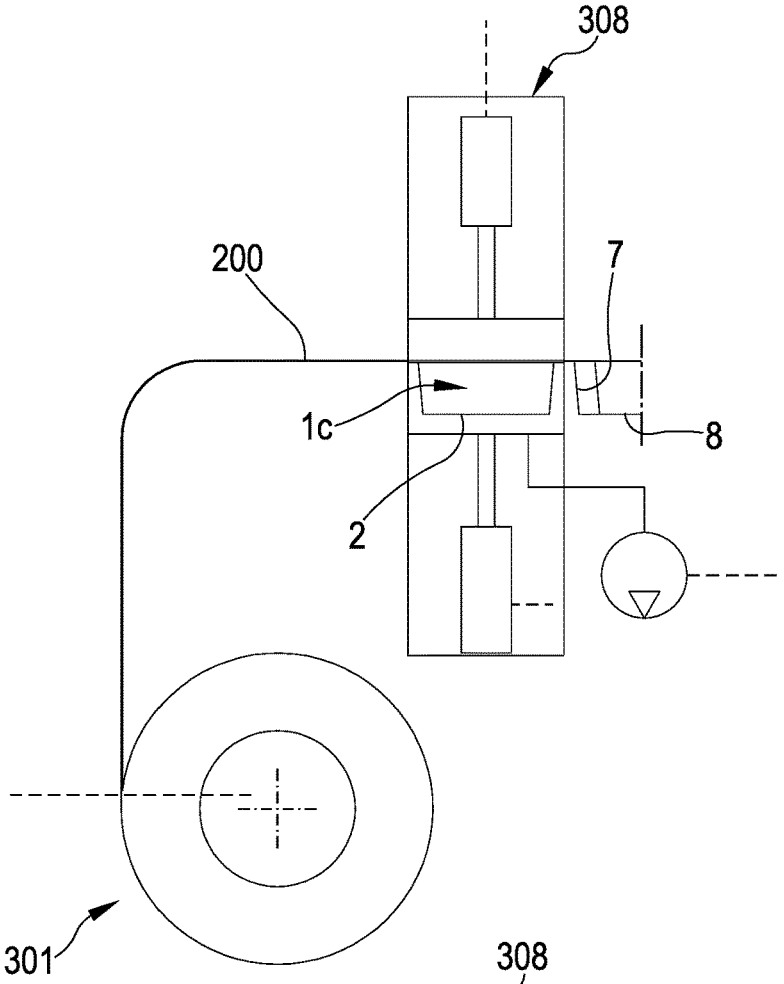
Figure 23A:
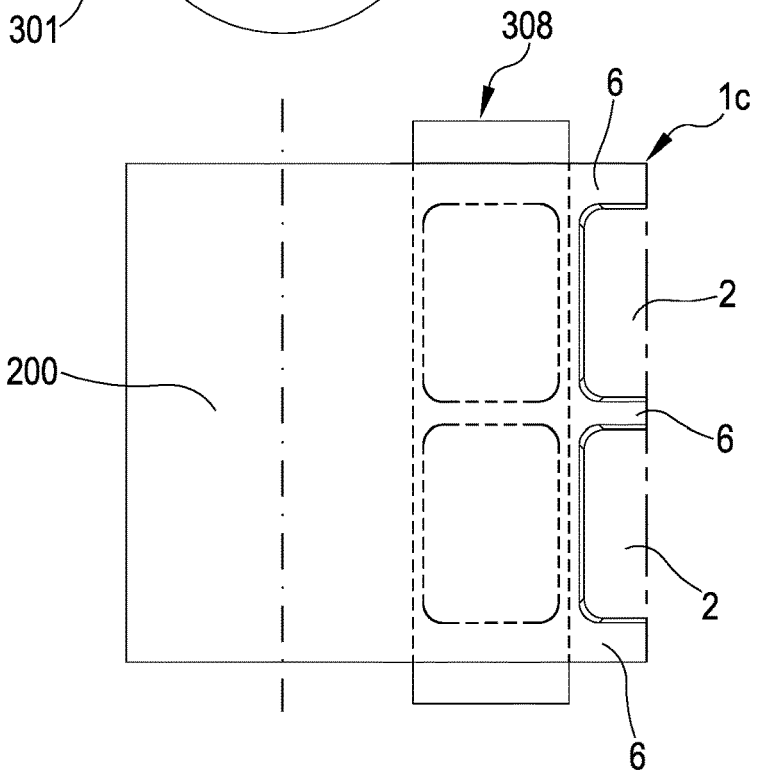

Downstream of the first supplying group 301 of the sheet material 200, the apparatus 300 may comprise at least one thermoforming station 308, shown in FIGS. 21 and 23, configured for defining the semifinished supports 1*c* on said sheet material; in the accompanying figures, a thermoforming station has been illustrated to define a semifinished support 1*c* shaped as a tray comprising the bottom 8 and lateral 7 walls. The thermoforming station 308 provides for heating the plastic sheet material 200 to a predefined temperature sufficient to deform said sheet 200, imposing, by the presence of a mold, the desired shape of the support 1. In particular, the thermoforming station 308 provides for the presence of an upper tool and a lower concave mold placed inferiorly with respect to the sheet material 200, movable with respect to each other and configured for being arranged at least in a spaced condition, at which the upper tool and the lower concave mold allow the introduction of the sheet material 200 into the thermoforming station 308, and at least an approached closed condition, at which the upper tool and the lower mold define a fluid-tight chamber. During the approached closed condition, the lower concave mold provides for the suction of air in order to define a pressure lower than atmospheric pressure and consequently allow the sheet material 200, adequately heated, to adhere to the walls of said mold, obtaining the desired shape. At the outlet of said thermoforming station 308, a plurality of thermoformed supports 1 joined together is thus obtained, arranged on the sheet material 200 according to a predetermined desired shape. In the case of a flat support 1 (not shown in the accompanying figures), the packaging apparatus 300 does not include said thermoforming station 308.

Subsequently to the thermoforming station 308 and/or to the first supplying group 301 with respect to the advancement path A of the sheet material 200, the apparatus 300 comprises (in the first embodiment thereof) a printing station 305 of the not heat-sealing material 222*a* on the sheet material 200. The printing station 305 may for example comprise a printing station configured for applying on the sheet material at least one selected from the group among the following materials:

- wax, for example synthetic wax, petroleum-derived wax, mineral wax;
- plastic, for example high melting point thermoplastic resins, such as for example polyesters (particularly PET), polyamides or PP homopolymer or resins chemically incompatible with the sealing layer of the closing film (for example wherein the sealing material is polyethylene and the coating layer is made of PETg) or thermosetting resins;
- smooth or embossed paper;
- ink or paint;
- metals, for example aluminum.

Figure 24:
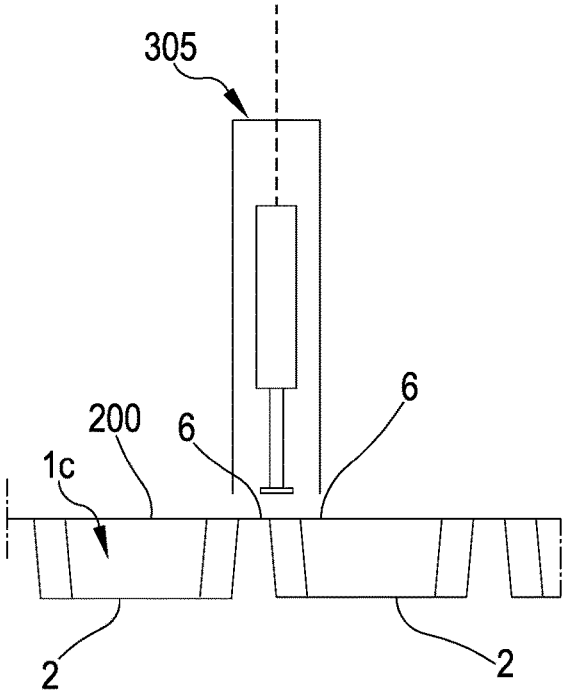
Figure 24A:
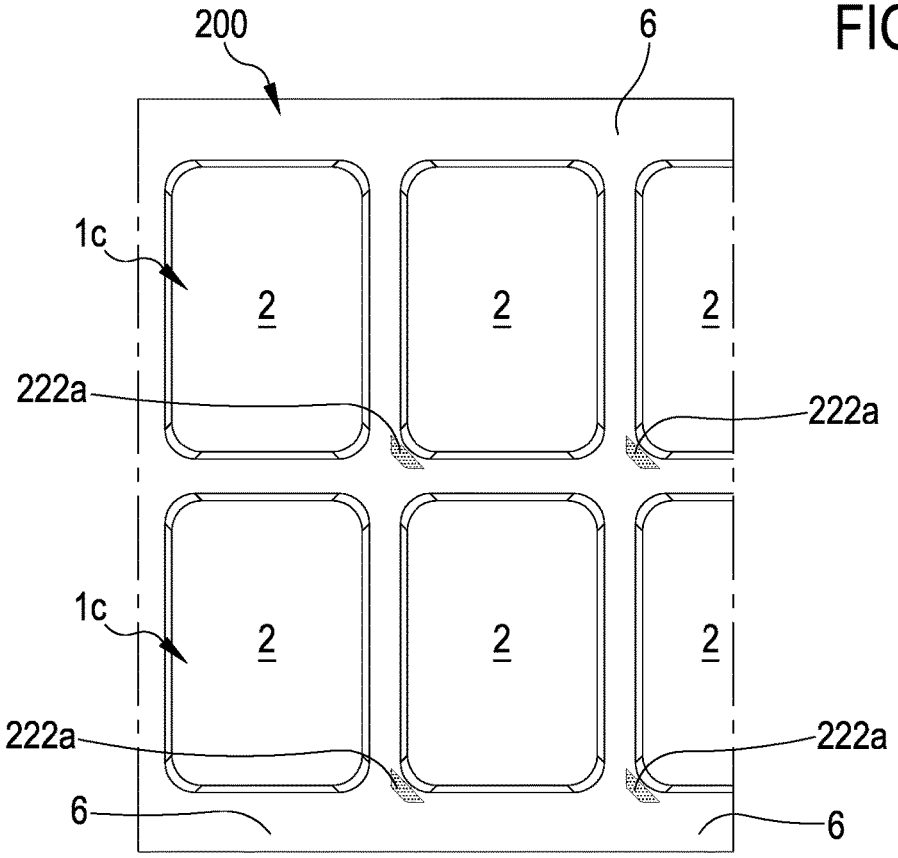

Downstream of the printing station 305, the apparatus 300 comprises at least one notching station 306, shown in FIGS. 21 and 24, configured for notching the thermoformed sheet material 200, in particular for defining on the precursor body the first and second semifinished portions 221 and 222 respectively configured for defining the removable portion 21 and the gripping portion 22 of the package. Optionally, the notching station 306 is configured for defining the weakening portion 25. The notch made by the notching station 306 may be through the sheet material 200 or may represent a reduction in the thickness of the sheet material 200 itself. The notch may be made using a cutting tool or a high intensity concentrated beam of the laser type.

In any case, the possibility of arranging the notching station 306 upstream of the printing station 305 in such a way that the apparatus can first form the first and second semifinished portion 221, 222 and subsequently carry out the application of the not heat-sealing material 222*a* on the second semifinished portion 222 is not excluded.

The apparatus 300 further comprises a positioning station 304, shown in FIGS. 21 and 26, configured for housing one or more products P on the semifinished supports 1*c*, in particular at the base 2 of said supports 1*c*. The positioning station 304 is configured for delivering the product P according to the position of the supports 1*c* of the film material 200.

Figure 27:
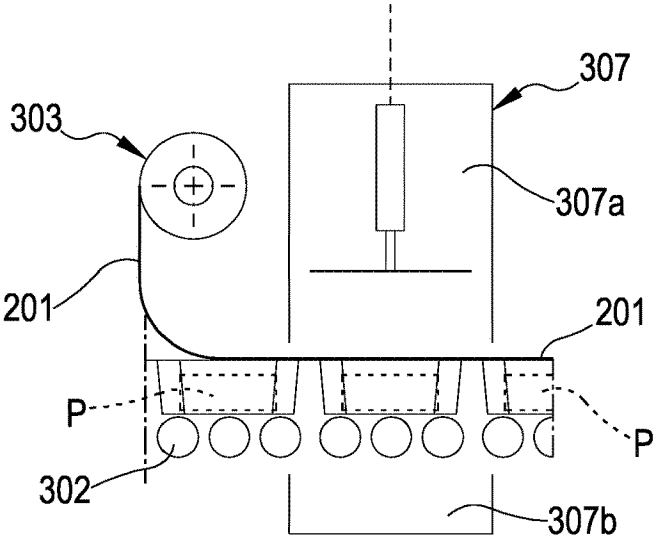

Subsequent to the positioning station 304 with respect to the advancement path A of the sheet material 200, the apparatus 300 comprises a second supplying assembly 303 shown in FIGS. 21 and 27, configured for supplying the closing film 201 and disposing it at the sheet material 200. The second supplying assembly 303 provides that the closing film 201 is wound on a reel movable by rotation, in particular said reel can be: a) moved by an electric motor, b) braked, c) free in rotation.

Downstream of the second supplying assembly 303 with respect to the advancement path A of the sheet material 200, the apparatus 300 comprises a packaging station 307, shown in FIGS. 21 and 27, configured for receiving the sheet material 200 on which one or more products P and at least a portion of said closing film 201 are housed. Said packaging station 307 is configured for fluid-tightly engaging the closing film 201 to the sheet material 200, in particular at least to the edge 6 of each semifinished support 1*c*. In order to ensure said fluid-tight engagement, the packaging station 307 comprises an upper tool 307*a* having a heater of the closing film 201 and a lower tool 307*b* configured for receiving one or more semifinished supports 1*c*. The upper tool 307*a* is configured for making a heat-sealing of the closing film 201 on the sheet material 200, so as to define the housing compartment 5 for the product P. In more detail, the upper and lower tool 307*a*, 307*b* are movable relative to one another between at least one spaced condition, at which the lower tool and the upper tool 307*a*, 307*b* allow the input in the packaging station 307 of the closing film 201 and of the sheet material 200, and at least one approached closed condition, at which the lower and upper tool 307*a*, 307*b* define a fluid-tight chamber.

As described above, due to the presence of the not heat sealable material 222*a*, the packaging station is capable of sealing the closing film 201 to the edge 6, optionally to the base 2 and to the first semifinished portion 221: the closing film 201 is not capable of sealing to the second semifinished portion due to the presence of the material 222*a*.

The packaging station 307 may be provided with a suction system configured for removing air from the inside of the packaging station 307 itself so as to define a pressure lower than atmospheric pressure. In a further embodiment, the packaging station 307 is configured for removing air from the housing compartment 5 when the closing film 201 is fluid-tightly engaged to the sheet material 200. Optionally, the packaging station 307 may be provided with a blowing system configured for injecting gas into the packaging station 307 in order to obtain a modified atmosphere environment. The packaging station 307 optionally includes a heater of the closing film 201 so as to facilitate the correct distribution of the closing film 201 around the product P.

Figure 27A:
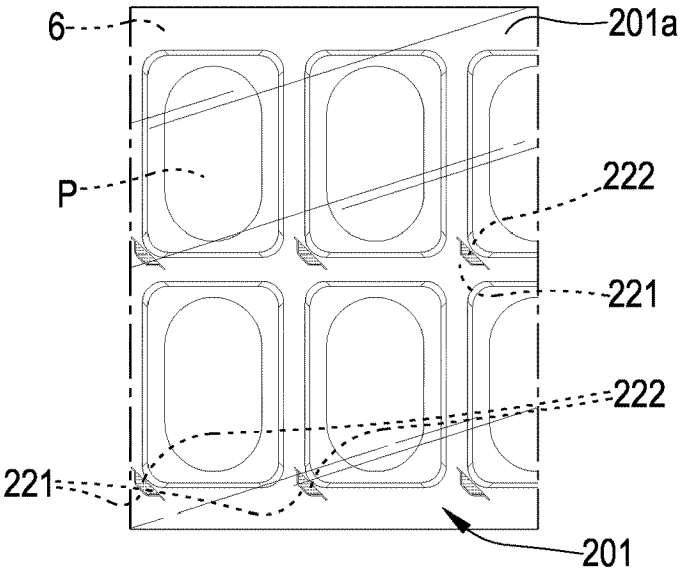

FIG. 27A schematically shows the plurality of semifinished supports 1 coming out of the packaging station 307, comprising the thermoformed sheet material 200, one or more products P, the notch defined by the notching station 305 and the closing film 201 fluid-tightly engaged to the sheet material 200.

Figure 28:
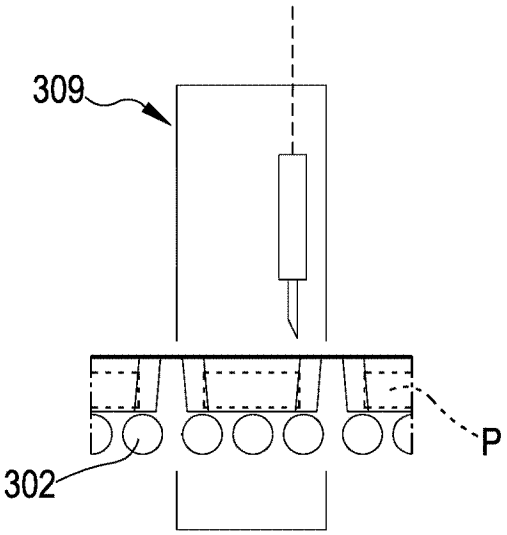
Figure 28A:
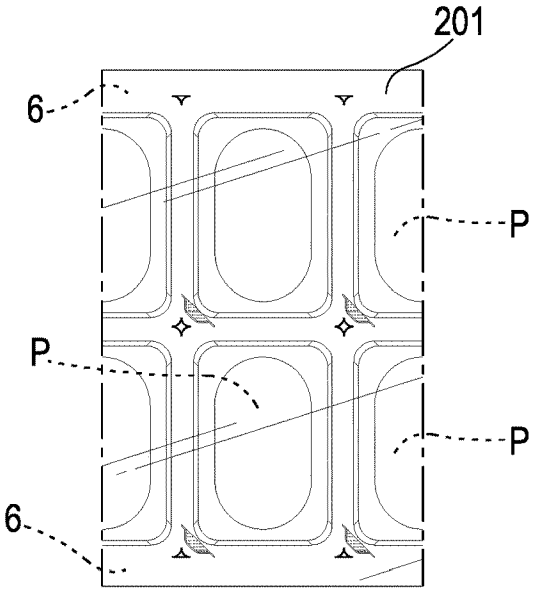

Downstream of the packaging station 307 with respect to the advancement path A of the sheet material 200, the apparatus 300 comprises a pre-cutting station 309, shown in FIGS. 21 and 28, configured for making a plurality of cuts through the sheet material 200 and the closing film 201, so as to join each support 1 at the angular portions; in the event that the removable portion 21 is defined at an angular portion 11, the pre-cutting station 309 is adapted to join at least one outer part of the removable portion 21. Said through cuts are made by using a punch having a cutting portion having a predetermined shape. Alternatively, said through cuts are made by means of a cutting tool, a rotating blade or a high intensity concentrated beam of the laser type.

Downstream of the pre-cutting station 309 with respect to the advancement path A of the sheet material 200, the apparatus 300 comprises at least one cutting station 310, shown in FIGS. 21 and 29, configured for defining a through cut of the sheet material 200 and closing film 201 for forming said packages 100. Said through cuts are made at the edges of the supports 1, so as to define the perimetral edge 6, using one or more rotating blades. In a further embodiment, said cutting station 310 can replace the pre-cutting station 309 providing the same through cutting operations to define the removable portion 21, the gripping portion 22, as well as the plurality of angular portions 11. In a further embodiment, the cutting operations carried out at the cutting station 310 are performed by means of a punching machine or by using a high intensity concentrated laser light beam.

Figure 32:
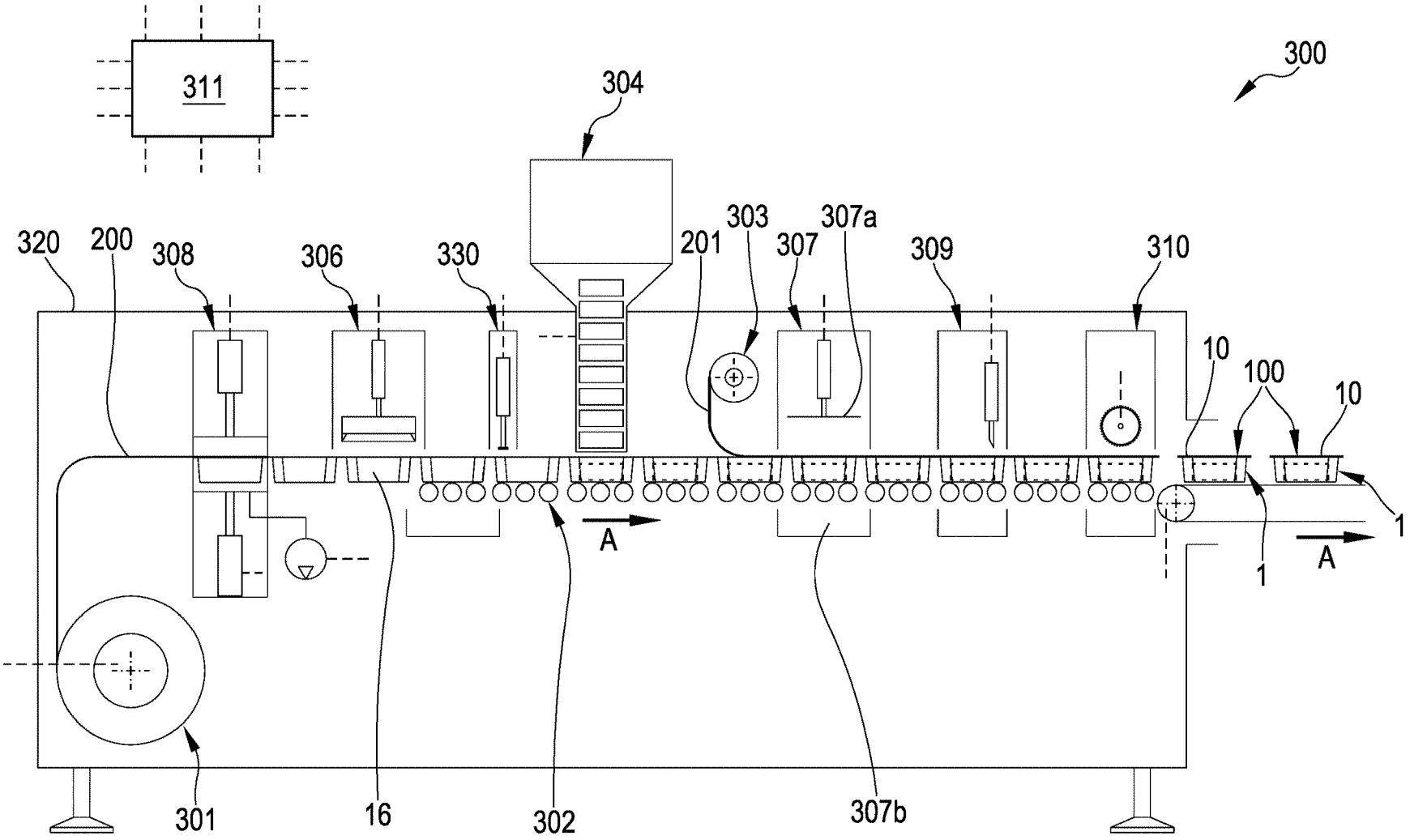
FIG. 32 is a schematic view of a further packaging apparatus for making a package according to the present invention.
Figure 33:
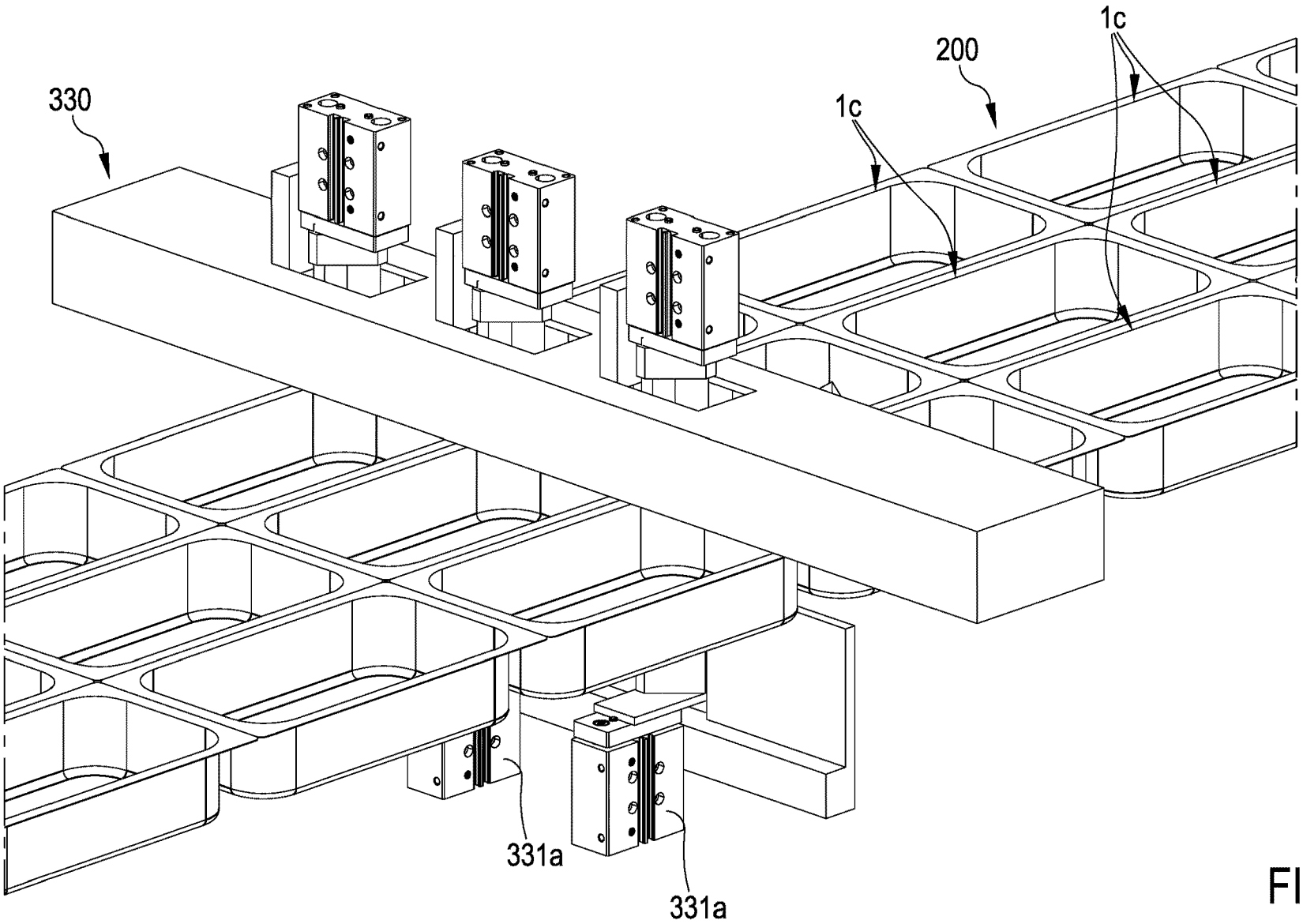
FIGS. 33 and 34 schematically show folding stations, according to a first embodiment, of the apparatus according to the present invention.
Figure 34:
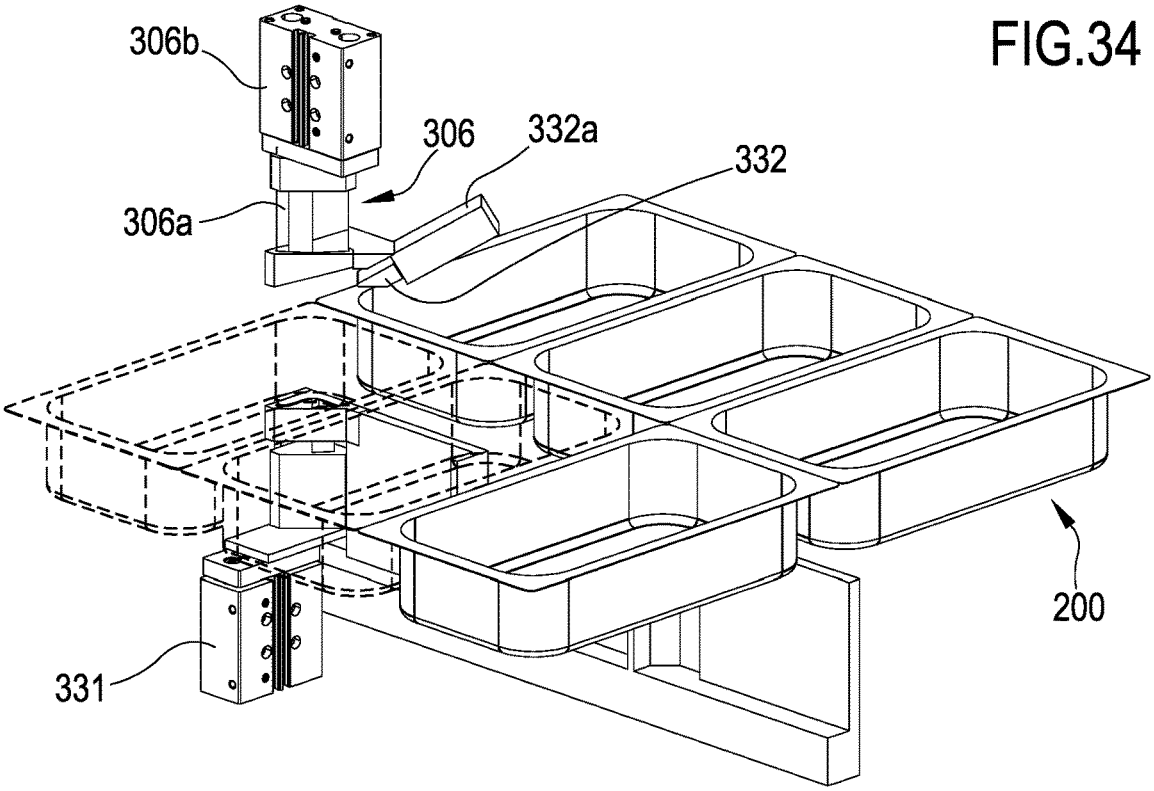
Figure 35:
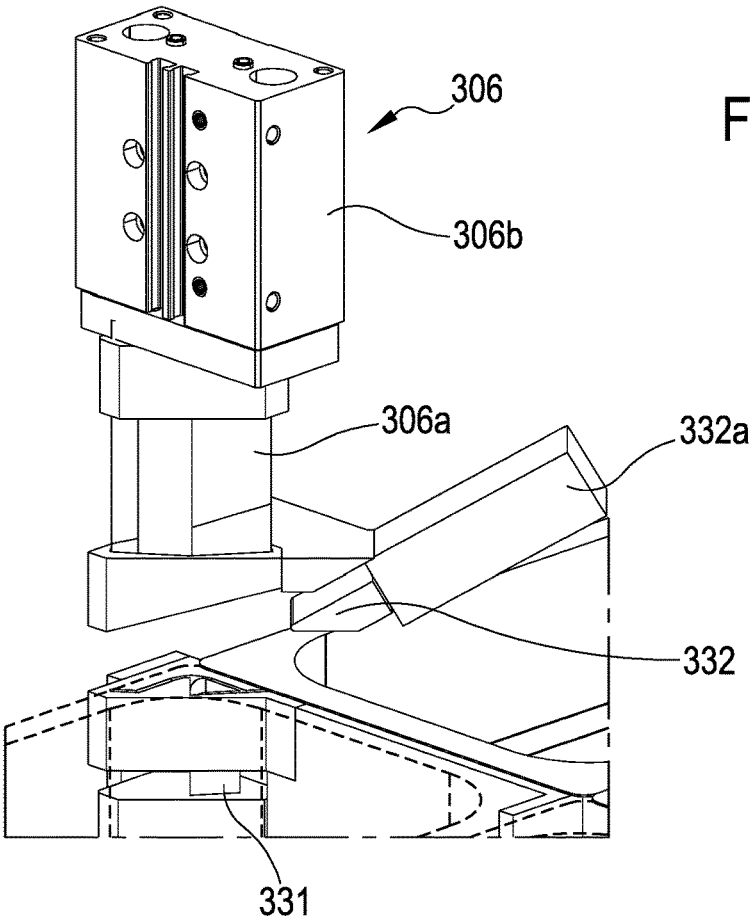
FIGS. 35 to 41 are detailed views of a folding station, according to the first embodiment, illustrated in different operating conditions.
Figure 37:
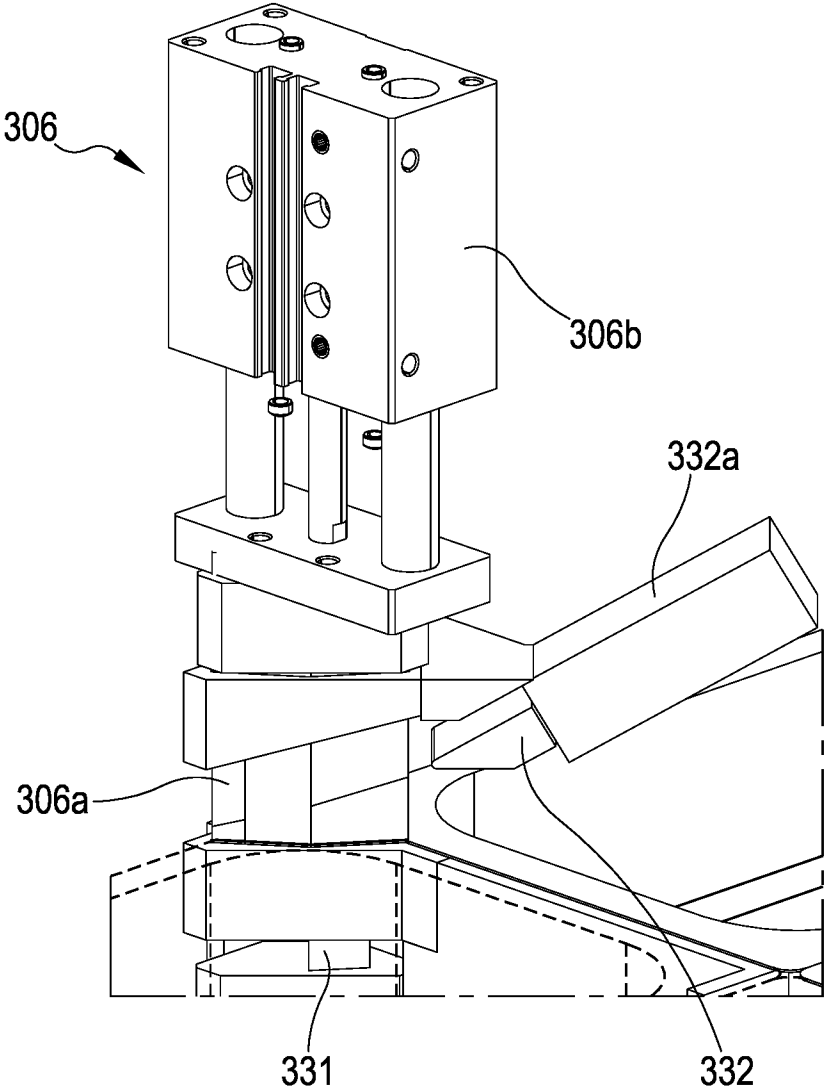
Figure 36:
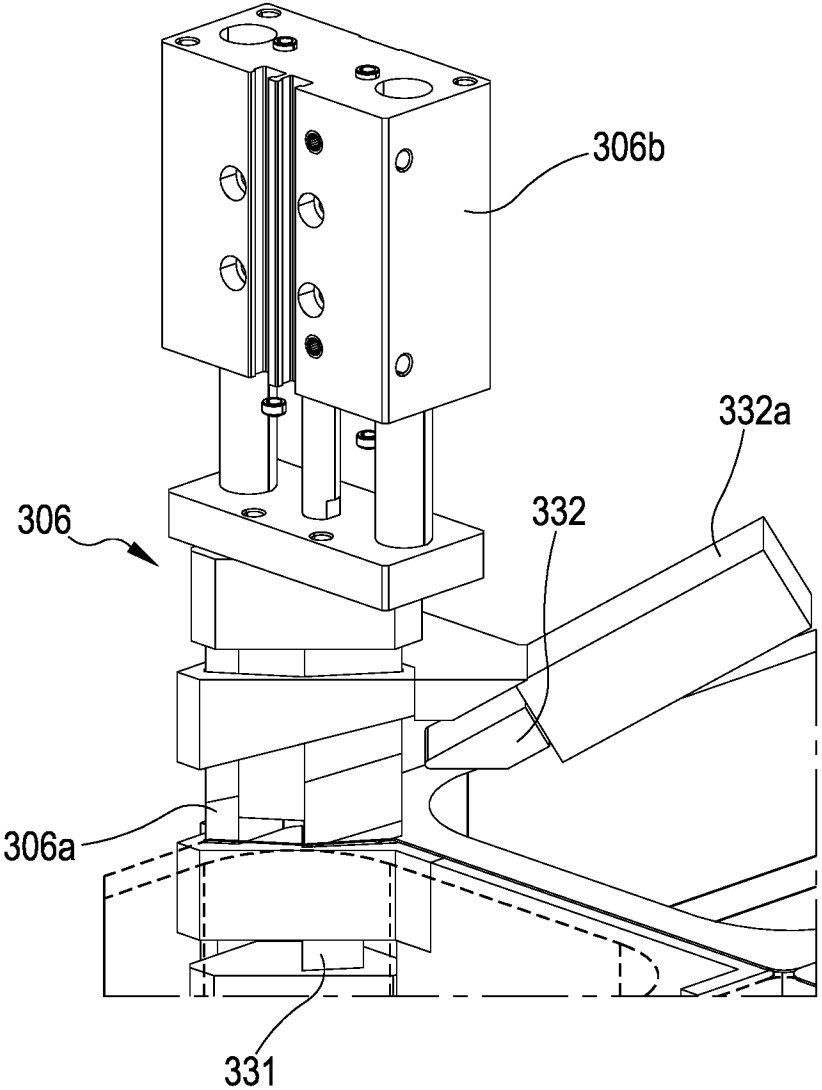
Figure 39:
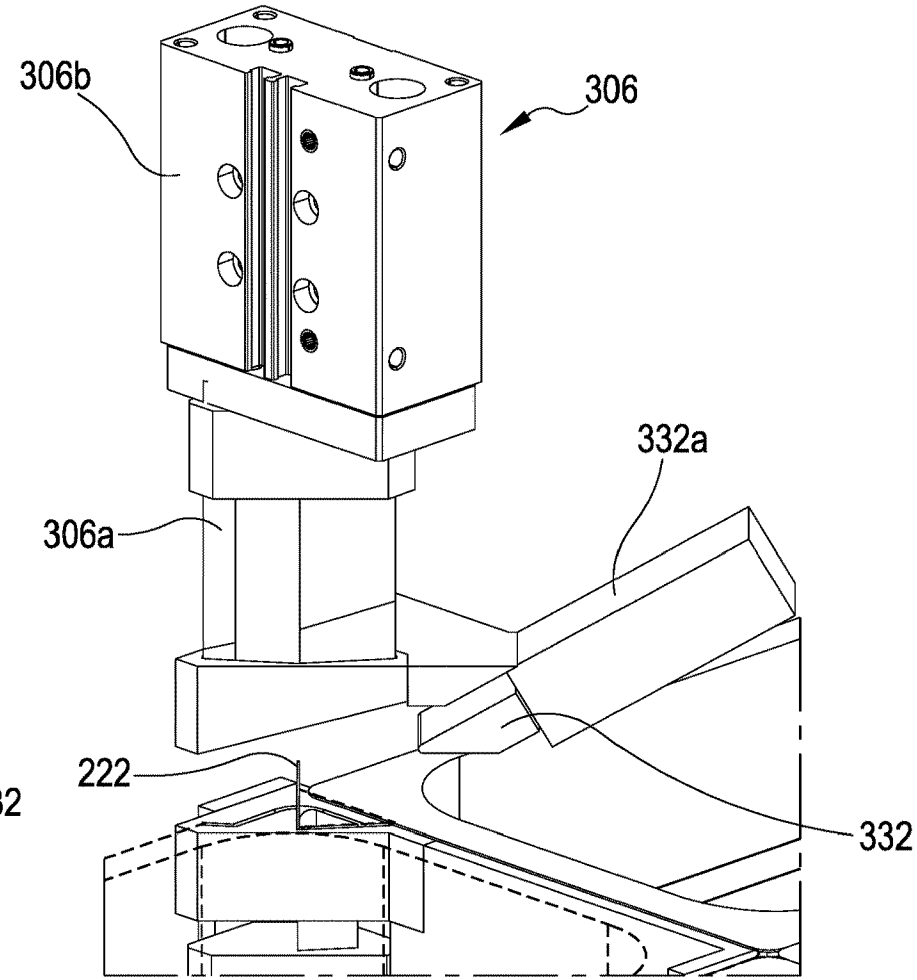
Figure 38:
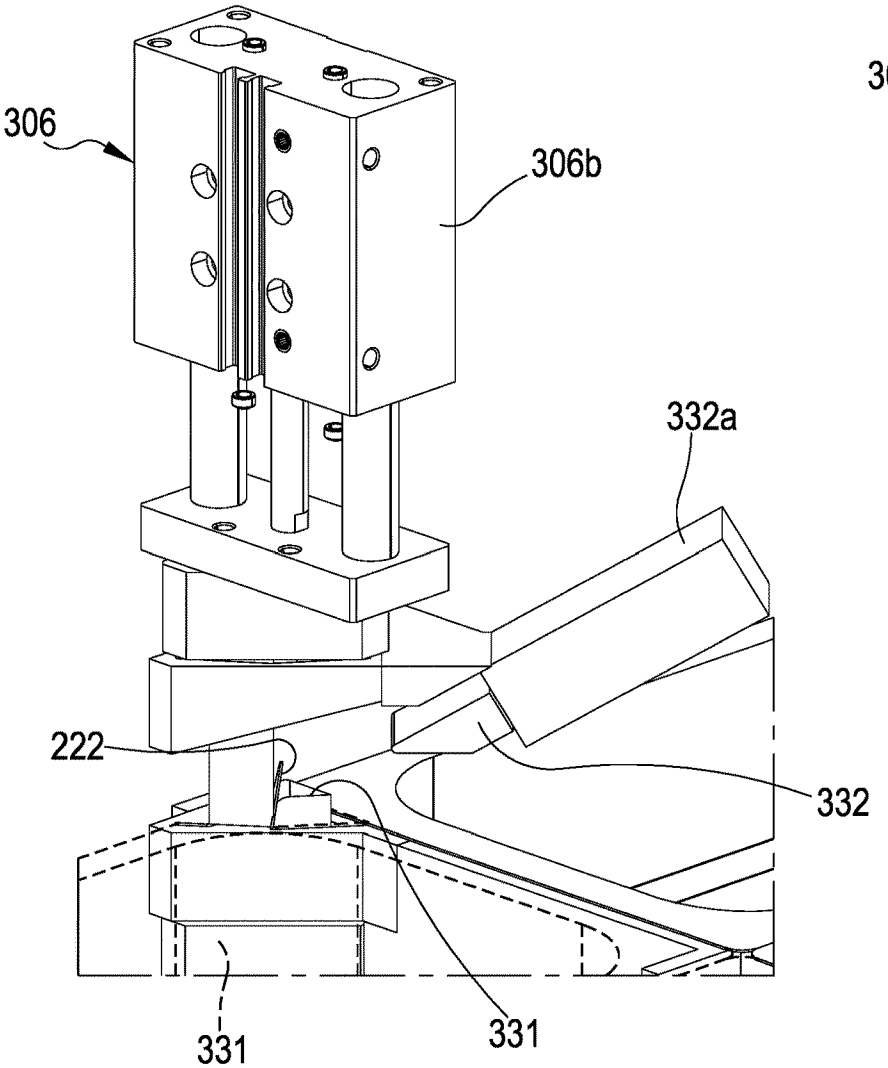
Figure 41:
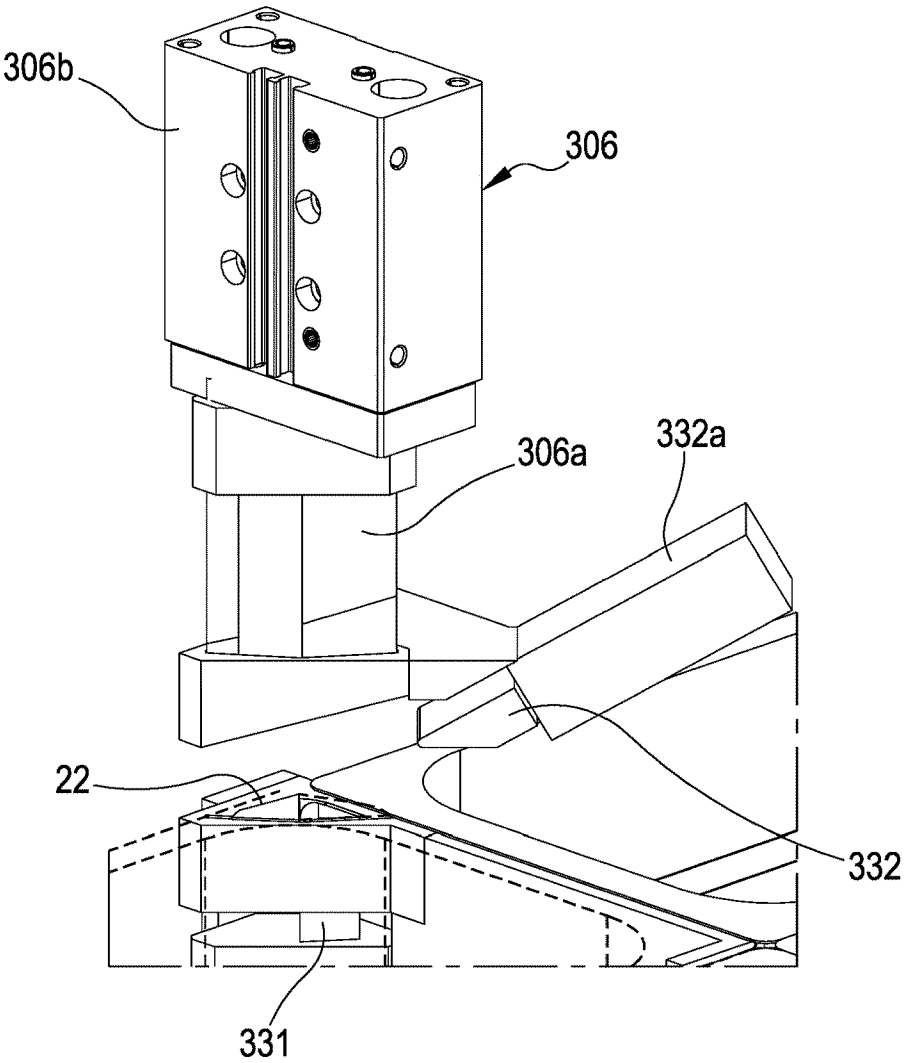

In a second embodiment of the apparatus illustrated for example in FIG. 32, the apparatus 300 comprises the supplying unit 301, optionally the forming station 308, the notching station 306, the positioning station 304, the packaging station 307, the pre-cutting station 309 and the cutting station 310 and the second supplying unit 303 as described above for the first embodiment; in the second embodiment, the apparatus comprises, in replacement of the printing station 305, a folding station 330 of the sheet material 200, placed upstream of the packaging station 307 with respect to the advancement path A of the sheet material 200, and configured for folding the second semifinished portion 222 for defining the gripping portion 22; in particular, the folding station 330 is configured for folding the second semifinished portion 222 in such a way that each of said semifinished supports 1*c* can have a gripping portion having a not heat-sealable surface adapted to receive the closing film 201 in abutment, preventing such a film portion from being welded on the sheet material 200, in particular on said supports 1*c*.

The folding station 330 may be distinguished from the cutting portion 306 and be disposed in interposition between the latter and the packaging station 307; FIG. 32 shows a folding station 330 distinct from the notching station 306, while in FIGS. 33 to 49, the notching station 306 and the folding station 330 are integrated to define a single station; in this configuration, the notching station 306 and the folding station 330 are configured for acting substantially simultaneously on the sheet material 200 for defining said gripping portion 22.

The folding station 330 comprises at least one pusher 331 configured for moving relative to the sheet material 200 at least between:

- a retracted position in which the pusher 331 faces the second semifinished portion 222, and
- an advanced position in which the pusher 331 is configured for contacting said second semifinished portion 222 to lift it transversely with respect to the first semifinished portion 221.

In detail, the pusher 331, in the retracted position, is placed, in the conditions of use of the apparatus 300, below and distanced from the sheet material 200. The pusher 331, in the retracted position, is in particular configured for being spaced from the second not heat-sealable surface of the second semifinished portion 222. The pusher 331 in the retracted position is illustrated, for example, in FIGS. 34-37, while the pusher 331 in the advanced position is illustrated, for example, in FIGS. 38 and 46. In the advanced position, the pusher 331 emerges from the sheet material 200, beyond the first heat-sealable surface defined on the edge portion of the sheet material 200 adapted to receive the closing film.

The pusher 331, after raising from the second semifinished portion 222, is configured for returning to the retracted position (FIGS. 39 and 47), leaving the second semifinished portion 222 raised.

The pusher is moved by a first actuator 331*a* which is configured for moving the pusher 331 from the retracted position to the advanced position, and vice versa. The first actuator 331*a* may be of the pneumatic, electrical, electromechanical type.

Figure 40:
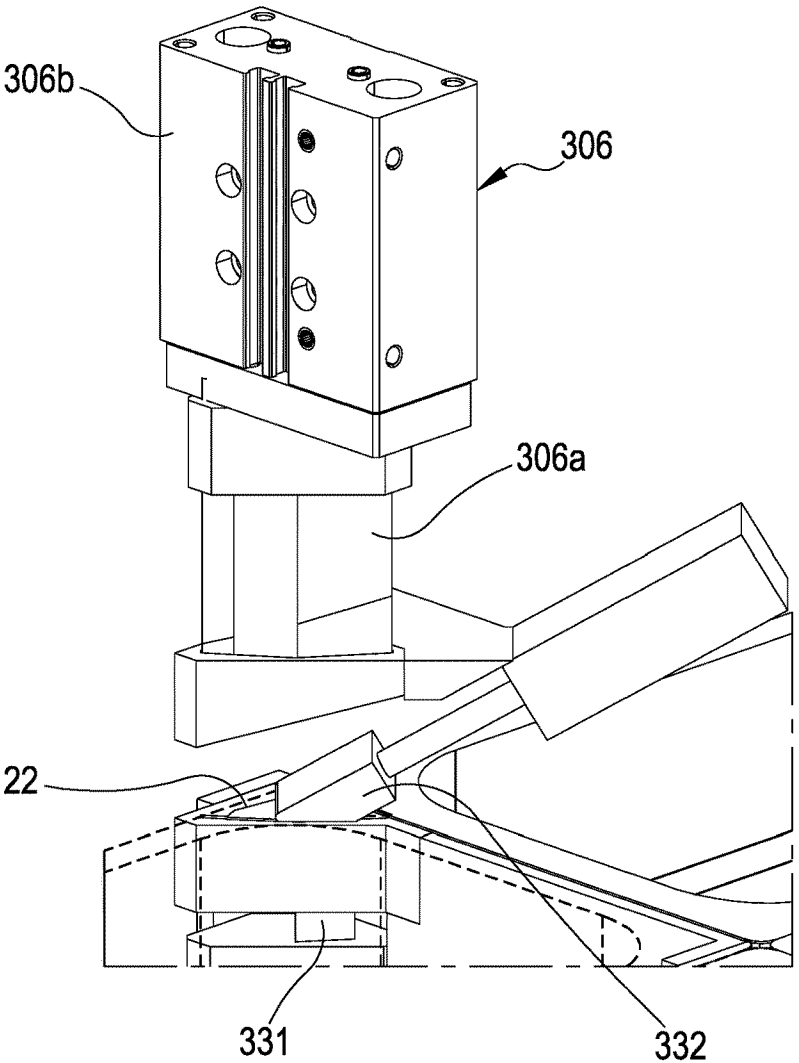
Figure 42:
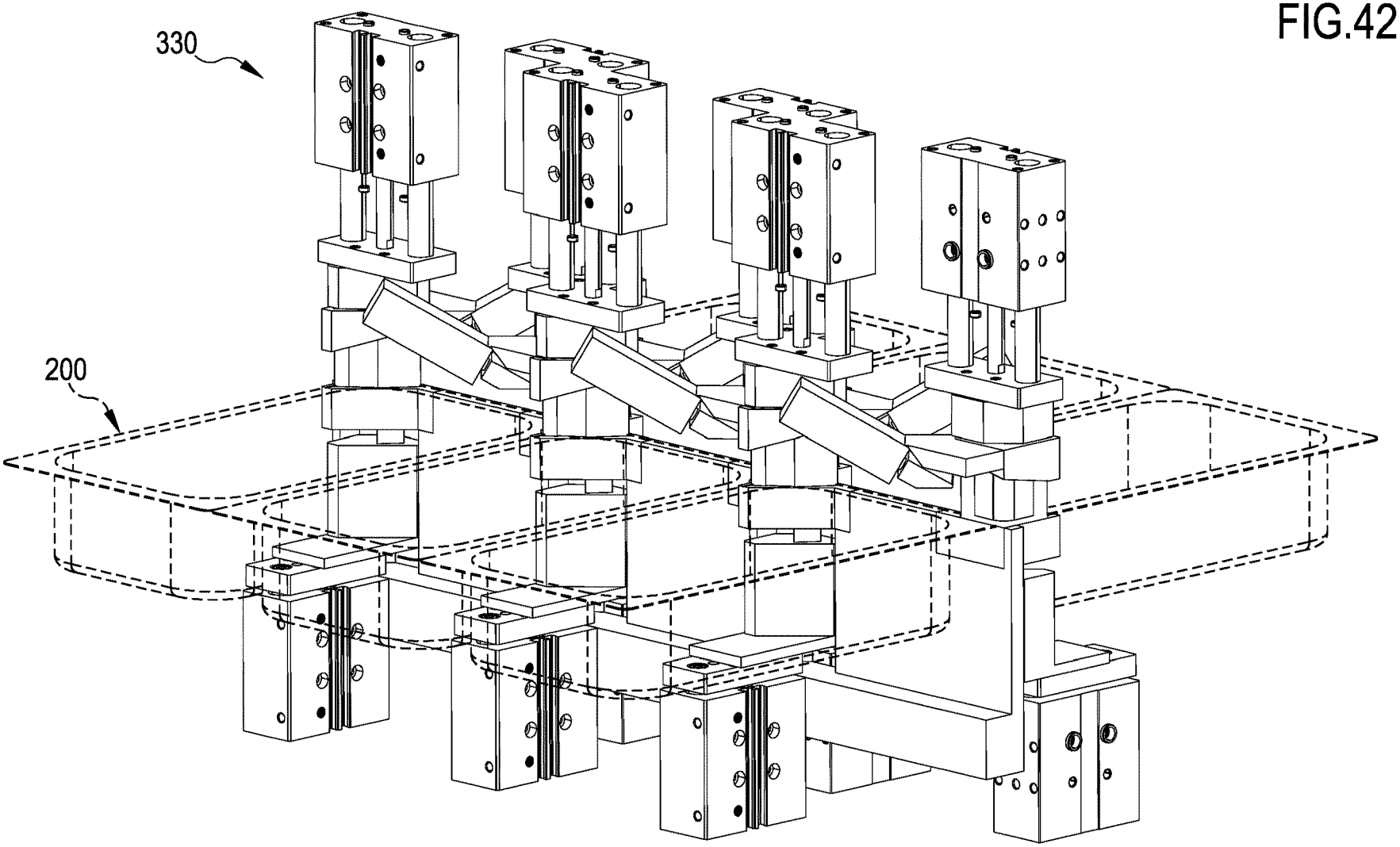
FIG. 42 is a schematic representation of an apparatus according to the invention comprising a plurality of folding stations.
Figure 43:
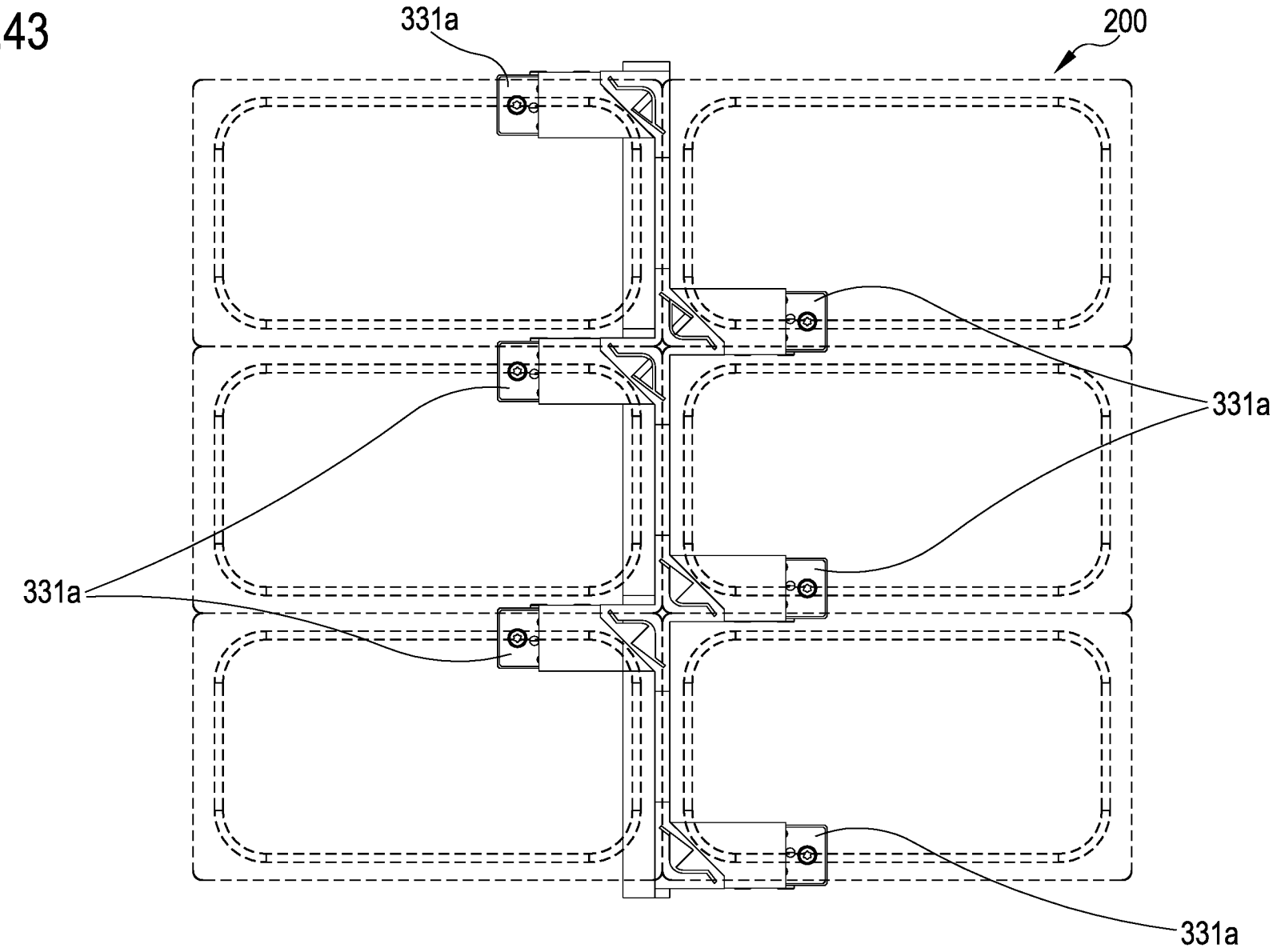
FIG. 43 is a top view of a sheet material placed at a plurality of folding stations.
Figure 44:
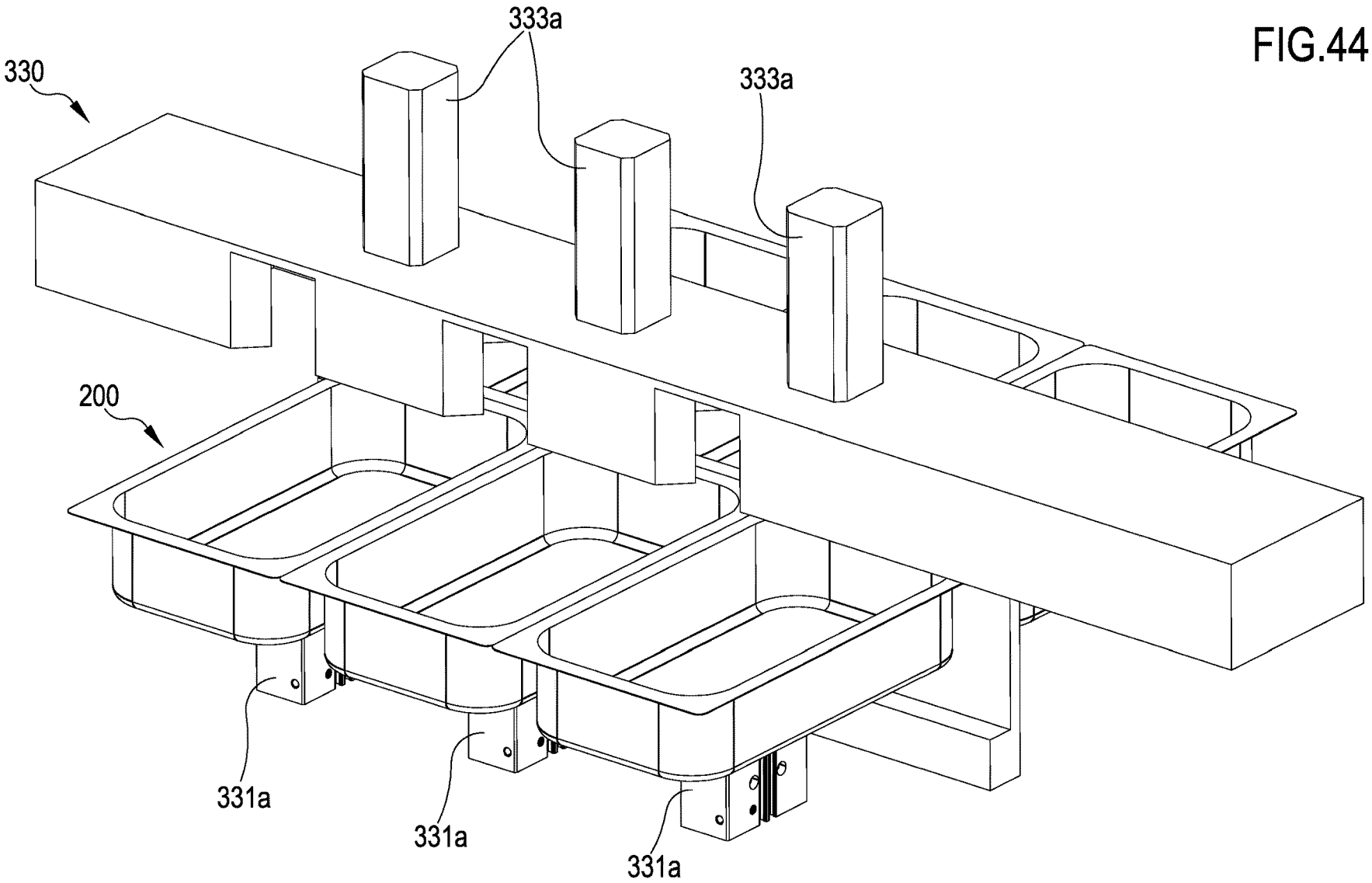
FIG. 44 is a schematic view of folding stations, according to an embodiment, of the apparatus according to the present invention.
Figure 45:
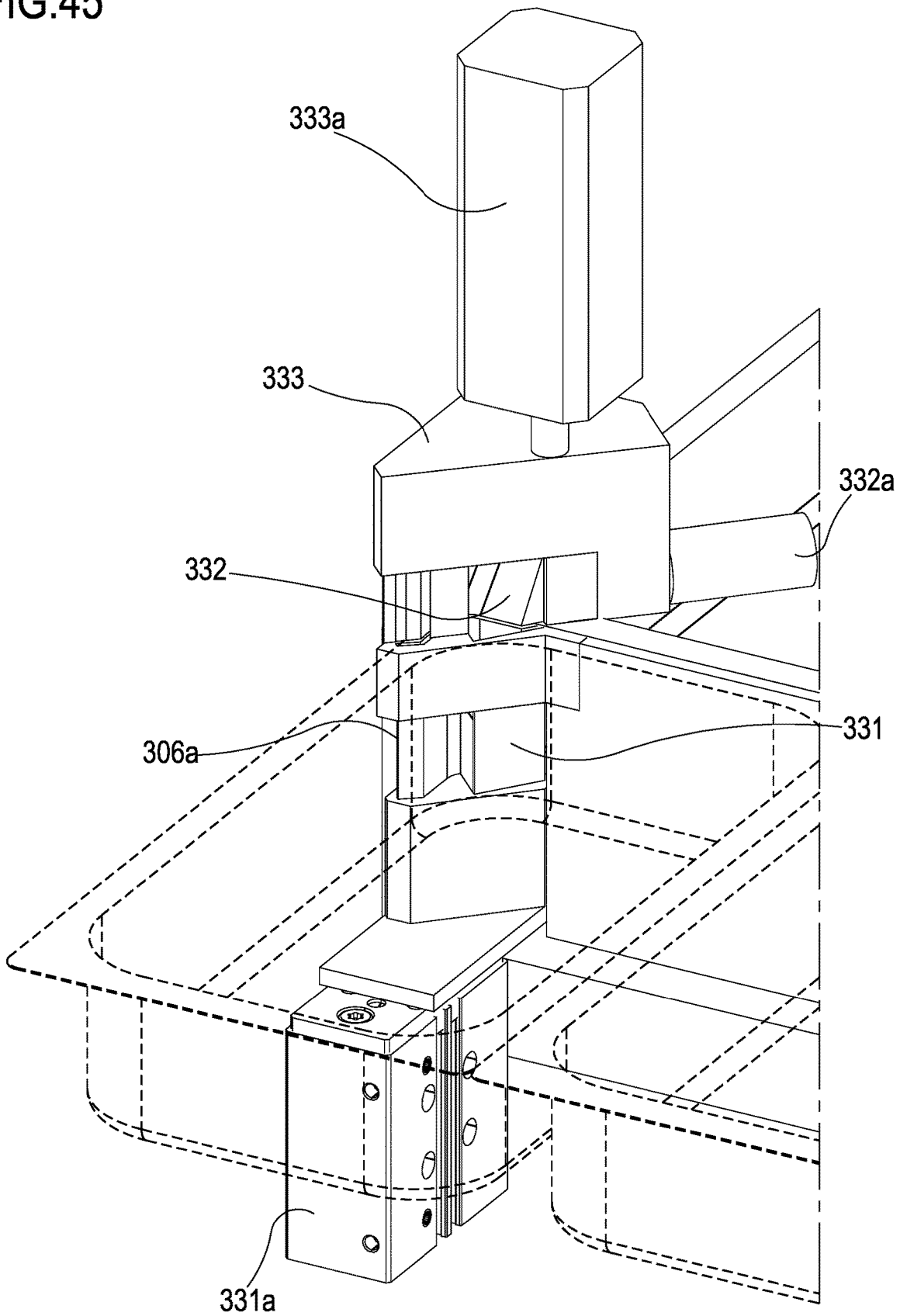
FIGS. 45 to 49 are detailed views of a folding station, according to the second embodiment, illustrated in different operating conditions.
Figure 47:
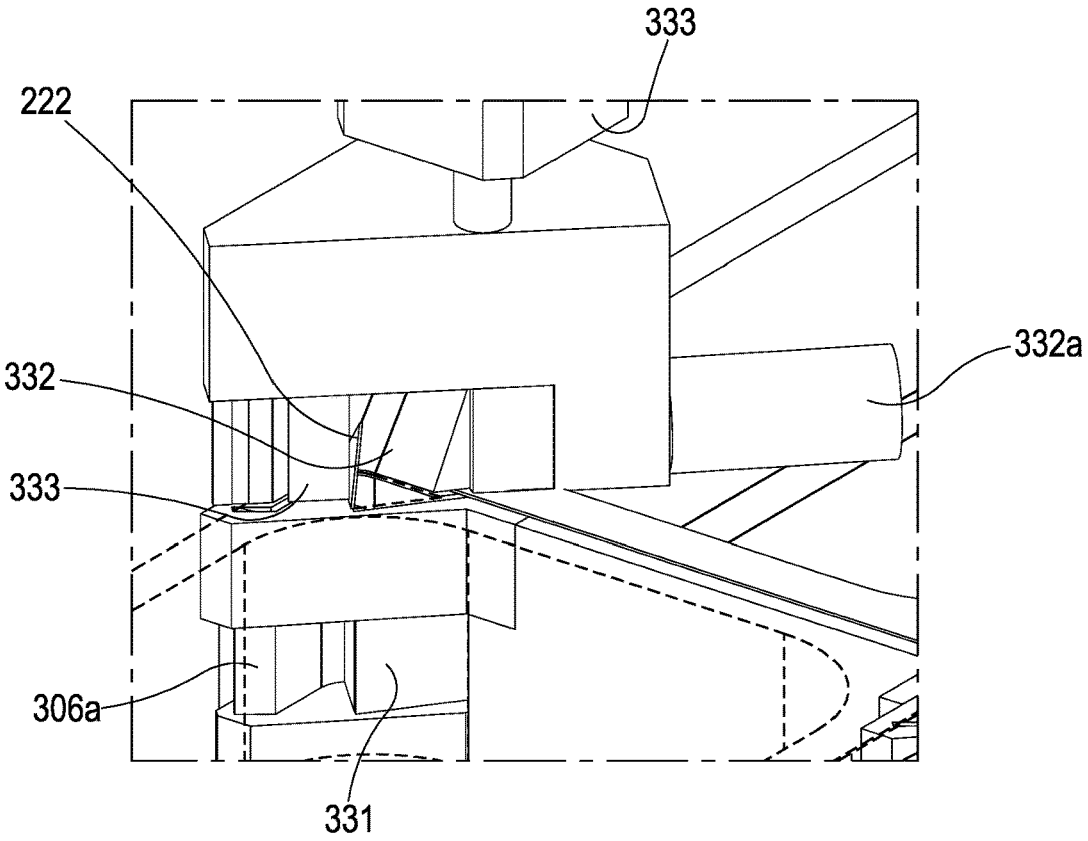
Figure 48:
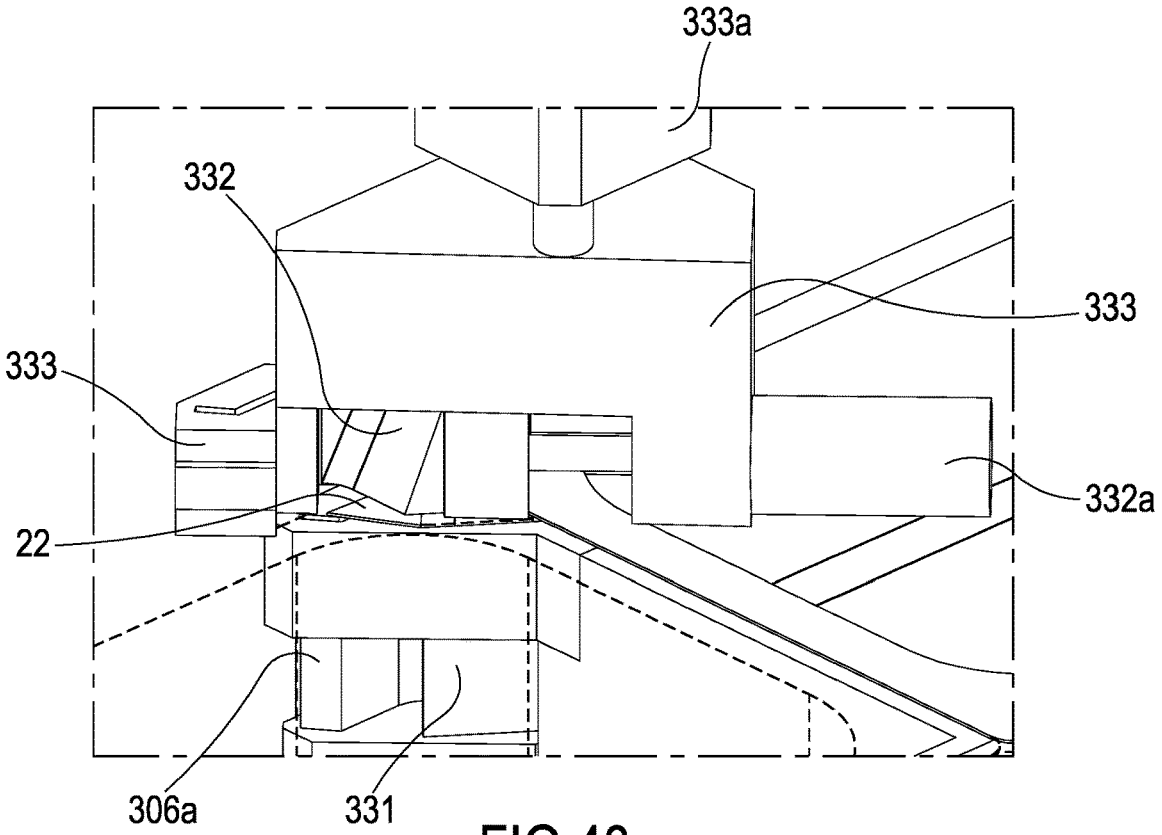
Figure 49:
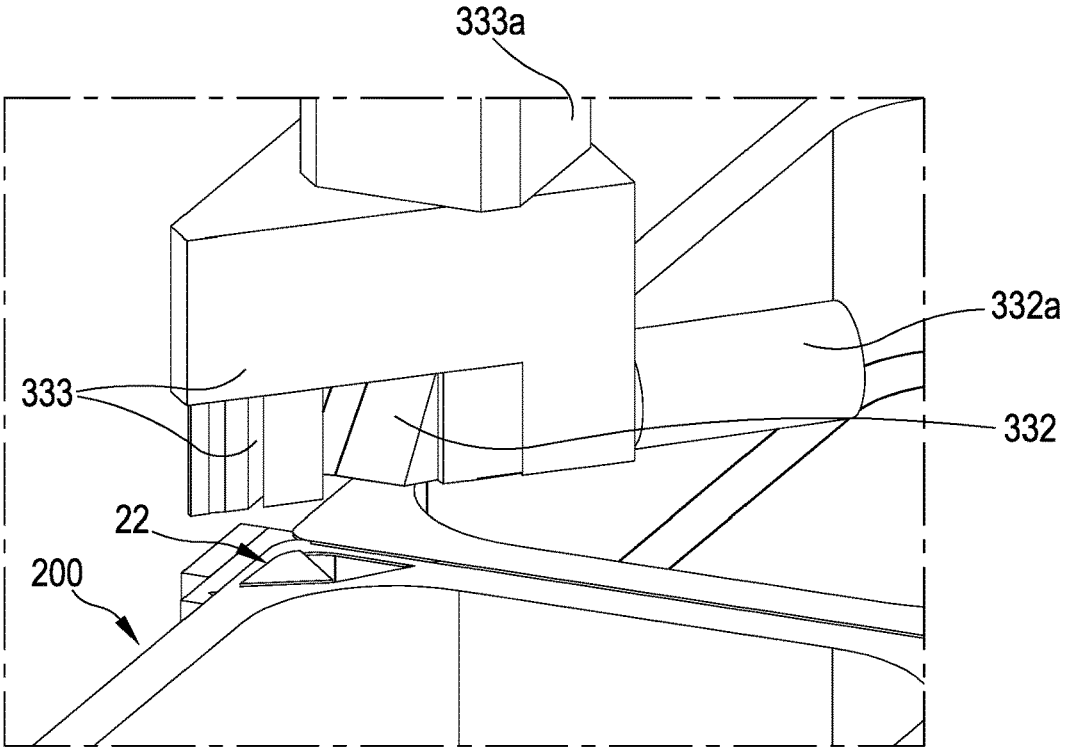

The folding station 330 is also provided with a pressure member 332 configured for disposing itself, at least in the retracted position of the pusher 331, opposed to the pusher 331 with respect to the sheet material 200. In fact, in the embodiment, shown in FIGS. 35-49, the pressure member 332 is placed, in conditions of use of the apparatus 300, above the sheet material 200 (while the pusher 331 is placed underneath the sheet material 200 and configured for contacting the second semifinished portion 222 from below. In detail, the pressure member 332 is configured for contacting the second semifinished portion 222, raised by the pusher 331, for folding it above a portion of a perimetral edge of the sheet material 200 so as to define said gripping portion 22; in detail, the pressure member 332 is configured for contacting the second semifinished portion 222 at the second not heat-sealable surface and for generating a thrust adapted to crush the second semifinished portion on the perimetral edge of the sheet material 200. The pressure member 332 is configured for moving, in conditions of use of the apparatus, relative to the sheet material (200) at least between:

- a starting position in which the pressure member 332 is configured for disposing itself at a distance from the second semifinished portion 222 raised by the pusher 331 (see for example FIGS. 35-39, 45-47), an intermediate position in which the pressure member 332 intercepts said second semifinished portion 222 raised by the pusher 331, a crushing position in which the pressure member 332 completely folds said second semifinished portion 222 above said portion of a perimetral edge of the sheet material 200 so as to define said gripping portion 22 (see, for example, FIGS. 40 and 48).

The pressure member 332 is moved by a second actuator 332*a* configured for moving said pressure member 332 from the starting position to the crushing position, and vice versa. The second actuator 332*a* may be of the pneumatic, electrical, electromechanical type.

The apparatus 300 may comprise a control unit 311 connected to the first and second actuators 331*a*, 332*a* and configured for:

controlling the first actuator 331*a* to define the retracted position and the advanced position of the pusher 331, controlling the second actuator 332*a* to define the starting position and the crushing position of the pressure member 332, synchronizing the actuation of said first and second actuators 331*a*, 332*a* to allow the pusher 331 to lift the second semifinished portion 222 and, only subsequently, allow the pressure member 332 to crush said second raised semifinished portion 222 to define said gripping portion 22.

In particular, the control unit 311 is configured for controlling the advanced position of the pusher 331 and at the same time controlling the starting position of the pressure member 332; the control unit 311 is configured for sequentially controlling the advanced position of the pusher 331 and the retracted position such that immediately after raising the second semifinished portion 222, the pusher can release said second portion and move away: only after having raised the second semifinished portion 222 and controlled the retracted position of the pusher 331, the control unit 311 is configured for controlling the crushing position of the pressure member 332 so as to define said gripping portion 22. At the end of the forming step of the gripping portion 22, the pressure member 332 is returned to the starting position: the pusher 331 is instead in the retracted position.

The folding station 330 may comprise a counter-thrust tool 333 configured for disposing itself against the pusher 331 with respect to the sheet material 200; in particular, the counter-thrust tool 333 is configured for disposing itself on the same side of the sheet material 200 on which the pressure member 332 is disposed, opposite to the pusher 331. The counter-thrust tool 333 is configured for resting on an edge portion of the sheet material 200 placed next to the second semifinished portion 222 for keeping said sheet material 200 in a predetermined position at least during the passage of the pusher 331 from the retracted position to advanced position. In fact, the counter-thrust tool 333 defines an abutment element of the sheet material adapted to prevent undesired displacements (lifting) of the sheet material during the action of the pusher 331 (lifting) on the second semifinished portion 222.

Figure 46:
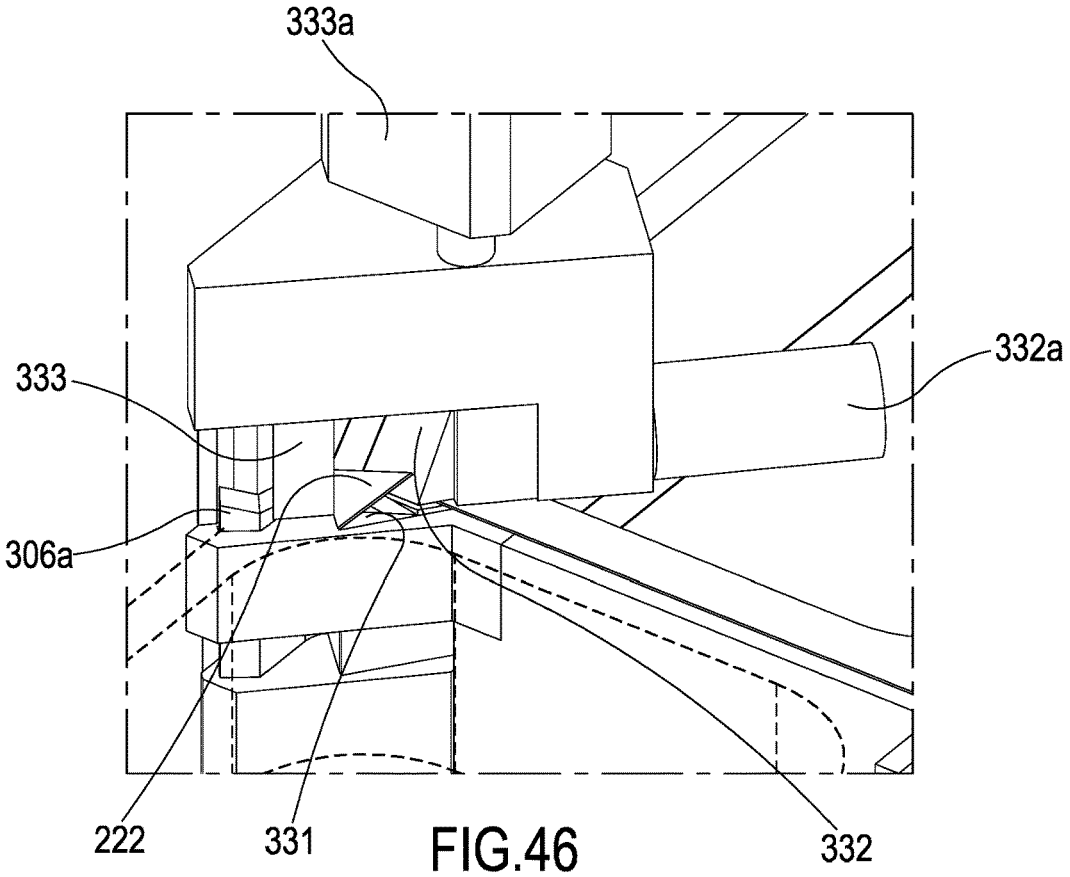

The counter-thrust tool 333 is also configured for moving relative to the sheet material 200 at least between two different positions, in particular at least between:

a distanced position in which the counter-thrust tool 333 is distanced from the sheet material 200 (see FIG. 49), and an abutment position in which the counter-thrust tool 333 is resting on the first surface of the edge portion of the sheet material 200 (see for example FIGS. 46-48).

The counter-thrust tool 333 is configured for being placed in the abutment position when the pusher 331 is still in the retracted position or in any case before said pusher contacts the second semifinished portion 222; the pusher 331 is then brought by the first actuator 331*a* to the advanced position only when the counter-thrust tool 333 is in the abutment position.

As regards instead the pressure member 332, the latter is configured for moving from the starting position to the crushing position during the distanced position of the counter-thrust tool 333. In fact, as a result of lifting of the second semifinished portion 222, the pusher and the counter-thrust tool are configured for distancing themselves from the sheet material so as to allow the pressure member to act on the raised second semifinished portion.

The counter-thrust tool 333 is movable by means of a third actuator 333*a*, distinct from the first and second actuators, configured for controlling the distanced and abutment position. The third actuator 333*a* may be of the pneumatic, electrical or electromechanical type. The control unit 311 is further connected to said third actuator 333*a* and configured for controlling the distanced and abutment position of the counter-thrust tool 333; in particular, the control unit 311 is configured for synchronizing the actuation of said third actuator 333 with the actuation of said first and second actuators 331*a*, 332*a* to allow the pusher 331 to raise the second semifinished portion and, only subsequently, allow the pressure member 332 to crush said raised second semifinished portion for defining said gripping portion 22. In fact, the control unit 311, only after having controlled the abutment position of the counter-thrust tool 333, is configured for controlling the advancement position of the pusher 331; the control unit 311, only after having controlled the distanced position of the pusher 331 is configured for controlling the crushing position of the pressure element 332.

In the embodiment of the folding station 330 illustrated in FIGS. 33-49, the folding station 330 and the notching station 306 are integrated to define a single station; in detail, the notching station 306 comprises a blade 306*a* configured for moving relative to the sheet material 200 at least between:

a retracted position in which the blade 306*a* is distanced from the sheet material (200), and a cutting position wherein said blade 306*a* passes through the sheet material 200 to define said first and second semifinished portions 221, 222.

The blade 306*a* is moved by a respective actuator 306*b*, optionally distinct from the first, second and, if present, the third actuator, described above. The blade 306*a* is actuated when the pusher 331 is in its retracted position and the pressure member is in the starting position. In fact, the blade 306*a* is the first member which is actuated to define the first and second semifinished portions 221, 222; only thereafter, the pusher is actuated to lift the second portion 222 and the pressure member brought into the crushing position to define the second gripping portion 22.

In a first embodiment of the notching station 306 shown in FIGS. 33-42, the blade 306*a* is placed opposed the pusher 331 and the counter-thrust tool 333 with respect to the sheet material 200, in particular adjacent to the pressure member 332: the blade 306*a* is configured for moving towards and away from the pusher 331.

In a second embodiment of the notching station 306 shown in FIGS. 44-49, the blade 306*a* is engaged with the pusher 331 and configured for moving, optionally by translation, relative to the latter; in detail, the blade 306*a* defines a cavity within which the pusher 331 is engaged by sliding.

As described above, the pusher 331 is used for lifting and then deforming the second semifinished portion 222; in an embodiment variant, the pusher 331, or if present the counter-thrust tool 333, may comprise a heating element (for example a resistor integrated in the body of the pusher 331 or in the body of the tool 333) configured for allowing the heating of the sheet material 200 to facilitate the folding (deformation) of the second semifinished portion 222. Moreover, a heating element may be further carried by the pressure member 332 such that the heat can stabilize the folding of the second semifinished portion 222 to define a stable gripping portion 22.

It should be noted that, in the case in which the sheet material 200 exhibits a plurality of semifinished supports 1*c* as shown in FIGS. 33-49 distributed along multiple rows extending along the advancement path A of the sheet material 200, the apparatus 300 may comprise a plurality of folding station 330 (optionally also a plurality of respective notching stations 306) aligned along a transverse direction, optionally orthogonal, to said advancement path A. The apparatus 300 may further comprise a plurality of folding station 330 (optionally also a plurality of respective notching stations 306) aligned along the advancement path A, as illustrated for example in FIG. 42. The folding stations 330 (and the notching stations 306, when integrated with the folding station 330) may be arranged distinctly and spaced from one another along the advancement path A so as to define one or more rows of folding stations configured for operating on a same angle portion of the respective semifinished support 1*c*. Alternatively, the folding stations 330 (optionally the respective notching stations 306, if present) may be placed side by side along the advancement path A and angularly offset by 180° such that said adjacent folding stations may operate on different semifinished supports 1*c* such as for example illustrated in FIG. 42.

As described above, the apparatus 300 may comprise a control unit 311 which may also be connected to the conveyor 302, to the second supplying group 303, to the packaging station 307, to the first notching station 306 and to the cutting station 310, to the printing station 305, optionally to the folding station 330. The control unit 311 is optionally connected to the positioning station 304, to the pre-cutting station 309 and/or to the cutting station 310. Optionally, said control unit 311 is also connected to the first supplying assembly 301.

The control unit 311 is configured for controlling the conveyor 302 to allow movement of the sheet material 200 along the operating path at a predetermined speed, for controlling the supplying assembly 303 adapted to supply the closing film 201, for controlling the packaging station 307 so as to allow engagement of the closing film 201—or closing film portion 201*a*—on the sheet material 200, for controlling the pre-cutting station 309 for defining one or more notches on the closing film, for controlling the cutting station 310 for the formation of the packages 100.

The control unit 311 is therefore configured for synchronizing the performance of the operations carried out by the single operating stations described above and arranged along the production line. Optionally, the control unit 311 is configured for receiving an input signal representative of the correct positioning of the sheet material 200 and/or of the closing film 201 at one or more of said operating stations.

The control unit 311 is further configured for synchronizing the operations of the notching station 305 as a function of at least one parameter representing the relative position between the lower tool and the upper tool 307*a*, 307*b* of the packaging station 307, and/or of a parameter representative of an active condition of the upper tool 307*a* in which the same heats the film portion 201*a* in engagement on the same tool.

FIGS. 30 and 31 show an embodiment variant of the apparatus 300 comprising a supplying station of supports 1 comprising the base 2, the edge 6, the gripping portion 22 and the removable portion 21. The supplying station is located upstream of the packaging station 307.

The apparatus 300 comprises only said supplying station, a conveyor 302 configured for moving the finished supports 1 from the supplying station to the packaging station 307, said packaging station 307, a system for feeding a closing film in the form of a continuous web or discrete film portions and, optionally, a continuous closing film cutting station.

The invention claimed is:

1. Package (100) for containing at least one product (P) comprising:

at least one support (1) exhibiting:

at least one base (2) configured for receiving one or more products (P), at least one perimetral edge (6) surrounding the base (2), at least one removable portion (21) extending as a prolongation of the perimetral edge (6) away from the base (2), a closing film (10) engaged with the perimetral edge (6) and with the removable portion (21), said closing film (10) being configured for defining—cooperatively with the support (1)— a housing compartment (5) for the product (P), a gripping portion (22) emerging from the perimetral edge (6), wherein the removable portion (21) and at least one part of the closing film (10) are configured for being separated from the support (1) during a step of opening the package (100), the package (100) being configured for defining a closed condition wherein:

the closing film (10) and support (1) interdict the access to the housing compartment (5), and the removable portion (21) is aligned with at least one portion (6*a*) of the perimetral edge (6) from which the removable portion (21) extends as a prolongation;

wherein:

the removable portion (21) exhibits a cavity (21*a*) the concavity whereof, at least in the closed condition of the package, faces the perimetral edge (6), the gripping portion (22) is disposed, at least in the closed condition of the package, inside the cavity (21*a*) of the removable portion (21), wherein the gripping surface (22) comprises:

a support portion (22*a*), a coating layer (22*b*) adapted to cover at least partially the support portion (22*a*), said coating layer (22*b*), at least in the closed condition of the package, being interposed between the support portion (22*a*) of the gripping portion (22) and the closing film (10), wherein the coating layer (22*b*) is of a not heat-sealable material configured for preventing the bond, optionally the sealing, of the gripping portion to the closing film (10).

2. Package (100) for containing at least one product (P) comprising:

at least one support (1) exhibiting:

at least one base (2) configured for receiving one or more products (P), at least one perimetral edge (6) surrounding the base (2), at least one removable portion (21) extending as a prolongation of the perimetral edge (6) away from the base (2), a closing film (10) engaged with the perimetral edge (6) and with the removable portion (21), said closing film (10) being configured for defining—cooperatively with the support (1)— a housing compartment (5) for the product (P), a gripping portion (22) emerging from the perimetral edge (6);

wherein the removable portion (21) and at least one part of the closing film (10) are configured for being separated from the support (1) during a step of opening the package (100), the package (100) being configured for defining a closed condition wherein:

the closing film (10) and support (1) interdict the access to the housing compartment (5), and the removable portion (21) is aligned with at least one portion (6*a*) of the perimetral edge (6) from which the removable portion (21) extends as a prolongation;

wherein:

the removable portion (21) exhibits a cavity (21*a*) the concavity whereof, at least in the closed condition of the package, faces the perimetral edge (6), the gripping portion (22) is disposed, at least in the closed condition of the package, inside the cavity (21*a*) of the removable portion (21), wherein the support extends, in thickness, between:

a first surface of a heat-sealable material configured for receiving the closing film (10) in engagement, and a second surface of a material not heat-sealable with the closing film (10), wherein at least the perimetral edge (6) and the removable portion (21) are defined superficially by said first surface of heat-sealable material, wherein the gripping portion (22) comprises a portion of the support folded above the perimetral edge (6) so that the gripping portion (22) is externally defined by the second not heat-sealable surface.

3. Package according to claim 1, wherein the gripping portion (22), at least in the closed condition of the package, is interposed between the removable portion (21) and the perimetral edge (6), optionally the gripping portion (22), at least in the closed condition of the package, is interposed between the removable portion (21) and the portion (6*a*) of the perimetral edge (6) from which said removable portions extend as a prolongation.

4. Package according to claim 1, wherein the gripping portion (22), in the closed condition of the package, exhibits an upper surface, which:

at least partially abuts against the closing film (10), is disengaged from said closing film (10).

5. Package according to claim 1, wherein the closing film (10) is of a plastic material, the closing film being heat-sealed only to the perimetral edge (6) of the support (1) and to the removable portion (21), the closing film (10) being not heat-sealed to said gripping portion (22).

6. Package according to claim 1, wherein the removable portion (21), in the closed condition, is coplanar with at least said portion (6*a*) of the perimetral edge (6) from which the removable portion extends as a prolongation.

7. Package according to claim 1, wherein the gripping portion (22) is integrally joined to the perimetral edge (6) of the support (1).

8. Package according to claim 1, wherein the gripping portion (22) extends as a prolongation of the perimetral edge (6) away from the base (2), wherein the gripping portion (22) extends as a prolongation of the portion (6*a*) of the perimetral edge (6), from which, in the closed condition of the package, the removable portion (21) extends as a prolongation, wherein the gripping portion (22) is coplanar with at least said portion (6*a*) of the perimetral edge (6).

9. Package according to claim 1, wherein the perimetral edge (6) comprises an external flange (30) which lies on a plane, wherein the closing film (10) is engaged with the flange (30), the gripping portion (22) extending at least partially along a respective plane parallel to the lying plane of the flange (30), optionally the gripping portion (22) is at least partially coplanar with the flange (30) of the perimetral edge (6).

10. Package according to claim 1 or, wherein the support portion (22*a*) of the gripping portion (22) is integrally joined to the perimetral edge (6), optionally the support portion (22*a*) of the gripping portion (22) is integrally joined to the flange (30) of the perimetral edge (6).

11. Package according to claim 1, wherein the package (100) is configured for defining a pre-opening condition wherein:

the closing film (10) and the support (1) interdict the access to the housing compartment (5), optionally the closing film (10) is stably engaged with the perimetral edge (6) for defining said fluid-tight housing compartment (5) for the product (P), the removable portion (21) is at least partially raised, optionally angularly offset, from the gripping portion (22), wherein in the pre-opening condition of the package, the closing film (10) is distanced from the gripping portion (22) so that such gripping portion is grippable by an user.

12. Package according to claim 1, wherein the removable portion (21), in the closed condition of the package, is:

joined to the perimetral edge (6) only by means of the closing film (10); or integrally joined to the perimetral edge (6) of the support (1) by at least one weakening portion (25) of the support (1), said weakening portion (25) being configured for ensuring the separation of the removable portion (21) from the perimetral edge (6) of the support (1) during a step of opening the package (100) following the closed condition.

13. Package according to claim 1, wherein the base (2) of the support (1) comprises a bottom wall (8) and a lateral wall (7), said lateral wall (7) emerging, in height, from the bottom wall (8) transversally to this latter, and defining, cooperatively with said bottom wall (8), a containment seat adapted to receive the product (P), wherein the flange (30) of the perimetral edge (6) emerges from the lateral wall (7) according to a direction exiting from the containment seat, said flange (30) being distanced from the bottom wall (8), wherein the gripping portion (22) is supported by, optionally integrally joined to, the flange (30) and emerges from this latter away from the lateral wall (7).

14. Package according to claim 1, wherein the support (1) comprises at least one angular portion (11), the removable portion (21) being disposed at the at least one angular portion (11), optionally the removable portion (21) defines at least part of said angular portion (11), wherein the gripping portion (22) is disposed at said at least one angular portion (11), optionally the gripping portion (22) and removable portion (21) are disposed at a same angular portion (11) of the support (1).

15. Package according to claim 1, wherein the removable portion (21) comprises a tab having a substantially "L" or "C" or "U" or "V" shape defining said cavity (21*a*) the concavity thereof faces the base (2) of the support (1), the gripping portion (22*b*) being completely contained in the cavity of said removable portion (21).

16. Package according to claim 1, wherein the gripping portion (22) comprises a folded portion of the support (1), wherein the support extends, in thickness, between a first surface of a heat-sealable material, and a second surface of a material not heat-sealable with the closing film (10), wherein at least the perimetral edge (6) and removable portion (21) are superficially defined by said first upper surface of heat-sealable material, wherein the gripping portion (22) comprises a portion of the support folded above the perimetral edge (6) so that the gripping portion (22) is externally defined by the second not heat-sealable surface.

17. Package according to claim 2, wherein the perimetral edge (6) and the removable portion (21) are delimited, on one side by the second surface of a not heat-sealable material in which the gripping portion is delimited on both sides, defined the thickness of said gripping portion, by the second not heat-sealable surface.

* * * * *